US008621676B2

(12) United States Patent
Morotomi et al.

(10) Patent No.: US 8,621,676 B2
(45) Date of Patent: Jan. 7, 2014

(54) SANITARY WASHING DEVICE

(75) Inventors: Yo Morotomi, Fukuoka-ken (JP); Ayumu Umemoto, Fukuoka-ken (JP); Koichiro Matsushita, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 179 days.

(21) Appl. No.: 12/891,020

(22) Filed: Sep. 27, 2010

(65) Prior Publication Data

US 2011/0072570 A1 Mar. 31, 2011

(30) Foreign Application Priority Data

Sep. 28, 2009 (JP) ..... 2009-223338
Mar. 26, 2010 (JP) ..... 2010-073258
Mar. 26, 2010 (JP) ..... 2010-073259

(51) Int. Cl.
*E03D 11/02* (2006.01)

(52) U.S. Cl.
USPC ..... 4/420.2

(58) Field of Classification Search
USPC ..... 4/420.2, 420, 420.1, 420.4, 447, 443, 4/615
See application file for complete search history.

(56) References Cited

U.S. PATENT DOCUMENTS 4,370,764 A * 2/1983 Ando et al. ..... 4/443
5,970,528 A * 10/1999 Shirai et al. ..... 4/420.2
2006/0096017 A1* 5/2006 Yamasaki et al. ..... 4/420

FOREIGN PATENT DOCUMENTS

EP 1536075 A1 6/2005
JP 2001-279745 A 10/2001
JP 3487447 B2 1/2004
WO 95/32922 A1 12/1995
WO 2006/135166 A1 12/2006
WO 2007/004790 A1 1/2007
WO 2009/136772 A2 11/2009

OTHER PUBLICATIONS

European Search Report for 10175628.6 dated Jan. 19, 2011.

* cited by examiner

*Primary Examiner* — Lori Baker
(74) *Attorney, Agent, or Firm* — Pearne & Gordon LLP

(57) ABSTRACT

A sanitary washing device includes: a nozzle including a water discharge port and configured to squirt water from the water discharge port to wash user's human private parts; a flow channel configured to supply the water to the water discharge port; a water supply device configured to supply the water; a sterilizing water producing device provided midway along the flow channel and being operable to produce sterilizing water; and a controller configured to perform control for retaining the sterilizing water produced by the sterilizing water producing device for a prescribed time in the flow channel, and then draining the sterilizing water out of the flow channel.

18 Claims, 27 Drawing Sheets

| ppm | 0 | 5 sec | 30 sec | 1 min | 10 min | 1 hour |
|---|---|---|---|---|---|---|
| 0 mg/L | 2.2E+5 | 2.4E+5 | 2.2E+5 | 2.5E+5 | 2.5E+5 | 1.2E+5 |
| 0.1 mg/L | | 2.5E+5 | 2.5E+5 | 2.6E+5 | 1 | <1 |
| 0.3 mg/L | | 1.8E+5 | <1 | <1 | <1 | <1 |
| 0.5 mg/L | | <1 | <1 | <1 | <1 | <1 |
| 1.0 mg/L | | <1 | <1 | <1 | <1 | <1 |

| ppm | 0 | 5 sec | 30 sec | 1 min | 10 min | 1 hour |
|---|---|---|---|---|---|---|
| 0 mg/L | 1.8E+5 | 1.6E+5 | 1.8E+5 | 1.5E+5 | 1.1E+5 | 3.0E+4 |
| 0.1 mg/L | | 1.7E+5 | 4.1E+4 | 2.5E+3 | 153 | 33 |
| 0.3 mg/L | | 7.5E+4 | <1 | <1 | <1 | <1 |
| 0.5 mg/L | | 2.0E+0 | <1 | <1 | <1 | <1 |
| 1.0 mg/L | | <1 | <1 | <1 | <1 | <1 |

| ppm | 0 | 5 sec | 30 sec | 1 min | 10 min | 1 hour |
|---|---|---|---|---|---|---|
| 0 mg/L | 1.2E+5 | 1.8E+5 | 1.6E+5 | 2.1E+5 | 1.4E+5 | 9.0E+4 |
| 0.1 mg/L | | 2.5E+5 | 1.3E+5 | 4.2E+3 | <1 | <1 |
| 0.3 mg/L | | 1.7E+5 | 2.5E+2 | 1.0E+1 | <1 | <1 |
| 0.5 mg/L | | 7.8E+4 | 2.0E+1 | <1 | <1 | <1 |
| 1.0 mg/L | | 7.9E+2 | <1 | <1 | <1 | <1 |

| ppm | 0 | 5 sec | 30 sec | 1 min | 10 min | 1 hour |
|---|---|---|---|---|---|---|
| 0 mg/L | 1.6E+5 | 1.5E+5 | 1.5E+5 | 1.7E+5 | 1.8E+5 | 1.5E+5 |
| 0.1 mg/L | | 1.6E+5 | 3.1E+4 | 7.4E+2 | 2.4E+2 | 78 |
| 0.3 mg/L | | 9.1E+4 | 5 | 20 | <1 | <1 |
| 0.5 mg/L | | 3.6E+3 | <1 | <1 | <1 | <1 |
| 1.0 mg/L | | 1.9E+2 | <1 | <1 | <1 | <1 |

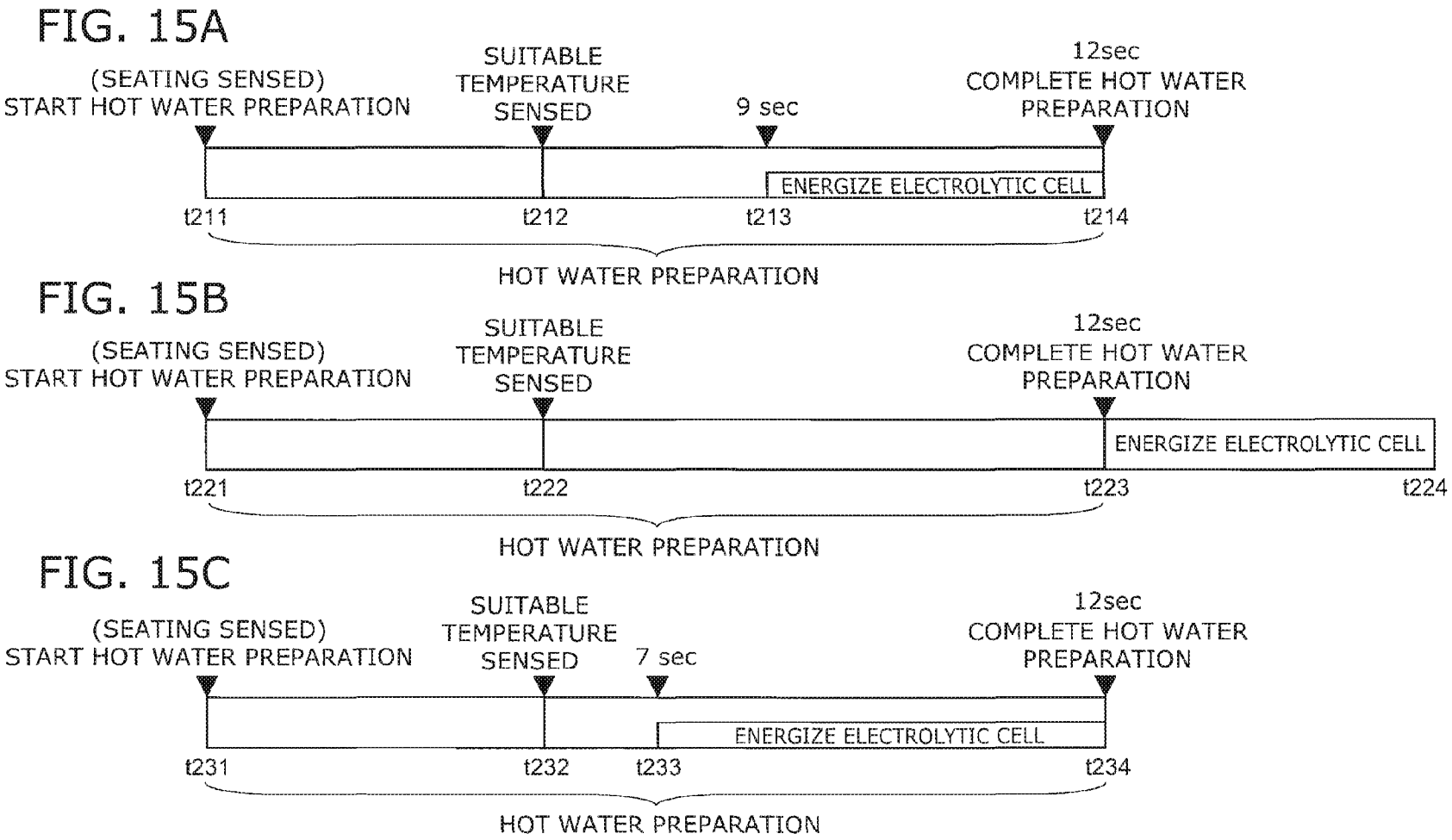
FIG. 15A
(SEATING SENSED)
START HOT WATER PREPARATION
SUITABLE TEMPERATURE SENSED
9 sec
12sec
COMPLETE HOT WATER PREPARATION
ENERGIZE ELECTROLYTIC CELL
t211
t212
t213
t214
HOT WATER PREPARATION
FIG. 15B
(SEATING SENSED)
START HOT WATER PREPARATION
SUITABLE TEMPERATURE SENSED
12sec
COMPLETE HOT WATER PREPARATION
ENERGIZE ELECTROLYTIC CELL
t221
t222
t223
t224
HOT WATER PREPARATION
FIG. 15C
(SEATING SENSED)
START HOT WATER PREPARATION
SUITABLE TEMPERATURE SENSED
7 sec
12sec
COMPLETE HOT WATER PREPARATION
ENERGIZE ELECTROLYTIC CELL
t231
t232
t233
t234
HOT WATER PREPARATION FIG. 18A
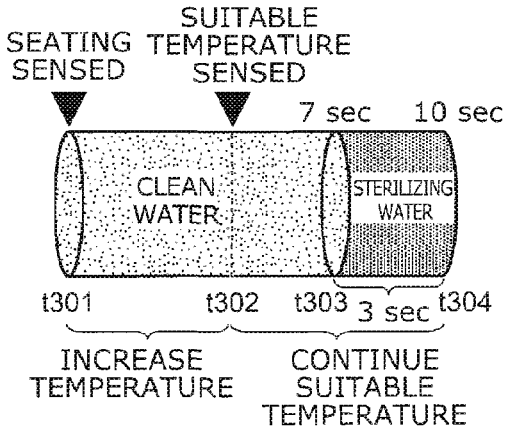
FIG. 18B
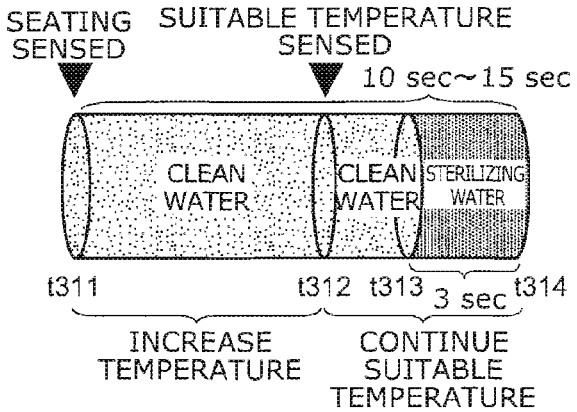
FIG. 18C
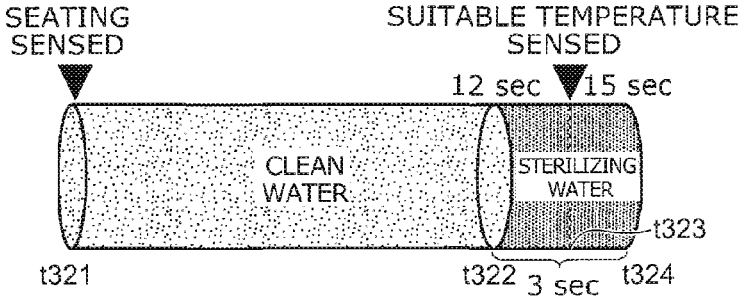
FIG. 19
| INCOMING WATER TEMPERATURE | SUITABLE TEMPERATURE CONTINUATION TIME |
|---|---|
| INCOMING WATER TEMPERATURE≦5°C | 3 sec (CLEAN WATER) + 3 sec (STERILIZING WATER) |
| 5°C<INCOMING WATER TEMPERATURE≦10°C | 2 sec (CLEAN WATER) + 3 sec (STERILIZING WATER) |
| 10°C<INCOMING WATER TEMPERATURE≦15°C | 1 sec (CLEAN WATER) + 3 sec (STERILIZING WATER) |
| 15°C<INCOMING WATER TEMPERATURE | 3 sec (STERILIZING WATER) |

SANITARY WASHING DEVICE

CROSS-REFERENCE TO RELATED APPLICATIONS

This application is based upon and claims the benefit of priorities from the prior Japanese Patent Application No. 2009-223338, filed on Sep. 28, 2009, the prior Japanese Patent Application No. 2010-073258, filed on Mar. 26, 2010 and the prior Japanese Patent Application No. 2010-073259, filed on Mar. 26, 2010; the entire contents of which are incorporated herein by reference.

BACKGROUND

1. Technical Field

Embodiments described herein relate generally to a sanitary washing device, and more particularly to a sanitary washing device for washing with water the "bottom" and other parts of a user seated on a sit-down toilet stool.

2. Background Art

When a washing nozzle for private parts washing squirts wash water at the private parts, at least part of the washing nozzle is exposed (advanced) outside from the casing installed with prescribed functional components including the washing nozzle and a hot water tank. Hence, dirt and dirty water may be attached to the washing nozzle. In this context, there is a sanitary washing device which cleans away dirt and dirty water attached to the washing nozzle before and/or after private parts washing. This keeps the washing nozzle clean.

However, in a humid environment such as a toilet room, even after dirt and dirty water attached to the washing nozzle are cleaned away, bacteria may grow on the washing nozzle over time. More specifically, bacteria such as methylobacteria, called pink slime, and black mold grow on the bowl surface of the toilet stool. Such bacteria may be attached to the washing nozzle and multiplied thereon. Multiplication of bacteria results in an aggregation of bacteria and their secretion (slime, black stain), called biofilm. The biofilm is difficult to remove by the normal nozzle cleaning as mentioned above.

In this context, Japanese Patent No. 3487447 proposes a sanitary washing device. In this sanitary washing device, an electrolytic cell is connected to the flow channel for supplying wash water. The electrolytic cell produces water containing hypochlorous acid. This water is regularly supplied to sterilize the washing nozzle so as to avoid biofilm formation. On the other hand, International Publication Pamphlet WO 95/32922 proposes an electrolyzing device and electrolyzing method for producing water containing hypochlorous acid. In the electrolyzing device and electrolyzing method described in WO 95/32922, running water containing chlorine ions flows into an electrolytic cell, and is electrolyzed after being heated. Hence, the generation efficiency of free chlorine can be increased.

Thus, bacteria attached to the washing nozzle and bacteria in the flow channel to the washing nozzle are sterilized, and formation of biofilm is suppressed. However, for instance, some mold is not sterilized by the sterilization process of several seconds and may partly survive in the flow channel. Furthermore, after performing the sterilization process, if the user does not use the sanitary washing device for some time, such mold may multiply.

In some devices, the sterilization process for sterilizing the washing nozzle with sterilizing water containing hypochlorous acid or silver ions is performed during a sequence of operations. For instance, in the case of no use for a long time during travels and the like, bacteria are intensively multiplied and may cause clogging in the drain pipe with a small diameter. In view of this situation, JP-A-2001-279745 discloses a human body washing device equipped with a silver ion electrolytic device. In this device, silver ion electrolytic water is passed and filled throughout the water channel on the downstream side of the silver ion electrolytic device. When the non-use state continues for a long time, the power of silver ion electrolytic water for suppressing multiplication of bacteria may be weakened. To prevent this, the human body washing device equipped with a silver ion electrolytic device described in JP-A-2001-279745 renews silver ion electrolytic water at regular intervals for passing water.

On the other hand, Japanese Patent No. 3487447 discloses a private parts washing device. In this device, the private parts washing water is clean water or gray water. The nozzle cleaning water exhibits stronger disinfectant or sterilizing property than the private parts washing water. The nozzle cleaning device includes a nozzle cleaning water producing unit for changing the property of clean water or gray water to produce the nozzle cleaning water. In the private parts washing device described in Japanese Patent No. 3487447, liquid chemical is used to clean the nozzle device. Hence, as compared with the conventional cleaning by showering only the wash water, dirt can be effectively removed. Furthermore, the effect of sterilizing and removing bacteria is highly expected.

However, in the human body washing device equipped with a silver ion electrolytic device described in JP-A-2001-279745, the extent of the weakening of the power of silver ion electrolytic water for suppressing multiplication of bacteria due to prolonged non-use state generally depends on the amount of remaining bacteria and the like. In the device described in JP-A-2001-279745, when the human body sensing device senses a user, the silver ion electrolytic water is drained. Subsequently, with the power feed to the silver ion electrolytic device stopped, heated water is discharged from the water discharge port for human body washing. Then, the sterilizing power may decrease, and bacteria may multiply. Thus, the hot wash water may be contaminated with bacteria.

SUMMARY

According to an aspect of the invention, there is provided a sanitary washing device, including: a nozzle including a water discharge port and configured to squirt water from the water discharge port to wash user's human private parts; a flow channel configured to supply the water to the water discharge port; a water supply device configured to supply the water; a sterilizing water producing device provided midway along the flow channel and being operable to produce sterilizing water; and a controller configured to perform control for retaining the sterilizing water produced by the sterilizing water producing device for a prescribed time in the flow channel, and then draining the sterilizing water out of the flow channel.

BRIEF DESCRIPTION OF THE DRAWINGS

FIGS. 15A to 15C are conceptual schematic diagrams illustrating operations of the hot water preparation of the sanitary washing device according to this embodiment;

FIGS. 18A to 18C are conceptual schematic diagrams illustrating examples of the hot water preparation of this embodiment;

FIG. 19 is a correspondence table showing the correspondence between the incoming water temperature and the suitable temperature continuation time in the hot water preparation;

DETAILED DESCRIPTION

Figure 1:
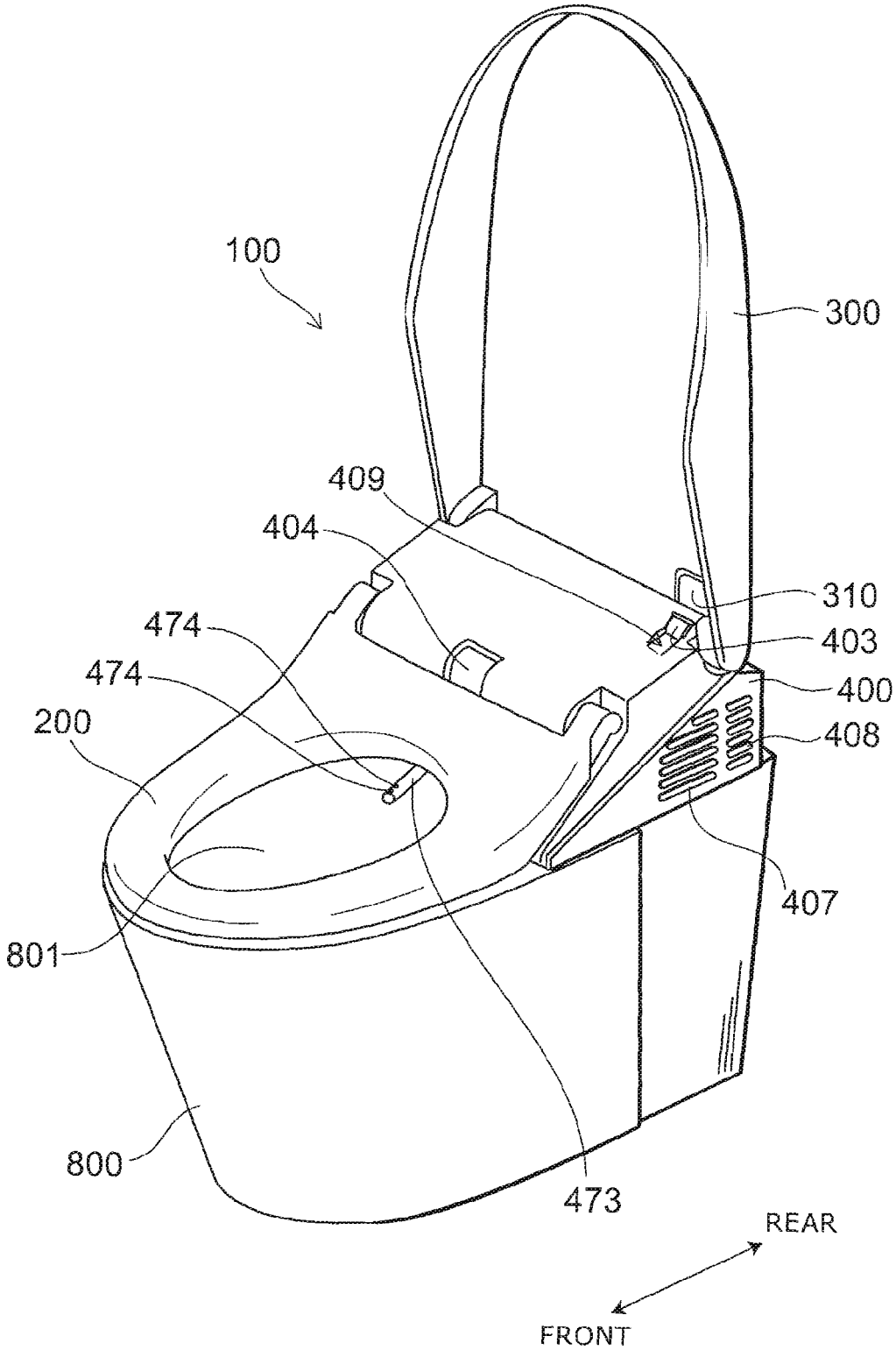
FIG. 1 is a perspective schematic view showing a toilet device equipped with a sanitary washing device according to an embodiment of the invention.

According to a first aspect of the invention, a sanitary washing device includes: a nozzle including a water discharge port and configured to squirt water from the water discharge port to wash user's human private parts; a flow channel configured to supply the water to the water discharge port; a water supply device configured to supply the water; a sterilizing water producing device provided midway along the flow channel and being operable to produce sterilizing water; and a controller configured to perform control for retaining the sterilizing water produced by the sterilizing water producing device for a prescribed time in the flow channel, and then draining the sterilizing water out of the flow channel.

In this sanitary washing device, the controller can cause the sterilizing water producing device to supply sterilizing water into the flow channel and can retain the sterilizing water for a prescribed time inside the flow channel. Furthermore, after retaining the sterilizing water for a prescribed time inside the flow channel, the controller can drain the sterilizing water out of the flow channel. Thus, the sanitary washing device of this invention retains the sterilizing water for a prescribed time inside the flow channel. Hence, bacteria surviving inside the flow channel can be reliably sterilized. Furthermore, the sanitary washing device of this invention drains the sterilizing water out of the flow channel after retaining the sterilizing water for a prescribed time inside the flow channel. Hence, even if the sterilizing power of the sterilizing water is decreased over time, the action of the sterilizing water as a nutrient source for bacteria can be suppressed.

According to a second aspect of the invention, the sanitary washing device of the first aspect further includes a human body sensing device configured to sense utilization by the user, wherein the controller performs control for filling the flow channel on downstream side of the sterilizing water producing device with the sterilizing water after the human body sensing device senses utilization by the user.

In this sanitary washing device, after the human body sensing device senses utilization by a user, the controller performs control for filling the flow channel on the downstream side of the sterilizing water producing device with sterilizing water. Thus, the flow channel on the downstream side of the sterilizing water producing device is filled and sterilized with the sterilizing water. That is, when there is a possibility that a user utilizes the sanitary washing device, the controller can earlier supply the sterilizing water to the flow channel on the downstream side of the sterilizing water producing device. Thus, bacteria surviving inside the flow channel can be sterilized at an earlier stage after sensing the possibility of utilization of the sanitary washing device.

Furthermore, in the sanitary washing device of this invention, the sterilizing water can be filled and retained for a prescribed time inside the flow channel. Thus, bacteria surviving inside the flow channel can be sterilized more reliably so that hygienic water can be squirted from the water discharge port of the nozzle. Furthermore, even when a male user urinates in the standing position, urine can be prevented from entering the flow channel from the water discharge port because the flow channel on the downstream side of the sterilizing water producing device is filled with the sterilizing water.

According to a third aspect of the invention, the sanitary washing device of the second aspect further includes a heating device provided on upstream side of the sterilizing water producing device and being operable to heat water supplied to the sterilizing water producing device, wherein the controller performs hot water preparation for operating the water supply device and the heating device to drain the water from the water discharge port when the human body sensing device senses the user, and the controller controls a timing to activate the sterilizing water producing device after starting the hot water preparation based on a time period required to fill the flow channel on the downstream side of the sterilizing water producing device with the sterilizing water.

In this sanitary washing device, when the human body sensing device senses a user, the controller performs hot water preparation for draining water from the water discharge port by controlling the operation of the water supply device and the heating device. At this time, the sterilizing water produced in the sterilizing water producing device can be supplied to the flow channel and retained for a prescribed time inside the flow channel. Thus, bacteria surviving inside the flow channel can be sterilized more reliably so that hygienic water can be squirted from the water discharge port.

Furthermore, based on the time period required to fill the flow channel on the downstream side of the sterilizing water producing device with sterilizing water, the controller controls the timing to activate the sterilizing water producing device after starting the hot water preparation. Thus, the flow channel on the downstream side of the sterilizing water producing device can be filled with a smaller amount of sterilizing water. Hence, wasteful drainage of the sterilizing water can be suppressed. Furthermore, for instance, in the case where the sterilizing water producing device includes electrodes, the energization time of the electrodes can be made shorter. Thus, the lifetime of the electrodes can be increased.

According to a fourth aspect of the invention, in the sanitary washing device of the third aspect, the controller starts to activate the sterilizing water producing device during or after completing the hot water preparation.

In this sanitary washing device, the controller starts to activate the sterilizing water producing device during or after completing the hot water preparation. Thus, there is no need to take into consideration the influence of variation in the temperature of water. This facilitates controlling the sterilizing water producing device and the heating device.

According to a fifth aspect of the invention, the sanitary washing device of the third aspect further includes a first temperature sensing device configured to sense temperature of the water heated by the heating device, wherein the controller starts to activate the sterilizing water producing device when the temperature sensed by the first temperature sensing device reaches a preset temperature.

In this sanitary washing device, after the temperature sensed by the first temperature sensing device reaches a preset temperature, the controller starts to activate the sterilizing water producing device. Thus, while the temperature sensed by the first temperature sensing device is stable, the controller activates the sterilizing water producing device. This determines the time period of the operation performed after the temperature sensed by the first temperature sensing device reaches the preset temperature. Furthermore, the timing to stop activating the sterilizing water producing device is determined. This can suppress wasteful production of sterilizing water in the sterilizing water producing device, wasteful passage of sterilizing water in the flow channel, and wasteful drainage of sterilizing water from the water discharge port.

According to a sixth aspect of the invention, in the sanitary washing device of the third aspect, the controller starts to activate the sterilizing water producing device after lapse of a fixed time from the start of the hot water preparation.

In this sanitary washing device, after the lapse of a fixed time from the start of the hot water preparation, the controller starts to activate the sterilizing water producing device. Thus, there is no need to take into consideration the influence of variation in the temperature sensed by the first temperature sensing device. This facilitates controlling the sterilizing water producing device and the heating device.

According to a seventh aspect of the invention, the sanitary washing device of the third aspect further includes a second temperature sensing device configured to sense temperature of water supplied to the heating device, wherein the controller sets a suitable temperature continuation time required to fill the flow channel on the downstream side of the sterilizing water producing device with the water heated by the heating device based on the temperature sensed by the second temperature sensing device, and starts to activate the sterilizing water producing device based on the suitable temperature continuation time so that a timing to stop activating the sterilizing water producing device coincides with or precedes a timing to complete the hot water preparation.

In this sanitary washing device, based on the temperature sensed by the second temperature sensing device, the controller sets a suitable temperature continuation time required to fill the flow channel on the downstream side of the sterilizing water producing device with the water heated by the heating device. Then, the controller starts to activate the sterilizing water producing device based on the suitable temperature continuation time so that the timing to stop activating the sterilizing water producing device coincides with or precedes the timing to complete the hot water preparation.

There may be variation in the temperature sensed by the second temperature sensing device, or variation in the timing at which the temperature sensed by the first temperature sensing device reaches the preset temperature. Despite such variations, the controller can start to activate the sterilizing water producing device so that the timing to stop activating the sterilizing water producing device coincides with the timing to complete the hot water preparation, while ensuring the water passage time of the sterilizing water. Thus, even if the temperature sensed by the second temperature sensing device varies, it is possible to suppress wasteful production of sterilizing water in the sterilizing water producing device, wasteful passage of sterilizing water in the flow channel, and wasteful drainage of sterilizing water from the water discharge port.

According to a eighth aspect of the invention, the sanitary washing device of the third aspect further includes a second temperature sensing device configured to sense temperature of water supplied to the heating device, wherein the controller includes a memory device configured to store a suitable temperature continuation time required to fill the flow channel on the downstream side of the sterilizing water producing device with the water heated by the heating device based on the temperature sensed by the second temperature sensing device, and starts to activate the sterilizing water producing device by referring to a past one of the suitable temperature continuation time stored in the memory device so that a timing to stop activating the sterilizing water producing device coincides with or precedes a timing to complete the hot water preparation.

In this sanitary washing device, by referring to the past suitable temperature continuation time stored in the memory device, the controller starts to activate the sterilizing water producing device so that the timing to stop activating the sterilizing water producing device coincides with or precedes the timing to complete the hot water preparation. Thus, the controller can refer to the past suitable temperature continuation time. This can further suppress wasteful production of sterilizing water in the sterilizing water producing device, wasteful passage of sterilizing water in the flow channel, and wasteful drainage of sterilizing water from the water discharge port.

According to a ninth aspect of the invention, in the sanitary washing device of the second aspect, the human body sensing device is a room entry sensor operable to sense entry of a user into a toilet room.

In this sanitary washing device, the human body sensing device is a room entry sensor operable to sense entry of a user into a toilet room. Thus, after the room entry sensor senses a user just entering the toilet room, the controller can supply sterilizing water to the flow channel on the downstream side of the sterilizing water producing device. Hence, the sterilizing water can be retained for a longer time inside the flow channel on the downstream side of the sterilizing water producing device.

Furthermore, even in the case where the controller performs hot water preparation after the user is seated on the toilet seat, the hot water preparation is not started yet before the user is seated on the toilet seat. Thus, before the user is seated on the toilet seat, the flow channel on the downstream side of the sterilizing water producing device is filled with sterilizing water at lower temperature. The reproductive power of bacteria is weaker in the environment at lower temperature than in the environment at higher temperature. Hence, before the user is seated on the toilet seat, bacteria surviving inside the flow channel can be sterilized more efficiently.

According to a tenth aspect of the invention, the sanitary washing device of the second aspect further includes a toilet lid, wherein the human body sensing device is a toilet lid opening/closing sensing device operable to sense an opening motion of the toilet lid.

In this sanitary washing device, a toilet lid opening/closing sensing device operable to sense the opening motion of the toilet lid is provided. The toilet lid opening/closing sensing device can sense utilization by a user. Thus, even without a room entry sensor operable to sense entry of a user into the toilet room, the controller can perform control for filling the flow channel on the downstream side of the sterilizing water producing device with the sterilizing water after the toilet lid opening/closing sensing device senses the opening motion of the toilet lid. Hence, the flow channel on the downstream side of the sterilizing water producing device is filled and sterilized with the sterilizing water.

According to a eleventh aspect of the invention, in the sanitary washing device of the first aspect, the controller performs a cleaning step configured to clean the nozzle, and performs the control for retaining continuously subsequent to the cleaning step.

In this sanitary washing device, the controller performs a cleaning step for cleaning the nozzle, and retains the sterilizing water for a prescribed time inside the flow channel continuously subsequent to the cleaning step. Thus, after performing the cleaning step for cleaning the nozzle, the inside of the flow channel can be elaborately sterilized. Hence, bacteria surviving inside the flow channel can be sterilized more reliably.

According to a twelfth aspect of the invention, in the sanitary washing device of the first aspect, the controller performs the control for retaining after the user ceases to be sensed.

In this sanitary washing device, the controller performs the control for retaining after the user ceases to be sensed. Thus, the inside of the flow channel can be sterilized after the user performs bottom washing.

According to a thirteenth aspect of the invention, in the sanitary washing device of the twelfth aspect, the controller senses leaving of the user from a toilet seat.

In this sanitary washing device, the controller performs the control for retaining after the user leaves the toilet seat. Thus, the sterilizing water can be retained for a longer time inside the flow channel. Hence, bacteria surviving inside the flow channel can be sterilized more reliably.

According to a fourteenth aspect of the invention, in the sanitary washing device of the first aspect, the controller regularly performs the control for retaining and the control for draining.

In this sanitary washing device, the controller regularly performs the control for retaining the sterilizing water inside the flow channel and the control for draining the sterilizing water out of the flow channel. Thus, the inside of the flow channel can be regularly sterilized. Hence, bacteria surviving inside the flow channel can be sterilized more reliably, and multiplication of bacteria inside the flow channel can be suppressed more reliably.

According to a fifteenth aspect of the invention, the sanitary washing device of the first aspect further includes a human body sensing device operable to sense the user, wherein the controller performs the control for retaining when the human body sensing device senses the user, and the controller performs the control for draining in response to receipt of a signal directing to perform washing of the human private parts.

In this sanitary washing device, the controller performs the control for retaining the sterilizing water inside the flow channel when the human body sensing device senses a user. Furthermore, the controller performs the control for draining the sterilizing water out of the flow channel in response to receipt of a signal for washing the human private parts. Thus, the inside of the flow channel can be sterilized before the user performs "bottom washing".

Here, the time period for retaining the sterilizing water inside the flow channel is the time from when the controller retains the sterilizing water inside the flow channel until the controller receives the signal for washing the human private parts. That is, in this invention, the time period for retaining the sterilizing water inside the flow channel varies with the time period for e.g. the user's act of using the toilet. When the controller receives the signal for washing the human private parts, the sterilizing water retained inside the flow channel is replaced by newly supplied water and drained. Thus, even if the sterilizing power of the sterilizing water is decreased over time, the action of the sterilizing water as a nutrient source for bacteria can be suppressed.

According to a sixteenth aspect of the invention, the sanitary washing device of the first aspect further includes a nozzle cleaning device including a water discharge portion and configured to clean a surface of the nozzle with water discharged from the water discharge portion, wherein the controller discharges the sterilizing water from the water discharge portion, and then completes the hot water preparation by discharging the sterilizing water from only the water discharge port of the nozzle.

In this sanitary washing device, the controller discharges the sterilizing water from the water discharge portion, and then completes the hot water preparation by discharging the sterilizing water from only the water discharge port. Thus, the drainage water flowing out in cleaning the body of the nozzle does not enter the flow channel from the water discharge port. Furthermore, the flow channel on the downstream side of the sterilizing water producing device can be filled with the sterilizing water down to the water discharge port located at the end of the flow channel.

According to a seventeenth aspect of the invention, in the sanitary washing device of the first aspect, the sterilizing water producing device is an electrolytic cell.

In this sanitary washing device, a solution containing hypochlorous acid superior in sterilizing power can be produced in the electrolytic cell. The sterilizing water produced in the electrolytic cell is not limited thereto. A solution containing metal ions such as silver ions or copper ions can be produced in the electrolytic cell. Alternatively, a solution containing electrolytic chlorine or ozone, and acid water or alkaline water can be produced. Thus, bacteria surviving inside the flow channel can be sterilized more effectively.

According to a eighteenth aspect of the invention, in the sanitary washing device of the seventeenth aspect, flow rate of water supplied to the electrolytic cell in producing the sterilizing water is lower than maximum flow rate of water flowing in the electrolytic cell.

In this sanitary washing device, when the sterilizing water is produced in the electrolytic cell, the controller sets the flow rate of water supplied to the electrolytic cell to a flow rate lower than the maximum flow rate. This further increases the efficiency of producing the sterilizing water in the electrolytic cell. Hence, the concentration of the sterilizing water retained inside the flow channel can be made higher.

Embodiments of the invention will now be described with reference to the drawings. In the drawings, similar components are labeled with like reference numerals, and the detailed description thereof is omitted as appropriate.

FIG. 1 is a perspective schematic view showing a toilet device equipped with a sanitary washing device according to an embodiment of the invention.

Figure 2:
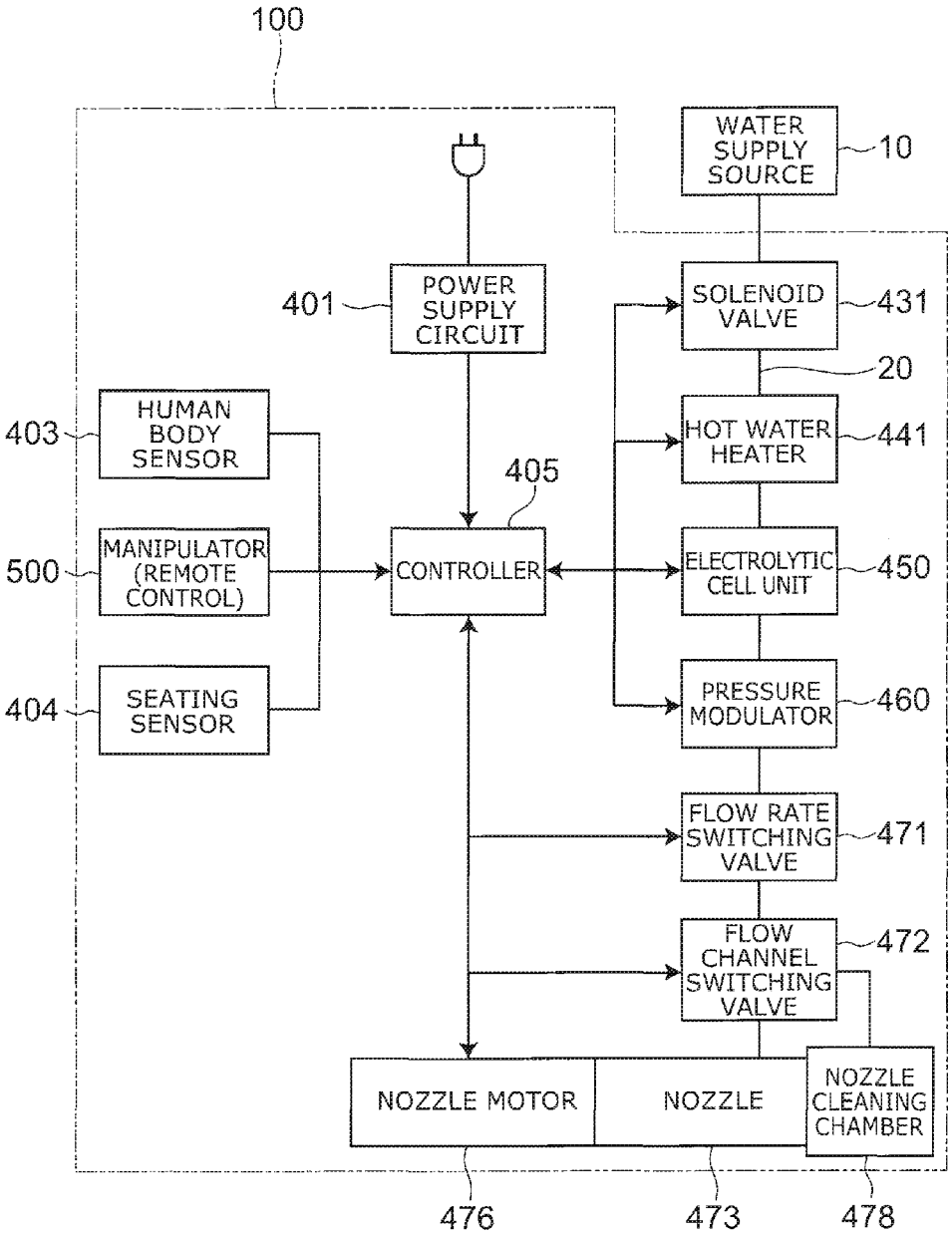
FIG. 2 is a block diagram showing the relevant configuration of the sanitary washing device according to this embodiment.

FIG. 2 is a block diagram showing the relevant configuration of the sanitary washing device according to this embodiment. In FIG. 2, the relevant configuration of the water channel system and the electrical system is shown together.

The toilet device shown in FIG. 1 includes a sit-down toilet stool (hereinafter simply referred to as "toilet stool" for convenience of description) 800 and a sanitary washing device 100 provided thereon. The sanitary washing device 100 includes a casing 400, a toilet seat 200, and a toilet lid 300. The toilet seat 200 and the toilet lid 300 are each pivotally supported on the casing 400 in an openable/closable manner.

The casing 400 includes therein e.g. a private parts washing functional part for washing the "bottom" and other parts of a user seated on the toilet seat 200. Furthermore, for instance, the casing 400 includes a seating sensor (human body sensing device) 404 for sensing seating of a user on the toilet seat 200. When the seating sensor 404 is sensing a user seated on the toilet seat 200, the user can manipulate a manipulator 500 such as a remote control to advance a washing nozzle (hereinafter simply referred to as "nozzle" for convenience of description) 473 into the bowl 801 of the toilet stool 800. In the sanitary washing device 100 shown in FIG. 1, the nozzle 473 is shown as being advanced into the bowl 801.

One or more water discharge ports 474 are provided at the tip of the nozzle 473. The nozzle 473 can squirt water from the water discharge port 474 provided at its tip to wash the "bottom" and other parts of the user seated on the toilet seat 200. Here, the term "water" used herein refers not only to cold water, but also to heated hot water.

More specifically, as shown in FIG. 2, the sanitary washing device 100 according to this embodiment includes a flow channel 20 for guiding water supplied from a water supply source 10 such as a water tap or a flush tank to the water discharge port 474 of the nozzle 473. A solenoid valve 431 is provided on the upstream side of the flow channel 20. The solenoid valve 431 is an openable/closable solenoid valve, and regulates water supply based on commands from a controller 405 provided inside the casing 400. Here, the flow channel 20 refers to the downstream side or secondary side of the solenoid valve 431.

A hot water heater 441 is provided downstream of the solenoid valve 431. The hot water heater 441 heats supplied water to hot water at a prescribed temperature. The temperature of the hot water can be configured by e.g. the user manipulating the manipulator 500.

An electrolytic cell unit (sterilizing water producing device) 450 operable to produce sterilizing water is provided downstream of the hot water heater 441. This electrolytic cell unit 450 is described later in detail.

A pressure modulator 460 is provided downstream of the electrolytic cell unit 450. This pressure modulator 460 provides pulsation to the flow of water in the flow channel 20. Thus, the pressure modulator 460 can provide pulsation to the water discharged from the water discharge port 474 of the nozzle 473.

A flow rate switching valve 471 for adjusting the water force (flow rate), and a flow channel switching valve 472 for opening/closing and switching water supply to the nozzle 473 and the nozzle cleaning chamber 478 are provided downstream of the pressure modulator 460. Here, as in the example described later with reference to FIG. 3, the flow rate switching valve 471 and the flow channel switching valve 472 may be provided as a single unit. Furthermore, a nozzle 473 is provided downstream of the flow rate switching valve 471 and the flow channel switching valve 472.

The nozzle 473 can be advanced into or retracted from the bowl 801 of the toilet stool 800 under a driving force from a nozzle motor 476. That is, the nozzle motor 476 can advance/retract the nozzle 473 based on commands from the controller 405.

Furthermore, the controller 405 is supplied with electrical power from a power supply circuit 401. The controller 405 can receive signals from a human body sensor (human body sensing device) 403, a seating sensor 404, and a manipulator 500. Based on these signals, the controller 405 can control the operation of the solenoid valve 431, hot water heater 441, electrolytic cell unit 450, pressure modulator 460, flow rate switching valve 471 and flow channel switching valve 472, and nozzle motor 476.

As shown in FIG. 1, the human body sensor 403 is embedded in a recess 409 formed in the upper surface of the casing 400. The human body sensor 403 can sense a user (human body) approaching the toilet seat 200. Furthermore, a transmissive window 310 is provided at the rear of the toilet lid 300. Hence, in the closed state of the toilet lid 300, the human body sensor 403 can sense the presence of a user through the transmissive window 310. For instance, when the human body sensor 403 senses a user, the controller 405 can automatically open the toilet lid 300 based on the sensing result of the human body sensor 403.

The casing 400 may further include various mechanisms as appropriate, such as a "warm air drying function" for blowing warm air at and drying the "bottom" and other parts of the user seated on the toilet seat 200, a "deodorizing unit", and a "room heating unit". In this case, an exhaust port 407 for the deodorizing unit and a vent 408 for the room heating unit are provided as appropriate on the side surface of the casing 400.

However, in this invention, the sanitary washing functional part and other added functional parts are not necessarily needed.

Figure 3:
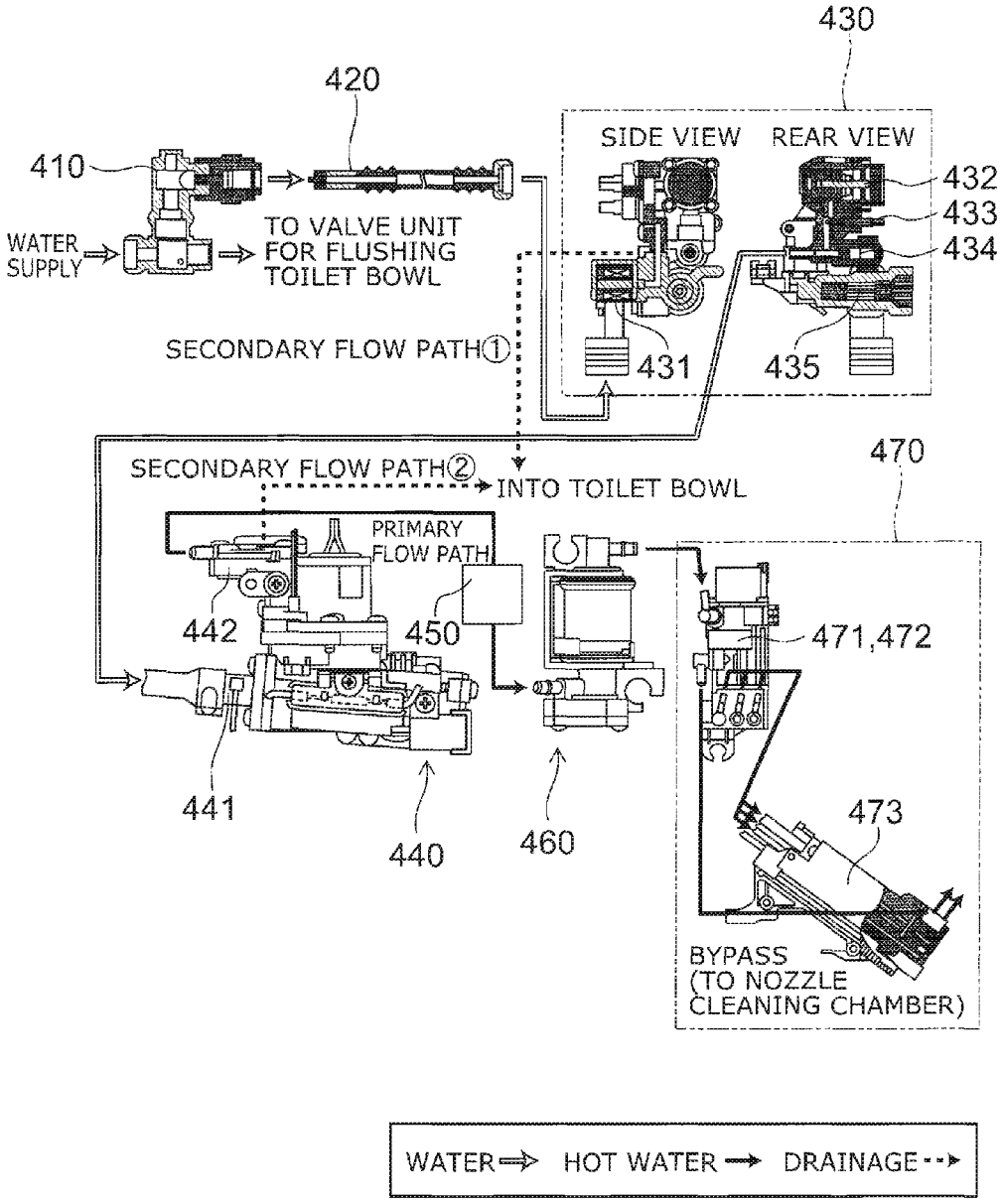
FIG. 3 is a block diagram illustrating an example of the relevant configuration of the water channel system of the sanitary washing device according to this embodiment.

FIG. 3 is a block diagram illustrating an example of the relevant configuration of the water channel system of the sanitary washing device according to this embodiment.

Figure 4:
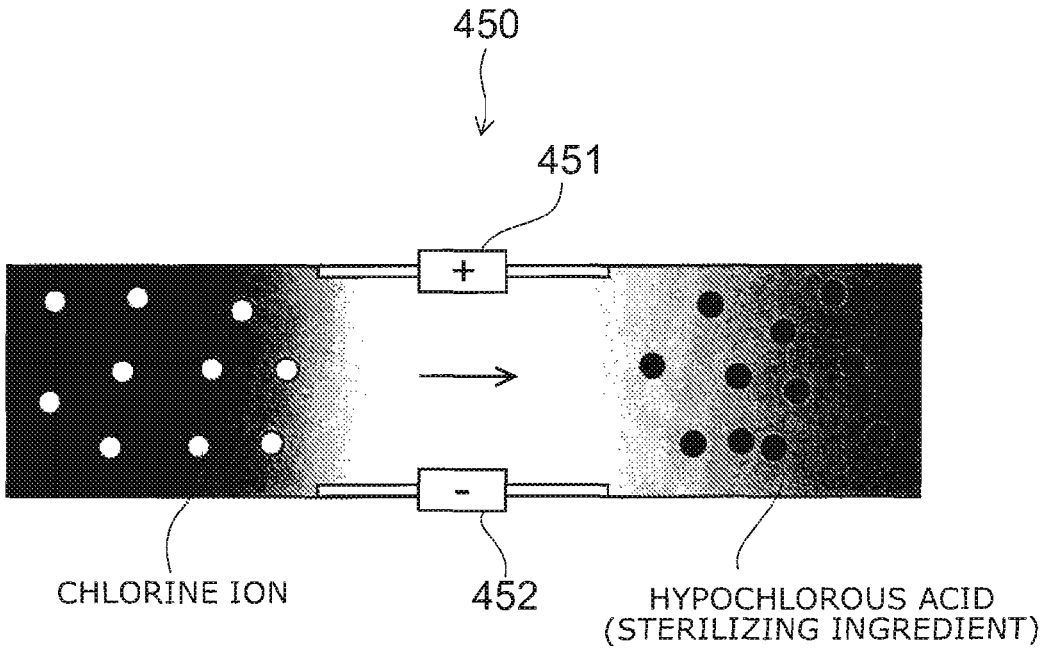
FIG. 4 is a sectional schematic view illustrating an example of the electrolytic cell unit of this embodiment.

FIG. 4 is a sectional schematic view illustrating an example of the electrolytic cell unit of this embodiment.

Figure 5:
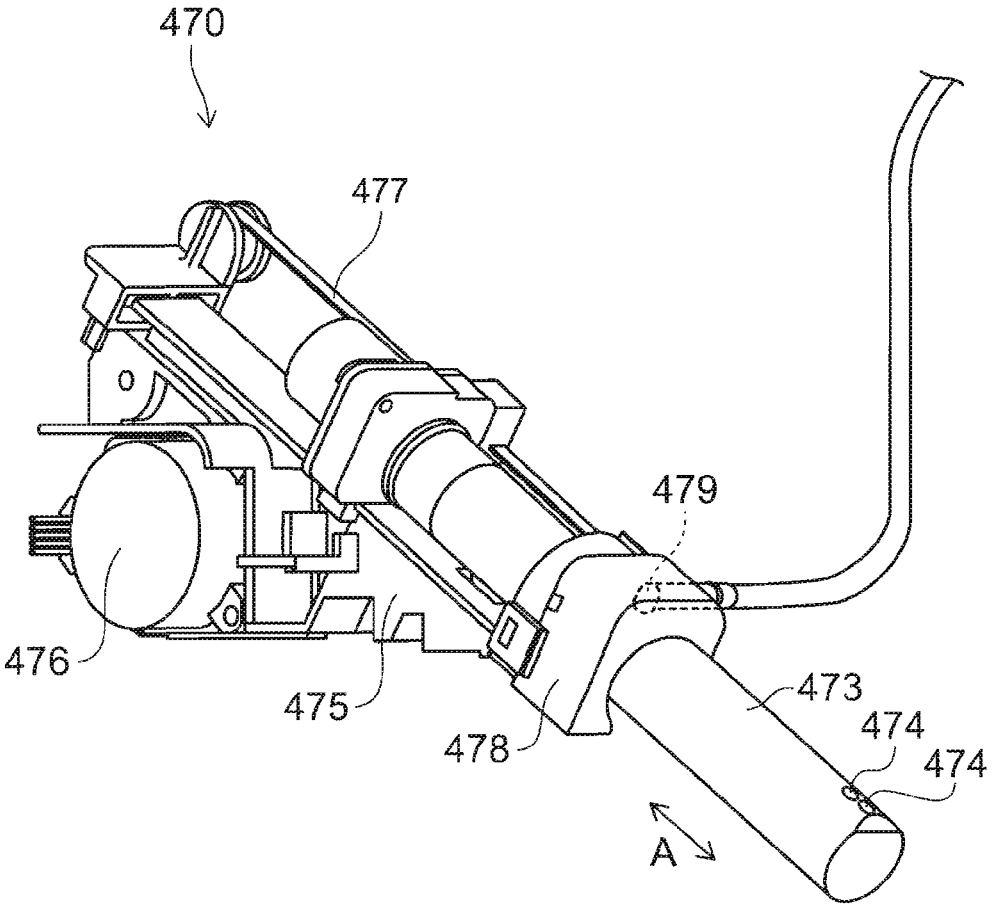
FIG. 5 is a perspective schematic view illustrating an example of the nozzle unit of this embodiment.

FIG. 5 is a perspective schematic view illustrating an example of the nozzle unit of this embodiment.

As shown in FIG. 3, water supplied from the water supply source 10 is first guided to a metal branch 410. The water guided to the metal branch 410 is distributed to a coupling hose 420, and to a valve unit for flushing the toilet bowl, not shown. However, the toilet device equipped with the sanitary washing device 100 according to this embodiment is not limited to the so-called "water tap direct pressure type", but may be of the so-called "low tank type". Hence, in the case where the toilet device is of the "low tank type", the water guided to the metal branch 410 is guided to a low tank, not shown, instead of the valve unit for flushing the toilet bowl.

Next, the water supplied to the coupling hose 420 is guided to a valve unit (water supply device) 430. The valve unit 430 includes a solenoid valve 431, a pressure regulator valve 432, an incoming water thermistor 433, a safety valve 434, and a drain plug 435. The pressure regulator valve 432 serves to regulate the water supply pressure to within a prescribed pressure range when the water supply pressure is high. The incoming water thermistor 433 senses the temperature of water guided to a heat exchanger unit 440 and outputs the information of the water temperature to the controller 405. The safety valve 434 is opened to drain water to the bowl 801 of the toilet stool 800 when the pressure of the flow channel 20 is increased. Thus, for instance, even if failure in the pressure regulator valve 432 results in increasing the pressure of the flow channel 20 on the secondary (downstream) side thereof, the safety valve 434 can prevent water leakage inside the sanitary washing device 100. The drain plug 435 is used when, for instance, the water in the flow channel 20 may be frozen. The drain plug 435 can drain the water in the flow channel 20. The solenoid valve 431 is as described above.

Next, the water supplied to the valve unit 430 is guided to a heat exchanger unit 440. The heat exchanger unit (heating device) 440 includes a hot water heater 441 and a vacuum breaker 442. The vacuum breaker 442 prevents backflow of dirty water from the nozzle 473 when, for instance, negative pressure occurs in the valve unit 430. Furthermore, when the flow channel 20 is drained, the vacuum breaker 442 takes in air from outside to facilitate draining the flow channel 20 between the heat exchanger unit 440 and the nozzle unit 470. The water from the vacuum breaker 442 is drained to the bowl 801 of the toilet stool 800.

Next, the water supplied to the heat exchanger unit 440 and heated to a prescribed temperature is guided to the electrolytic cell unit 450. As described above with reference to FIGS. 1 and 2, the electrolytic cell unit 450 can produce sterilizing water. Here, the electrolytic cell unit 450 of this embodiment is described with reference to the drawings.

As shown in FIG. 4, the electrolytic cell unit 450 includes therein an anode plate 451 and a cathode plate 452. Under energization controlled by the controller 405, the electrolytic cell unit 450 can electrolyze tap water flowing therein. Here, the tap water contains chlorine ions. Such chlorine ions are contained as salt (NaCl) and calcium chloride ($CaCl_2$) in water sources (e.g., groundwater and water in dams and rivers). Thus, hypochlorous acid is produced by electrolysis of the chlorine ions. Consequently, the water electrolyzed in the electrolytic cell unit 450 turns into a liquid containing hypochlorous acid.

Hypochlorous acid functions as a sterilizing ingredient. A solution containing hypochlorous acid, i.e., sterilizing water, can efficiently remove or decompose and sterilize dirt such as resulting from ammonia. Here, the term "sterilizing water" used herein refers to a solution containing a sterilizing ingredient such as hypochlorous acid more than tap water (also simply referred to as "water").

Thus, the tap water supplied from the heat exchanger unit 440 is electrolyzed in the electrolytic cell unit 450 and turns into a solution containing hypochlorous acid. The solution is guided to the nozzle unit 470 through the pressure modulator 460. As shown in FIG. 3, the nozzle unit 470 includes a flow rate switching valve 471, a flow channel switching valve 472, and a nozzle 473. By the flow channel switching valve 472, sterilizing water supplied from the electrolytic cell unit 450 through the pressure modulator 460 can be guided to the water discharge port 474 of the nozzle 473 or to the nozzle cleaning chamber 478 (see FIGS. 2 and 5). Here, the nozzle unit 470 is described with reference to the drawings.

As shown in FIG. 5, the nozzle unit 470 of this embodiment includes a mounting stage 475 as a base stage, a nozzle 473 supported on the mounting stage 475, and a nozzle motor 476 for moving the nozzle 473. The nozzle 473 is provided so as to be slidable with respect to the mounting stage 475, as indicated by arrow A shown in FIG. 5, by the driving force transmitted from the nozzle motor 476 through a transmission member 477 such as a belt. That is, the nozzle 473 can linearly move in its own axial direction (advancing/retracting direction). The nozzle 473 can reciprocably move from the casing 400 and the mounting stage 475.

Furthermore, the nozzle unit 470 of this embodiment includes a nozzle cleaning chamber 478. The nozzle cleaning chamber 478 is fixed to the mounting stage 475. The nozzle cleaning chamber 478 can sterilize or clean the outer peripheral surface (body) of the nozzle 473 by squirting sterilizing water or water from a water discharge portion 479 provided inside the nozzle cleaning chamber 478. Specifically, when the controller 405 energizes the anode plate 451 and the cathode plate 452 of the electrolytic cell unit 450 to produce sterilizing water, the body of the nozzle 473 is sterilized with the sterilizing water squirted from the water discharge portion 479. On the other hand, when the controller 405 does not energize the anode plate 451 and the cathode plate 452 of the electrolytic cell unit 450, the body of the nozzle 473 is physically cleaned with water squirted from the water discharge portion 479.

More specifically, when the nozzle 473 is housed in the casing 400, the water discharge port 474 region of the nozzle 473 is substantially housed in the nozzle cleaning chamber 478. Hence, the nozzle cleaning chamber 478 can sterilize or clean the water discharge port 474 region of the nozzle 473 in the housed state by squirting sterilizing water or water from the water discharge portion 479 provided inside the nozzle cleaning chamber 478. Furthermore, the nozzle cleaning chamber 478 can sterilize or clean not only the water discharge port 474 region but also the outer peripheral surface of the other region by squirting water or sterilizing water from the water discharge portion 479 when the nozzle 473 is advanced/retracted.

Furthermore, when the nozzle 473 is housed in the casing 400, the nozzle 473 of this embodiment can sterilize or clean the water discharge port 474 region by squirting sterilizing water or water from the water discharge port 474 of the nozzle 473 itself. Furthermore, when the nozzle 473 is housed in the casing 400, the water discharge port 474 region of the nozzle 473 is substantially housed in the nozzle cleaning chamber 478. Hence, the sterilizing water or water discharged from the water discharge port 474 of the nozzle 473 is reflected by the inner wall of the nozzle cleaning chamber 478 and splashed on the water discharge port 474 region. Thus, the water discharge port 474 region of the nozzle 473 is sterilized or cleaned also with the sterilizing water or water reflected by the inner wall of the nozzle cleaning chamber 478.

Thus, the outer peripheral surface and the water discharge port 474 region of the nozzle 473 are sterilized with the sterilizing water produced in the electrolytic cell unit 450. However, for instance, some mold is not sterilized by the sterilization process of several seconds and may partly survive inside the flow channel 20. Furthermore, after performing the sterilization process, if the user does not use the sanitary washing device 100 for some time, such mold may multiply.

In contrast, the sanitary washing device 100 according to this embodiment can supply the sterilizing water produced in the electrolytic cell unit 450 to the flow channel 20 and retain the sterilizing water for a prescribed time inside the flow channel 20 (sterilizing water retaining step). In this step, the flow channel switching valve 472 can be closed to facilitate retaining the sterilizing water inside the flow channel 20. In particular, because the flow channel extending to the water discharge port 474 of the nozzle 473 is prone to pollution, this embodiment is effective. Furthermore, when the sterilizing water is retained inside the flow channel 20, injection of the sterilizing water into the flow channel 20 is preferably performed after completely replacing the water remaining inside the flow channel 20. Furthermore, after retaining the sterilizing water for a prescribed time inside the flow channel 20, the sanitary washing device 100 according to this embodiment can drain the sterilizing water out of the flow channel 20 (draining step).

Thus, in the sanitary washing device 100, the sterilizing water is retained for a prescribed time inside the flow channel 20. Hence, bacteria surviving inside the flow channel 20 can be sterilized more reliably. This is one of the effective means in the case where the flow channel 20 is formed from an antibacterial metal with weaker sterilizing power. Furthermore, in the sanitary washing device 100, after retaining the sterilizing water for a prescribed time inside the flow channel 20, the sterilizing water is drained out of the flow channel 20. Hence, even if the sterilizing power of the sterilizing water is decreased over time, the action of the sterilizing water as a nutrient source for bacteria can be suppressed. In the following, these operations are described with reference to the drawings.

Figure 6:
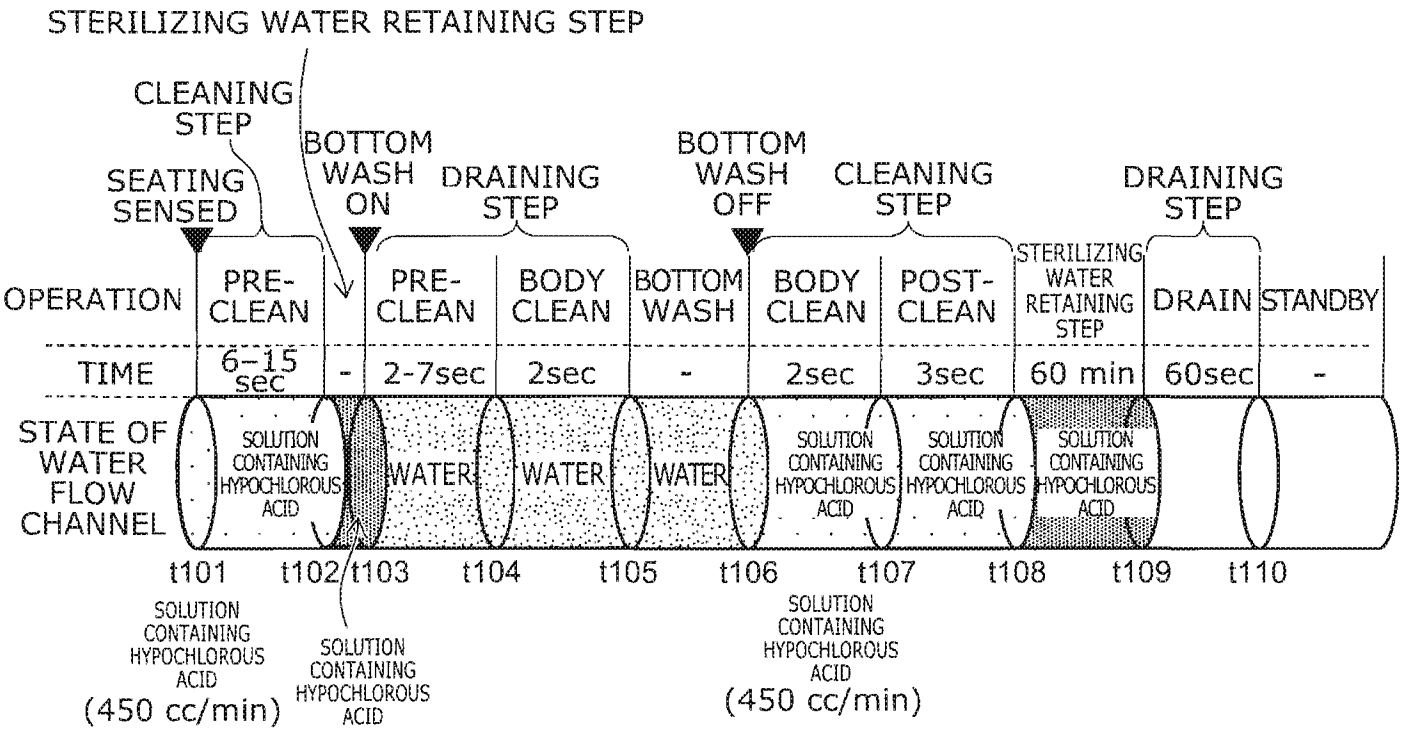
FIG. 6 is a conceptual schematic diagram generally showing the operation and the state of the flow channel of the sanitary washing device according to this embodiment.

FIG. 6 is a conceptual schematic diagram generally showing the operation and the state of the flow channel of the sanitary washing device according to this embodiment.

First, when the seating sensor 404 senses a user seated on the toilet seat 200, the controller 405 opens the solenoid valve 431 to perform "water discard". Thus, cold water in the flow channel 20 is drained for hot water preparation.

Next, the controller 405 energizes the electrolytic cell unit 450 to produce sterilizing water. Then, the controller 405 controls the flow rate switching valve 471 and the flow channel switching valve 472, thereby discharging the sterilizing water from all the plurality of water discharge ports 474 to perform "pre-cleaning" of the water discharge port 474 region (timing t101-t102). At this time, because the sterilizing water is discharged from the water discharge port 474, the inside of the flow channel 20 and the water discharge port 474 region are sterilized with the sterilizing water. Here, the time period for performing the pre-cleaning with the sterilizing water is e.g. approximately 6-15 seconds.

Next, the controller 405 closes the solenoid valve 431. Until the "bottom washing switch", not shown, provided on the manipulator 500 is pressed by the user, the controller 405 waits on standby and keeps the temperature of water to be discharged from the water discharge port 474 (timing t102-t103). At this time, because the controller 405 closes the solenoid valve 431 and the flow channel switching valve 472, the sterilizing water produced in the electrolytic cell unit 450 can be retained for a prescribed time inside the flow channel 20 (sterilizing water retaining step). Thus, the inside of the flow channel 20 can be sterilized before the user performs "bottom washing".

This prescribed time refers to the time for which the sterilizing water is retained inside the flow channel 20, i.e., the time from when the controller 405 closes the solenoid valve and the flow channel switching valve 472 until the "bottom washing switch" is pressed by the user. Thus, this prescribed time varies with the time period for e.g. the user's act of using the toilet.

Next, when the user presses the "bottom washing switch", not shown, provided on the manipulator 500 (timing t103), the controller 405 receives a signal for performing private parts washing. Then, the controller 405 first performs "pre-cleaning" with water (timing t103-t104). More specifically, the controller 405 controls the flow rate switching valve 471 and the flow channel switching valve 472, thereby discharging water from all the plurality of water discharge ports 474 to clean these water discharge ports 474. At this time, the controller 405 does not energize the electrolytic cell unit 450, and does not produce sterilizing water. Hence, the region around the plurality of water discharge ports 474 is physically cleaned with water (including water reflected by the inner wall of the nozzle cleaning chamber 478) discharged by the water discharge ports 474 themselves.

In other words, the sterilizing water retained inside the flow channel 20 is drained from the water discharge port 474 by the newly supplied water. That is, the sterilizing water retained inside the flow channel 20 is replaced by the newly supplied water and drained (draining step). Here, the time period for performing the pre-cleaning with water is e.g. approximately 2-7 seconds.

Next, the controller 405 controls the flow rate switching valve 471 and the flow channel switching valve 472, thereby squirting water from the water discharge portion 479 provided in the nozzle cleaning chamber 478. Simultaneously, the controller 405 advances the nozzle 473 into the bowl 801. Thus, the body of the nozzle 473 is cleaned with water squirted from the water discharge portion 479 (timing t104-t105). At this time again, the controller 405 does not energize the electrolytic cell unit 450, and does not produce sterilizing water. Hence, the body of the nozzle 473 is physically cleaned with water squirted from the water discharge portion 479.

At this time again, the sterilizing water retained inside the flow channel 20 connected to the water discharge portion 479 is replaced by the newly supplied water and drained (draining step). Here, the time period for performing the body cleaning with water is e.g. approximately 2 seconds.

Next, the controller 405 controls the flow rate switching valve 471 and the flow channel switching valve 472, thereby squirting water from the water discharge port 474 for "bottom washing" to wash the "bottom" of the user seated on the toilet seat 200 (timing t105-t106). At this time, the controller 405 does not energize the electrolytic cell unit 450, and does not produce sterilizing water. Furthermore, the sterilizing water which was retained inside the flow channel 20 is replaced by the newly supplied water and drained at timing t103-t105. Hence, there is no case where the sterilizing water is squirted at the user's private parts.

Next, when the user presses the "stop switch", not shown, on the manipulator 500 (timing t106), the controller 405 controls the flow rate switching valve 471 and the flow channel switching valve 472, thereby squirting sterilizing water from the water discharge portion 479 provided in the nozzle cleaning chamber 478. Simultaneously, the controller 405 houses the nozzle 473 in the casing 400 (timing t106-t107). That is, the controller 405 energizes the electrolytic cell unit 450 to produce sterilizing water, and performs "body cleaning" of the nozzle 473 with the sterilizing water squirted from the water discharge portion 479 (timing t106-t107). Thus, the inside of the flow channel 20 and the outer peripheral surface of the nozzle 473 are sterilized with the sterilizing water. Here, the time period for performing the body cleaning with the sterilizing water is e.g. approximately 2 seconds.

Next, with the nozzle 473 housed in the casing 400, the controller 405 controls the flow rate switching valve 471 and the flow channel switching valve 472, thereby discharging sterilizing water from all the plurality of water discharge ports 474 to perform "post-cleaning" of these water discharge ports 474 (timing t107-t108). That is, the controller 405 energizes the electrolytic cell unit 450 to produce sterilizing water, and performs the post-cleaning of the water discharge port 474 region with the sterilizing water squirted from the water discharge port 474 (timing t107-t108). Thus, the inside of the flow channel 20 and the water discharge port 474 region are sterilized with the sterilizing water. Here, the time period for performing the post-cleaning with the sterilizing water is e.g. approximately 3 seconds.

Next, the controller 405 closes the solenoid valve 431, and then closes the flow channel switching valve 472, so that the sterilizing water produced in the electrolytic cell unit 450 is retained for a prescribed time inside the flow channel 20 (timing t108-t109, sterilizing water retaining step). Thus, after the user performs "bottom washing", the inside of the flow channel 20 can be sterilized. This prescribed time is e.g. approximately 60 minutes. Thus, in the sanitary washing device 100 according to this embodiment, the sterilizing water is retained for a longer time inside the flow channel 20. Hence, bacteria surviving inside the flow channel 20 can be sterilized more reliably.

Next, after the lapse of the prescribed time, the controller 405 performs "drainage" (timing t109-t110, draining step). That is, the controller 405 drains the sterilizing water inside the flow channel 20, thereby emptying the flow channel 20. The time period for performing this "drainage" is e.g. approximately 60 seconds. Thus, in the sanitary washing device 100 according to this embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

The controller 405 of this embodiment performs the cleaning step for cleaning the nozzle 473, and retains sterilizing water for a prescribed time inside the flow channel 20 continuously subsequent to the cleaning step. Here, the term "cleaning step" for cleaning the nozzle used herein refers to at least one of the pre-cleaning with the sterilizing water, the body cleaning with the sterilizing water, and the post-cleaning with the sterilizing water. Thus, after performing the cleaning step for cleaning the nozzle 473, the inside of the flow channel 20 can be elaborately sterilized. Hence, bacteria surviving inside the flow channel 20 can be sterilized more reliably.

Figure 7:
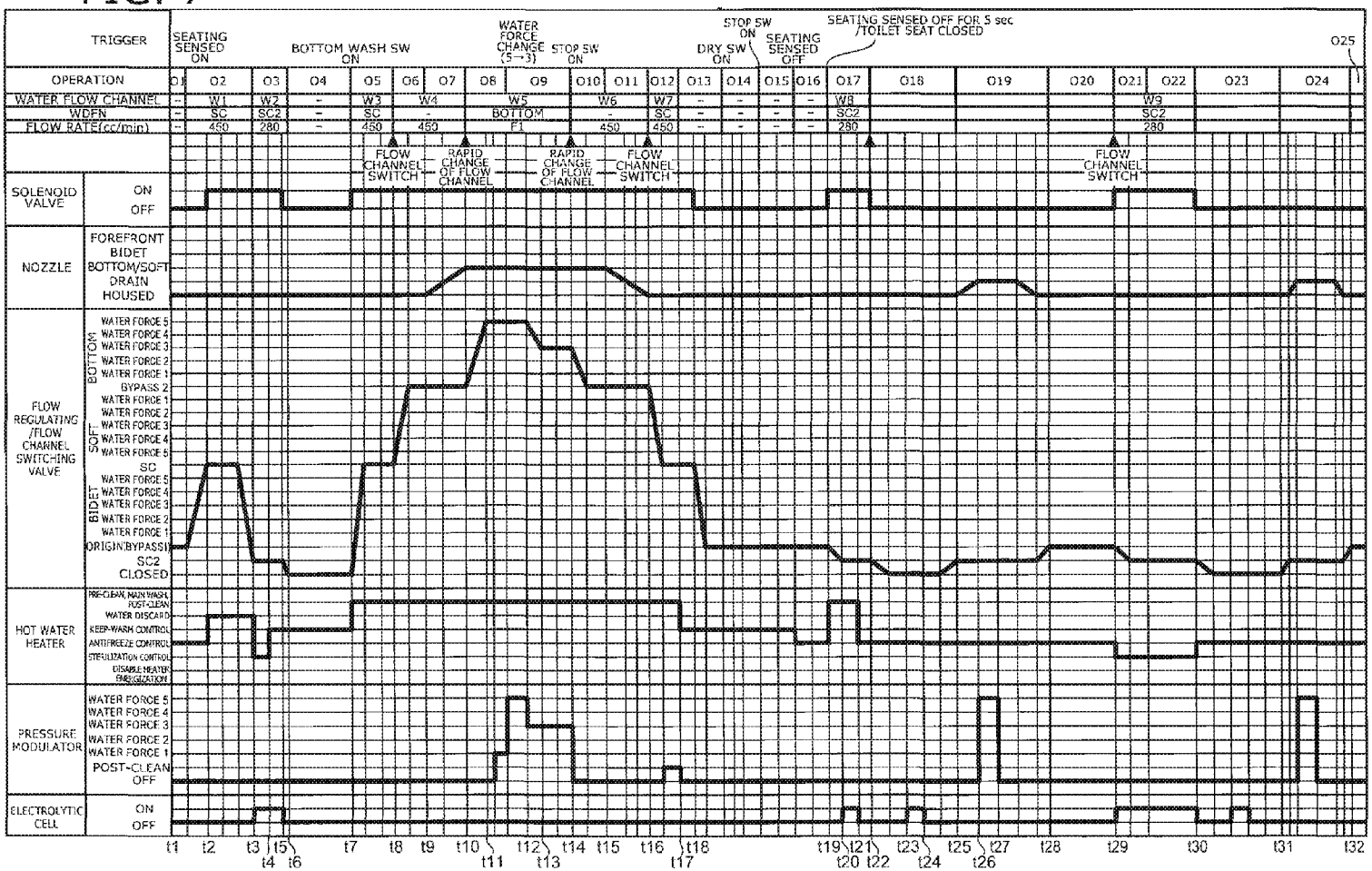
FIG. 7 is a timing chart illustrating an example operation of the sanitary washing device according to this embodiment.

FIG. 7 is a timing chart illustrating an example operation of the sanitary washing device according to this embodiment.

"O1" of "OPERATION" in FIG. 7 shows "STANDBY".

"O2" of "OPERATION" in FIG. 7 shows "HOT WATER PREPARATION". "O3" of "OPERATION" in FIG. 7 shows "PRE-CLEAN (PRE-STERILIZE)". "O4" of "OPERATION" in FIG. 7 shows "STERILIZING WATER RETAINING STEP (KEEP WARM)".

"O5" of "OPERATION" in FIG. 7 shows "PRE-CLEAN".

"O6" of "OPERATION" in FIG. 7 shows "DEPRESSURE".

"O7" of "OPERATION" in FIG. 7 shows "BODY CLEAN (ADVANCE NOZZLE)". "O8" of "OPERATION" in FIG. 7 shows "SOFT START". "O9" of "OPERATION" in FIG. 7 shows "MAIN WASH". "O10" of "OPERATION" in FIG. 7 shows "DEPRESSURE". "O11" of "OPERATION" in FIG. 7 shows "BODY CLEAN (HOUSE NOZZLE)". "O12" of "OPERATION" in FIG. 7 shows "POST-CLEAN". "O13" of "OPERATION" in FIG. 7 shows "KEEP WARM". "O14" of "OPERATION" in FIG. 7 shows "DRY". "O15" of "OPERATION" in FIG. 7 shows "KEEP WARM". "O16" of "OPERATION" in FIG. 7 shows "STANDBY". "O17" of "OPERATION" in FIG. 7 shows "POST-CLEAN (PRE-STERILIZE)". "O18" of "OPERATION" in FIG. 7 shows "STERILIZING WATER RETAINING STEP". "O19" of "OPERATION" in FIG. 7 shows "DRAIN". "O20" of "OPERATION" in FIG. 7 shows "STANDBY". "O21" of "OPERATION" in FIG. 7 shows "DEPRESSURE". "O22" of "OPERATION" in FIG. 7 shows "REGULAR STERILIZATION". "O23" of "OPERATION" in FIG. 7 shows "STERILIZING WATER RETAINING STEP".

"O24" of "OPERATION" in FIG. 7 shows "DRAIN".

"O25" of "OPERATION" in FIG. 7 shows "STANDBY".

"W1" to "W3" of "WATER FLOW CHANNEL" in FIG. 7 show "PRIMARY CHANNEL". "W4" of "WATER FLOW CHANNEL" in FIG. 7 shows "BYPASS". "W5" of "WATER FLOW CHANNEL" in FIG. 7 shows "PRIMARY CHANNEL". "W6" of "WATER FLOW CHANNEL" in FIG. 7 shows "BYPASS". "W7" to "W9" of "WATER FLOW CHANNEL" in FIG. 7 show "PRIMARY CHANNEL".

"WDFN" in FIG. 7 shows "WATER DISCHARGE FROM NOZZLE".

"F1" of "FLOW RATE (cc/min)" in FIG. 7 shows "FROM MINIMUM TO PRESET FLOW RATE (270-430)".

First, the seating sensor 404 senses a user seated on the toilet seat 200 (timing t1). Then, the controller 405 switches the flow rate switching valve 471 and the flow channel switching valve 472 from "origin" to "SC (self-cleaning)" to enable water discharge from all the water discharge ports 474 for "bottom washing" and "bidet washing". The flow rate (volume of water) at this time is e.g. approximately 450 cc/min.

Next, when the switching of the flow rate switching valve 471 and the flow channel switching valve 472 is completed (timing t2), the controller 405 opens the solenoid valve 431 and sets the hot water heater 441 to the "water discard mode". Thus, cold water in the flow channel 20 is drained for preparation of hot water. Next, the controller 405 switches the flow rate switching valve 471 and the flow channel switching valve 472 from "SC" to "SC2", thereby completing the hot water preparation. Then, the controller 405 starts to energize the electrolytic cell unit 450 to produce sterilizing water (timing t3).

The flow rate (volume of water) at this time is e.g. approximately 280 cc/min. That is, the flow rate at this time is lower than the flow rate during the hot water preparation (e.g., approximately 450 cc/min) and the flow rate during the pre-cleaning, body cleaning, and post-cleaning with water (e.g., approximately 450 cc/min). In other words, the controller 405 can produce sterilizing water at a preset flow rate independent of the flow rate in performing private parts washing. In this example, the flow rate during the hot water preparation and the flow rate during the pre-cleaning, body cleaning, and post-cleaning with water are set to the maximum flow rate. Thus, the controller 405 makes the flow rate of water supplied to the electrolytic cell unit 450 lower than the maximum flow rate. Hence, the concentration of hypochlorous acid in the sterilizing water produced in the electrolytic cell unit 450 can be made higher.

Furthermore, at this time, the controller 405 changes the setting of the hot water heater 441 from the "water discard mode" to the "sterilization control mode" (timing t3). The temperature of the hot water heater 441 at this time, i.e., the preset temperature of the hot water heater 441 in the "sterilization control mode", is equal to or higher than the maximum temperature of the preset temperature of the hot water heater 441 in performing private parts washing, i.e., the preset temperature of the hot water heater 441 in the "pre-cleaning mode, main washing mode, post-cleaning mode". In other words, the controller 405 can produce sterilizing water at a preset temperature independent of the temperature in performing private parts washing.

Thus, the controller 405 sets the hot water heater 441 to the "sterilization control mode" so that the temperature is set equal to or higher than the maximum temperature of water supplied from the hot water heater 441 in performing private parts washing. Hence, the concentration of hypochlorous acid in the sterilizing water produced in the electrolytic cell unit 450 can be made higher. Furthermore, because the concentration of hypochlorous acid in the sterilizing water can be made higher by setting the temperature equal to or higher than the maximum temperature in performing private parts washing, the controller 405 can suppress the decrease of the sterilizing power of the sterilizing water, and the sterilizing effect of the sterilizing water retained inside the flow channel 20 can be maintained for a longer time. Thus, the action of the sterilizing water as a nutrient source for bacteria can be suppressed.

At this time, the controller 405 has switched the flow rate switching valve 471 and the flow channel switching valve 472 to "SC2". Hence, as in the case of "SC", water discharge from all the water discharge ports 474 for "bottom washing" and "bidet washing" is enabled. Furthermore, the sterilizing water produced in the electrolytic cell unit 450 is discharged from the water discharge port 474. Hence, the inside of the flow channel 20 and the water discharge port 474 region are sterilized with the sterilizing water.

Next, the controller 405 changes the setting of the hot water heater 441 from the "sterilization control mode" to the "keep-warm control mode" (timing t4). Then, the controller 405 closes the solenoid valve 431, and stops energizing the electrolytic cell unit 450 (timing t5). Here, it is because of the so-called "after-boiling prevention" that the controller 405 closes the solenoid valve 431 after changing the setting of the hot water heater 441. That is, this is because the hot water heater 441 generates residual heat even after its setting is changed from the "sterilization control mode" to the "keep-warm control mode".

Next, the controller 405 switches the flow rate switching valve 471 and the flow channel switching valve 472 from "SC2" to "closed" (timing t6). Then, until the "bottom washing switch", not shown, provided on the manipulator 500 is pressed by the user, the controller 405 waits on standby and keeps the temperature of water to be discharged from the water discharge port 474 (timing t6-t7). At this time, because the controller 405 closes the solenoid valve 431 and the flow channel switching valve 472, the sterilizing water produced in the electrolytic cell unit 450 can be retained for a prescribed time inside the flow channel 20 (sterilizing water retaining step). Thus, the inside of the flow channel 20 can be sterilized before the user performs "bottom washing".

Next, when the user presses the "bottom washing switch", not shown, provided on the manipulator 500 (timing t7), the controller 405 receives a signal for performing private parts washing. Then, the controller 405 switches the flow rate switching valve 471 and the flow channel switching valve 472 from "closed" to "SC". Furthermore, the controller 405 opens the solenoid valve 431 and sets the hot water heater 441 to the "pre-cleaning mode, main washing mode, post-cleaning mode". At this time, the controller 405 does not energize the electrolytic cell unit 450, and does not produce sterilizing water. Hence, the water discharge port 474 region is cleaned with water discharged by the water discharge ports 474 themselves.

In other words, the sterilizing water retained inside the flow channel 20 is drained from the water discharge port 474 by the newly supplied water. That is, the sterilizing water retained inside the flow channel 20 is replaced by the newly supplied water and drained (draining step).

Next, the controller 405 switches the flow rate switching valve 471 and the flow channel switching valve 472 from "SC" to "bypass 2" so that water can be squirted from the water discharge portion 479 provided in the nozzle cleaning chamber 478 (timing t8). Next, the controller 405 advances the nozzle 473 housed in the casing 400 to the position of "bottom washing" (timing t9-t10). At this time, the controller 405 opens the solenoid valve 431, does not energize the electrolytic cell unit 450, and does not produce sterilizing water. Hence, the body of the nozzle 473 is cleaned with water squirted from the water discharge portion 479. Furthermore, the sterilizing water retained inside the flow channel 20 connected to the water discharge portion 479 is replaced by the newly supplied water and drained (draining step).

Next, the controller 405 switches the flow rate switching valve 471 and the flow channel switching valve 472 from "bypass 2" to "bottom water force 5" (timing t10-t11) and performs main washing (bottom washing) (timing t11-t12). Here, for instance, if the user changes the setting of the water force in "bottom washing" from "water force 5" to "water force 3" by the manipulator 500, then the controller 405 switches the flow rate switching valve 471 and the flow channel switching valve 472 from "bottom water force 5" to "bottom water force 3" (timing t12-t13). Then, the controller 405 continues main washing at "water force 3" (timing t13-t14).

In this main washing, the controller 405 does not energize the electrolytic cell unit 450, and does not produce sterilizing water. Furthermore, the sterilizing water which was retained inside the flow channel 20 is replaced by the newly supplied water and drained at timing t7-t10. Hence, there is no case where the sterilizing water is squirted at the user's private parts.

Next, when the user pushes a "stop switch", not shown, on the manipulator 500, the controller 405 switches the flow rate switching valve 471 and the flow channel switching valve 472 from "bottom water force 3" to "bypass 2" so that water can be squirted from the water discharge portion 479 provided in the nozzle cleaning chamber 478 (timing t14). Next, the controller 405 houses the nozzle 473 advanced to the position of "bottom washing" in the casing 400 (timing t15-t16). At this time, the controller 405 opens the solenoid valve 431, does not energize the electrolytic cell unit 450, and does not produce sterilizing water. Hence, the body of the nozzle 473 is cleaned with water squirted from the water discharge portion 479.

Next, with the nozzle 473 housed in the casing 400, the controller 405 switches the flow rate switching valve 471 and the flow channel switching valve 472 from "bypass 2" to "Sc". Thus, post-cleaning is performed by discharging water from all the water discharge ports 474 for "bottom washing" and "bidet washing" (timing t16-t17). At this time again, the controller 405 opens the solenoid valve 431, and does not energize the electrolytic cell unit 450. Hence, the water discharge port 474 region of the nozzle 473 is cleaned with water discharged by the water discharge ports 474 themselves.

Next, the controller 405 closes the solenoid valve 431 and switches the flow rate switching valve 471 and the flow channel switching valve 472 from "SC" to "origin" (timing t18). Next, the user performs "bottom drying" as appropriate and leaves the toilet seat 200. Then, after the lapse of a prescribed time (here, e.g., approximately 5 seconds), the controller 405 switches the flow rate switching valve 471 and the flow channel switching valve 472 from "origin" to "SC2" to enable water discharge from all the water discharge ports 474 for "bottom washing" and "bidet washing" (timing t19). Furthermore, the controller 405 opens the solenoid valve 431 and sets the hot water heater 441 to the "pre-cleaning mode, main washing mode, post-cleaning mode" (timing t19). Furthermore, the controller 405 starts to energize the electrolytic cell unit 450, and starts to produce sterilizing water (timing t20).

Thus, the post-cleaning of the nozzle 473 is performed with the sterilizing water produced in the electrolytic cell unit 450. That is, the sterilizing water produced in the electrolytic cell unit 450 is discharged from the water discharge port 474. Hence, the inside of the flow channel 20 and the water discharge port 474 region are sterilized with the sterilizing water. Thus, after the user performs "bottom washing", the inside of the flow channel 20 can be sterilized.

The flow rate (volume of water) at this time is e.g. approximately 280 cc/min. Thus, as described above, by decreasing the flow rate of water supplied to the electrolytic cell unit 450, the controller 405 can increase the concentration of hypochlorous acid in the sterilizing water produced in the electrolytic cell unit 450.

Next, the controller 405 stops energizing the electrolytic cell unit 450, and sets the hot water heater 441 to the "anti-freeze control mode" (timing t21). Subsequently, the controller 405 closes the solenoid valve 431 and the flow channel switching valve 472, so that the sterilizing water produced in the electrolytic cell unit 450 is retained for a prescribed time inside the flow channel 20 (timing t22-t25, sterilizing water retaining step). Thus, after the user performs "bottom washing", the inside of the flow channel 20 can be sterilized.

The time period for performing this sterilizing water retaining step is e.g. approximately 60 minutes. Thus, in the sanitary washing device 100 according to this embodiment, the sterilizing water is retained for a longer time inside the flow channel 20. Hence, bacteria surviving inside the flow channel 20 can be sterilized more reliably. Here, the controller 405 may energize the electrolytic cell unit 450 to supply sterilizing water (timing t23-t24) while retaining sterilizing water inside the flow channel 20 (timing t22-t25). Thus, even if the sterilizing power of the sterilizing water is decreased over time, the controller 405 can control the electrolytic cell unit 450 to supply new sterilizing water, thereby suppressing the decrease of sterilizing power.

Next, after the lapse of the prescribed time (e.g., approximately 60 minutes), the controller 405 switches the flow rate switching valve 471 and the flow channel switching valve 472 from "closed" to "SC2", and moves the nozzle 473 to the position of "drainage" (timing t25). Thus, the "drainage" of the flow channel 20 is performed (timing t25-t28, draining step). That is, the controller 405 drains the sterilizing water inside the flow channel 20, thereby emptying the flow channel 20. Thus, in the sanitary washing device 100 according to this embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

Here, while performing drainage of the flow channel 20, the controller 405 can accelerate the drainage by activating the pressure modulator 460 (timing t26-t27). More specifically, depending on the installation position of the flow channel 20, the heat exchanger unit 440, and the electrolytic cell unit 450, sterilizing water inside the flow channel 20 may not be completely drained simply by the height difference between their installation positions. In addition, depending on the internal structure of the electrolytic cell unit 450, and the distance between the anode plate 451 and the cathode plate 452 provided inside the electrolytic cell unit 450, sterilizing water inside the flow channel 20 may not be completely drained due to the resistance and surface tension of water inside the electrolytic cell unit 450. If sterilizing water is not drained from the flow channel 20 but remains therein, the sterilizing power of the sterilizing water is decreased over time, and the sterilizing water may act as a nutrient source for bacteria.

In contrast, while performing drainage of the flow channel 20, the controller 405 can actively drain the sterilizing water inside the flow channel 20 by activating the pressure modulator 460. This can suppress residual presence of sterilizing water inside the flow channel 20, and more reliably prevent the sterilizing water from acting as a nutrient source for bacteria.

Here, the pressure modulator 460 of this embodiment is described with reference to the drawings.

Figure 8:
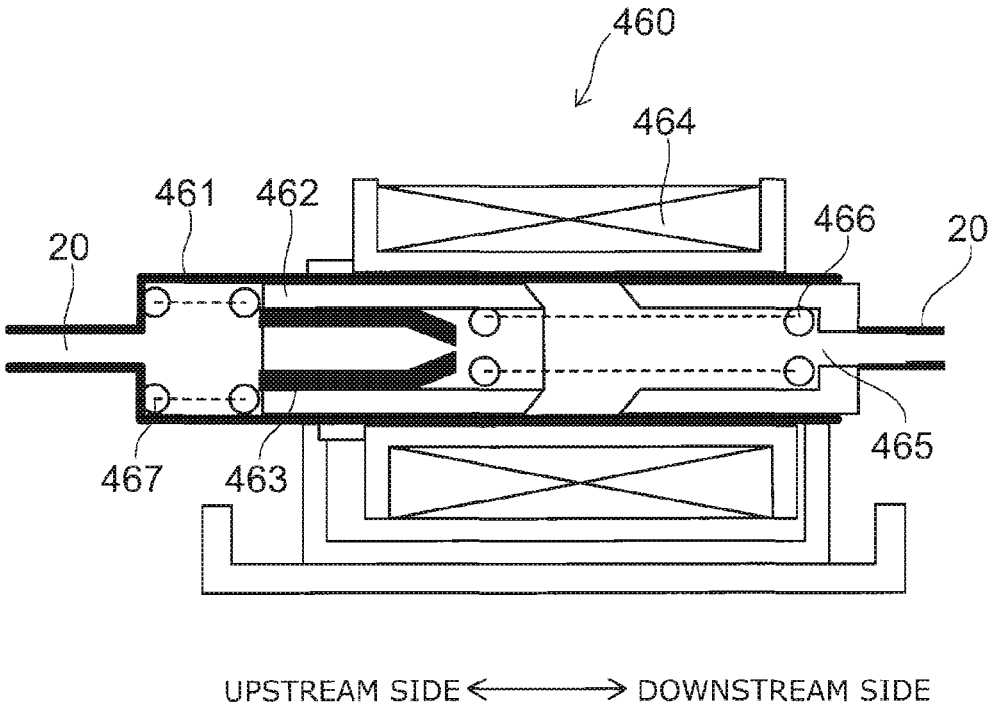
FIG. 8 is a sectional schematic view schematically showing the internal structure of the pressure modulator of this embodiment.

FIG. 8 is a sectional schematic view schematically showing the internal structure of the pressure modulator of this embodiment.

The pressure modulator 460 can provide pulsation to the flow of water inside the flow channel 20. Here, the term "pulsation" used herein refers to pressure variation caused by the pressure modulator 460. Thus, the pressure modulator 460 is a device for varying the pressure of water inside the flow channel 20.

As shown in FIG. 8, the pressure modulator 460 includes a cylinder 461 connected to the flow channel 20, a plunger 462 reciprocably provided inside the cylinder 461, a check valve 463 provided inside the plunger 462, and a pulsation generating coil 464 for reciprocating the plunger 462 under a controlled excitation voltage.

The check valve is disposed so that the pressure of water on the downstream side of the pressure modulator 460 increases when the position of the plunger 462 is changed to the nozzle 473 side (downstream side), and that the pressure of water on the downstream side of the pressure modulator 460 decreases when the position of the plunger 462 is changed to the side opposite to the nozzle 473 (upstream side). In other words, the pressure of water on the upstream side of the pressure modulator 460 decreases when the position of the plunger 462 is changed to the nozzle 473 side (downstream side). The pressure of water on the upstream side of the pressure modulator 460 increases when the position of the plunger 462 is changed to the side opposite to the nozzle (upstream side).

The plunger 462 is moved to the upstream or downstream side by controlling the excitation of the pulsation generating coil 464. That is, to add pulsation to the water inside the flow channel 20 (to vary the pressure of the water inside the flow channel 20), the plunger 462 is reciprocated in the axial direction (upstream/downstream direction) of the cylinder 461 by controlling the excitation voltage applied to the pulsation generating coil 464.

Here, by excitation of the pulsation generating coil 464, the plunger 462 moves from the original position (plunger original position) as shown to the downstream side 465. Then, when the excitation of the coil is extinguished, the plunger 462 returns to the original position by the biasing force of a return spring 466. Here, a buffer spring 467 buffers the return motion of the plunger 462. The plunger 462 includes therein a duckbill check valve 463 to prevent backflow to the upstream side.

Hence, when the plunger 462 moves from the plunger original position to the downstream side, the plunger 462 can pressurize water in the cylinder 461 to drive the water to the downstream flow channel 20. In other words, when the plunger 462 moves from the plunger original position to the downstream side, the plunger 462 can decompress water in the upstream flow channel 20 to suck the water into the cylinder 461. Here, because the plunger original position and the position after the motion to the downstream side are always the same, the amount of wash water fed to the downstream flow channel 20 in response to the motion of the plunger 462 is constant.

Subsequently, at the time of return to the original position, wash water flows into the cylinder 461 through the check valve 463. Thus, at the next time when the plunger 462 moves to the downstream side, a constant amount of wash water is newly fed to the downstream flow channel 20.

Thus, when the plunger 462 moves from the plunger original position to the downstream side, the plunger 462 can decompress water in the upstream flow channel 20 to suck the water into the cylinder 461. Hence, the pressure modulator 460 can suck the water inside the flow channel 20 on the upstream side of the pressure modulator 460 while providing pulsation to the flow of water in the flow channel 20. Consequently, by controlling the pressure modulator 460, the controller 405 can actively drain the sterilizing water inside the flow channel 20 not only on the downstream side of the pressure modulator 460 but also on the upstream side thereof.

Next, returning to the description of the timing chart shown in FIG. 7, after the controller 405 performs drainage of the flow channel 20, the controller 405 enters the standby state (timing t28-t29). Subsequently, the controller 405 switches the flow rate switching valve 471 and the flow channel switching valve 472 from "origin" to "SC2" to enable water discharge from all the water discharge ports 474 for "bottom washing" and "bidet washing" (timing t29). Furthermore, the controller 405 opens the solenoid valve 431 and sets the hot water heater 441 to the "sterilization control mode" (timing t29). Furthermore, the controller 405 starts to energize the electrolytic cell unit 450, and starts to produce sterilizing water (timing t29). That is, here, as described above with reference to timing t19-t22, the inside of the flow channel 20 and the water discharge port 474 region are sterilized with the sterilizing water (timing t29-t30).

Next, as in the operation described above with reference to timing t22-t25, the controller 405 closes the solenoid valve 431 and the flow channel switching valve 472, so that the sterilizing water produced in the electrolytic cell unit 450 is retained for a prescribed time inside the flow channel 20 (timing t30-t31, sterilizing water retaining step). Thus, after the user performs "bottom washing", the inside of the flow channel 20 can be regularly sterilized. Then, as in the operation described above with reference to timing t25-t28, the controller 405 drains the sterilizing water inside the flow channel 20, thereby emptying the flow channel 20 (timing t31-t32, draining step). Thus, bacteria surviving inside the flow channel 20 can be sterilized more reliably, and multiplication of bacteria inside the flow channel 20 can be suppressed more reliably.

Here, with regard to the triggers for performing regular sterilization and drainage of the flow channel 20 (timing t29-t32), for instance, the controller 405 can perform regular sterilization and drainage at times appropriately set by a timer. The times of the timer may be preset during manufacturing or before shipment of the sanitary washing device 100, or may be configured by the user as desired. Alternatively, the controller 405 can perform regular sterilization and drainage during night hours when the sanitary washing device 100 is not used.

Alternatively, the controller 405 may store the frequency of usage of the sanitary washing device 100 by the user, and learn the hours having low usage frequency. Thus, the controller 405 can perform regular sterilization and drainage during the hours having low frequency of usage by the user.

Next, the sterilizing effect for various bacteria is described with reference to the drawings.

Figures 9A, 9B:
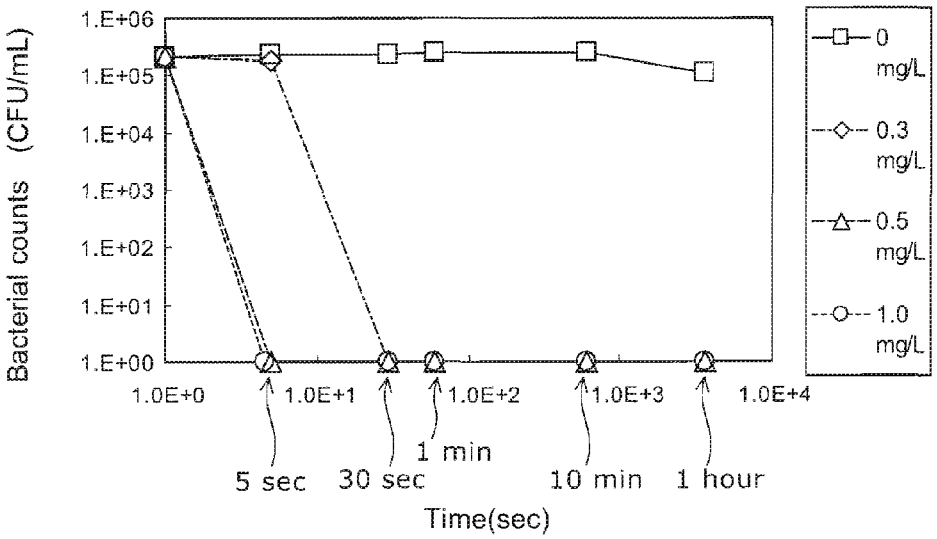
FIGS. 9A and 9B are a graph and a data table illustrating an example experimental result on the sterilizing effect for *Escherichia coli;*

FIGS. 9A and 9B are a graph and a data table illustrating an example experimental result on the sterilizing effect for *Escherichia coli.*

Figures 10A, 10B:
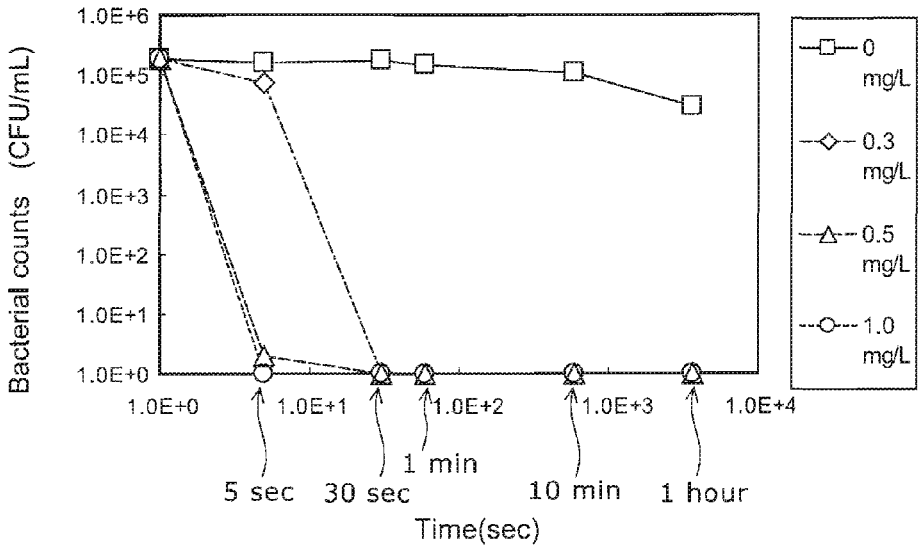
FIGS. 10A and 10B are a graph and a data table illustrating an example experimental result on the sterilizing effect for *Pseudomonas aeruginosa;*

FIGS. 10A and 10B are a graph and a data table illustrating an example experimental result on the sterilizing effect for *Pseudomonas aeruginosa.*

Figures 11A, 11B:
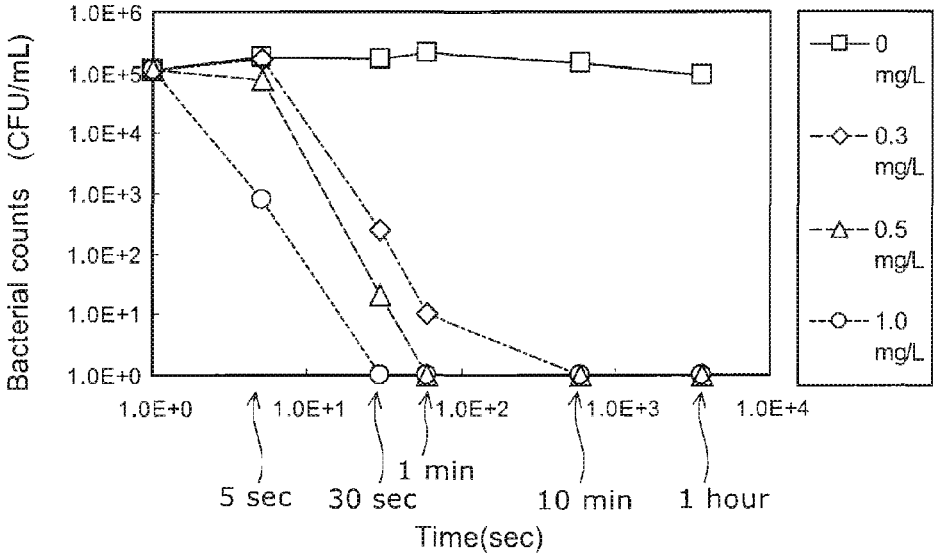
FIGS. 11A and 11B are a graph and a data table illustrating an example experimental result on the sterilizing effect for *Staphylococcus aureus;*

FIGS. 11A and 11B are a graph and a data table illustrating an example experimental result on the sterilizing effect for *Staphylococcus aureus.*

Figures 12A, 12B:
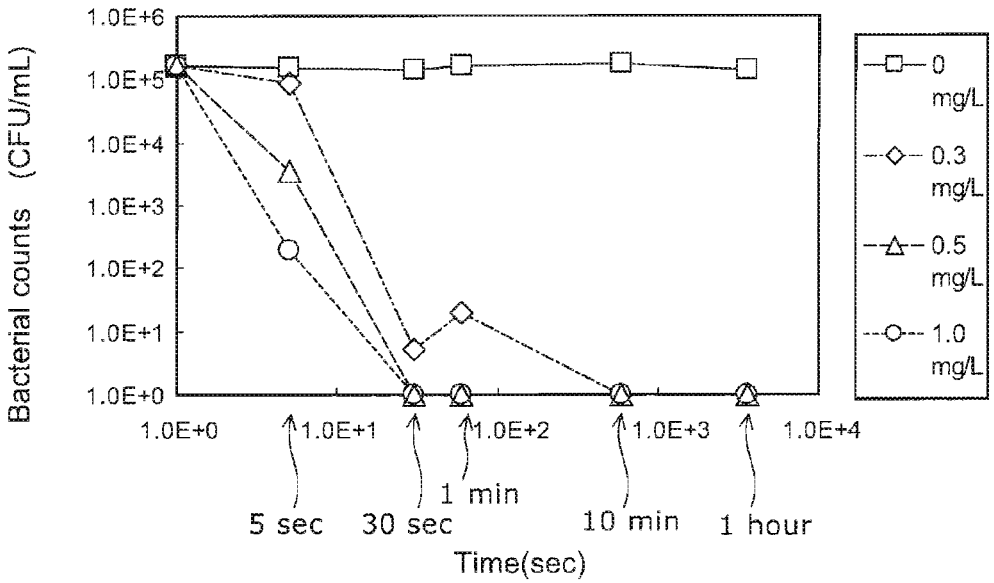
FIGS. 12A and 12B are a graph and a data table illustrating an example experimental result on the sterilizing effect for *Methylobacterium extorquens;*

FIGS. 12A and 12B are a graph and a data table illustrating an example experimental result on the sterilizing effect for *Methylobacterium extorquens.*

Using electrolytic water with relatively low concentration, the inventors conducted experiments for studying the sterilizing effect for bacteria detected at relatively high frequency in the damp environment such as kitchens and bathrooms.

First, the condition for producing the electrolytic water is described. The inventors first appropriately eliminated free residual chlorine from clean water. Then, the inventors passed the clean water in an electrolytic cell, and appropriately adjusted the electrolytic voltage to produce electrolytic water with the concentration of free residual chlorine being 0.3-1.0 mg/L. Here, the electrode used in this electrolysis is an iridium-based electrode ($Pt/IrO_2$) suitable for electrolysis of domestic water and superior in durability.

Furthermore, as microorganisms isolated at relatively high frequency from the damp environment, the inventors selected *Escherichia coli* (NBRC 3972), *Pseudomonas aeruginosa* (IFO 13736), *Staphylococcus aureus* (NBRC 12732), and *Methylobacterium extorquens* (IFO 15687).

Next, the method for the sterilization test is described. First, the inventors added the test bacterial suspension (approximately $10^7$ CFU (colony forming units)/mL) to 100 mL of the electrolytic water produced under the aforementioned producing condition, and left it to stand for approximately one hour. Here, the inventors separated 1 mL of the electrolytic water after the lapse of 5 seconds, 30 seconds, 1 minute, 10 minutes, and 1 hour each from the addition of the test bacterial suspension to the electrolytic water. Then, the inventors added the separated electrolytic water (1 mL) to 1% sodium thiosulfate-containing saline solution (9 mL), thereby deactivating the sterilizing efficacy of the electrolytic water.

Next, the inventors used the agar plate dilution method to measure the number of bacteria surviving in the electrolytic water with the sterilizing efficacy deactivated. Here, with regard to *Escherichia coli, Pseudomonas aeruginosa*, and *Staphylococcus aureus*, bacteria were cultured for 24 hours on the standard agar culture medium under the environment of 35° C. On the other hand, with regard to *Methylobacterium extorquens*, bacteria were cultured for seven days on the R2A culture medium under the environment of 27° C. The measurement results are as shown in FIGS. 9A to 12B.

In the graphs shown in FIGS. 9A, 10A, 11A, and 12A, the horizontal axis represents the elapsed time (seconds) from the addition of the test bacterial suspension to the electrolytic water, and the vertical axis represents the number of surviving bacteria (CFU/mL). In the data tables shown in FIGS. 9B, 10B, 11B, and 12B, examples of actual measurement values are illustrated for the number of surviving bacteria (CFU/mL) corresponding to the concentration (mg/L) of free residual chlorine and the elapsed time (seconds) from the addition of the test bacterial suspension to the electrolytic water.

From these results, with regard to *Escherichia coli*, as shown in FIGS. 9A and 9B, at a concentration of 1.0 and 0.5 mg/L, bacteria of $10^5$ CFU/mL were not detected after 5 seconds. At a concentration of 0.3 mg/L, bacteria of $10^5$ CFU/mL were not detected after 30 seconds.

With regard to *Pseudomonas aeruginosa*, as shown in FIGS. 10A and 10B, at a concentration of 1.0 mg/L, bacteria of $10^5$ CFU/mL were not detected after 5 seconds. At a concentration of 0.5 and 0.3 mg/L, bacteria of $10^5$ CFU/mL were not detected after 30 seconds.

With regard to *Staphylococcus aureus*, as shown in FIGS. 11A and 11B, at a concentration of 1.0 mg/L, bacteria of $10^5$ CFU/mL were not detected after 30 seconds. At a concentration of 0.5 mg/L, bacteria of $10^5$ CFU/mL were not detected after 1 minute. At a concentration of 0.3 mg/L, bacteria of $10^5$ CFU/mL were not detected after 10 minutes.

With regard to *Methylobacterium extorquens*, as shown in FIGS. 12A and 12B, at a concentration of 1.0 and 0.5 mg/L, bacteria of $10^5$ CFU/mL were not detected after 30 seconds. At a concentration of 0.3 mg/L, bacteria of $10^5$ CFU/mL were not detected after 10 minutes.

Hence, it is found that for microorganisms detected at relatively high frequency from the damp environment, a sterilizing effect in a shorter time is achieved in electrolytic water with relatively low concentration (the concentration of free residual chlorine is 0.3-1.0 mg/L). Thus, even if bacteria survive inside the flow channel 20, as described above with reference to FIGS. 6 and 7, bacteria surviving inside the flow channel 20 can be sterilized more reliably by retaining the sterilizing water for e.g. approximately 60 minutes inside the flow channel 20.

As described above, according to this embodiment, the sanitary washing device 100 can supply the sterilizing water produced in the electrolytic cell unit 450 to the flow channel 20 and retain the sterilizing water for a prescribed time inside the flow channel 20 (sterilizing water retaining step). Furthermore, after retaining the sterilizing water for a prescribed time inside the flow channel 20, the sanitary washing device 100 can drain the sterilizing water out of the flow channel 20 (draining step). Thus, in the sanitary washing device 100, the sterilizing water is retained for a prescribed time inside the flow channel 20. Hence, bacteria surviving inside the flow channel 20 can be sterilized more reliably. Furthermore, in the sanitary washing device 100, after retaining the sterilizing water for a prescribed time inside the flow channel 20, the sterilizing water is drained out of the flow channel 20. Hence, even if the sterilizing power of the sterilizing water is decreased over time, the action of the sterilizing water as a nutrient source for bacteria can be suppressed.

Next, another embodiment of the invention is described with reference to the drawings.

Figure 13:
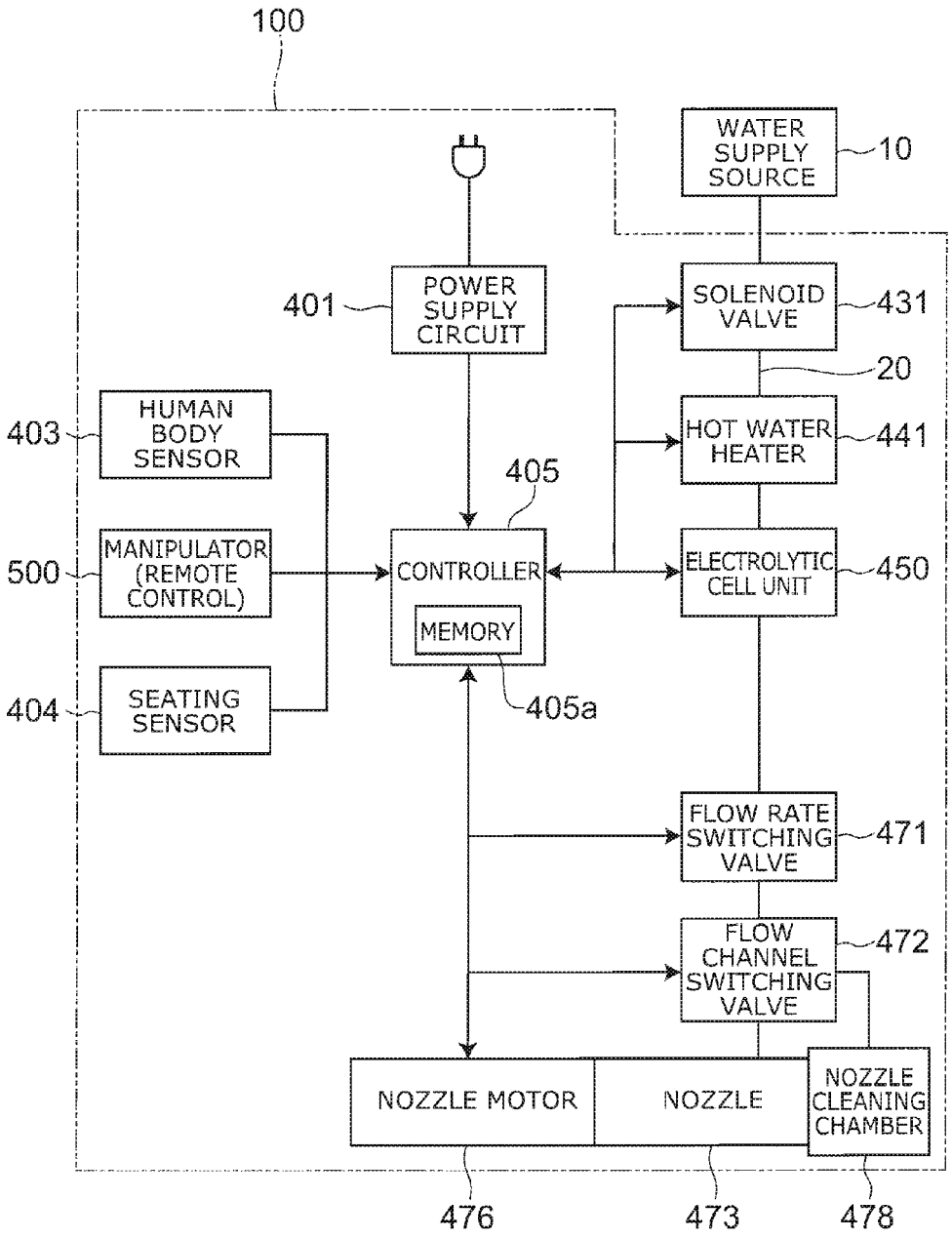
FIG. 13 is a block diagram showing the relevant configuration of a sanitary washing device according to another embodiment of the invention.

FIG. 13 is a block diagram showing the relevant configuration of a sanitary washing device according to another embodiment of the invention.

In FIG. 13, the relevant configuration of the water channel system and the electrical system is shown together. The toilet device equipped with the sanitary washing device according to this embodiment is similar to the toilet device shown in FIG. 1.

As shown in FIG. 13, the sanitary washing device 100 according to this embodiment includes a flow channel 20 for guiding water supplied from a water supply source 10 such as a water tap or a flush tank to the water discharge port 474 of the nozzle 473. A solenoid valve 431 is provided on the upstream side of the flow channel 20. The solenoid valve 431 is an openable/closable solenoid valve, and regulates water supply based on commands from a controller 405 provided inside the casing 400. The controller 405 includes a memory (storage device) 405*a*. The memory 405*a* is described later in detail. Here, the flow channel 20 refers to the downstream side or secondary side of the solenoid valve 431.

A hot water heater 441 is provided downstream of the solenoid valve 431. The hot water heater 441 heats supplied water to hot water at a prescribed temperature. On the upstream side of the hot water heater 441, an incoming water thermistor (second temperature sensing device) 433 (see FIG. 14) is provided. On the downstream side of the hot water heater 441, a hot water thermistor (first temperature sensing device) 443 (see FIG. 14) is provided. The temperature of the hot water can be configured by e.g. the user manipulating the manipulator 500.

An electrolytic cell unit 450 operable to produce sterilizing water is provided downstream of the hot water heater 441.

A flow rate switching valve 471 for adjusting the water force (flow rate), and a flow channel switching valve 472 for opening/closing and switching water supply to the nozzle 473 and the nozzle cleaning chamber (nozzle cleaning device) 478 are provided downstream of the electrolytic cell unit 450. Here, as in the example described later with reference to FIG. 14, the flow rate switching valve 471 and the flow channel switching valve 472 may be provided as a single unit. Furthermore, a nozzle 473 is provided downstream of the flow rate switching valve 471 and the flow channel switching valve 472. The rest of the relevant configuration of the sanitary washing device 100 according to this embodiment is similar to the relevant configuration of the sanitary washing device 100 described above with reference to FIG. 2.

Figure 14:
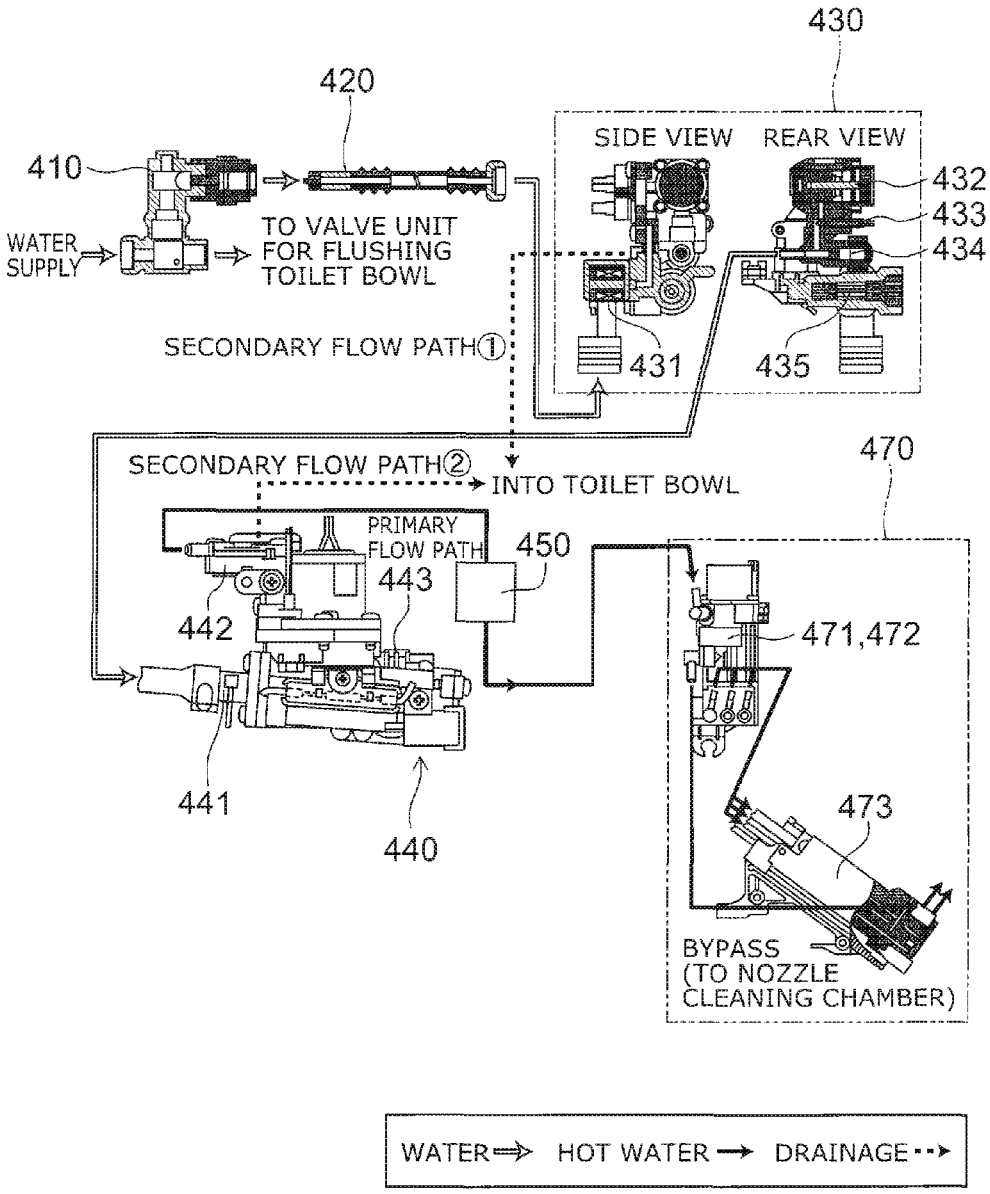
FIG. 14 is a block diagram illustrating an example of the relevant configuration of the water channel system of the sanitary washing device according to this embodiment.

FIG. 14 is a block diagram illustrating an example of the relevant configuration of the water channel system of the sanitary washing device according to this embodiment.

The example of the electrolytic cell unit and the nozzle unit of this embodiment is similar to the electrolytic cell unit 450 and the nozzle unit 470 described above with reference to FIGS. 4 and 5, respectively.

The relevant configuration from the metal branch 410 to the heat exchanger unit 440 is similar to the relevant configuration from the metal branch 410 to the heat exchanger unit 440 described above with reference to FIG. 3. Next, the water supplied to the valve unit 430 is guided to the heat exchanger unit 440. The heat exchanger unit (heating device) 440 includes a hot water heater 441, a vacuum breaker 442, and a hot water thermistor 443. The vacuum breaker 442 prevents backflow of dirty water from the nozzle 473 when, for instance, negative pressure occurs in the valve unit 430. Furthermore, when the flow channel 20 is drained, the vacuum breaker 442 takes in air from outside to facilitate draining the flow channel 20 between the heat exchanger unit 440 and the nozzle unit 470. The water from the vacuum breaker 442 is drained to the bowl 801 of the toilet stool 800.

The hot water thermistor 443 senses the temperature of water heated by the hot water heater 441, and outputs the information of the water temperature to the controller 405. The hot water thermistor 443 can be e.g. a sheath heater or a ceramic heater. Here, the water supplied to the heat exchanger unit 440 is heated to a prescribed temperature by the hot water heater 441 under the energization control of the controller 405. The temperature of the incoming water to the heat exchanger unit 440 is sensed by the incoming water thermistor 433. The temperature of the heated hot water is sensed by the hot water thermistor 443. The controller 405 retrieves the information of these temperatures, and performs the energization control for the hot water heater 441 by combination of feedforward control and feedback control based on this information.

Next, the water supplied to the heat exchanger unit 440 and heated to a prescribed temperature is guided to the electrolytic cell unit 450. As described above with reference to FIGS. 1 and 2, the electrolytic cell unit 450 can produce sterilizing water.

In the sanitary washing device 100 according to this embodiment, after the seating sensor 404 senses a human body, the controller 405 performs hot water preparation for opening the solenoid valve 431, activating the hot water heater 441, and draining water from the water discharge port 474. Furthermore, based on the time period required to fill the flow channel 20 on the downstream side of the electrolytic cell unit 450 with sterilizing water, the controller 405 controls the timing to activate the electrolytic cell unit 450, i.e., the timing to energize the anode plate 451 and the cathode plate 452, after starting the hot water preparation.

Thus, the flow channel 20 on the downstream side of the electrolytic cell unit 450 can be filled with a smaller amount of sterilizing water. Hence, wasteful drainage of the sterilizing water can be suppressed. Furthermore, because the energization time of the anode plate 451 and the cathode plate 452 can be made shorter, the lifetime of the anode plate 451 and the cathode plate 452 can be increased. Furthermore, because the energization time of the anode plate 451 and the cathode plate 452 can be made shorter, generation of carbonates such as calcium carbonate and magnesium carbonate, called scale, can be suppressed.

This is described in more detail. Electrolysis of tap water generates calcium hydroxide and magnesium hydroxide. The generated calcium hydroxide and magnesium hydroxide turn to carbonates, called scale, by reaction with carbon dioxide in the water. Then, the generated scale is attached to the surface of the anode plate 451 and the cathode plate 452 of the electrolytic cell unit 450. Thus, passivation of the anode plate 451 and the cathode plate 452 may occur partly or entirely. This may decrease the production efficiency of hypochlorous acid.

In contrast, in this embodiment, the energization time of the anode plate 451 and the cathode plate 452 can be made shorter. Thus, generation of scale is suppressed. This can suppress passivation of the anode plate 451 and the cathode plate 452, and the decrease of the production efficiency of hypochlorous acid. In the following, these operations are described with reference to the drawings.

FIGS. 15A to 15C are conceptual schematic diagrams illustrating operations of the hot water preparation of the sanitary washing device according to this embodiment.

First, the operation illustrated in FIG. 15A is described.

When the seating sensor 404 senses a human body, the controller 405 starts hot water preparation for opening the solenoid valve 431, activating the hot water heater 441, and draining water from the water discharge port 474 (timing t211). At this time, the controller 405 does not energize the electrolytic cell unit 450. Hence, clean water flows in the flow channel 20 and is drained from the water discharge port 474. The operation of the hot water preparation is the operation of draining the water in the flow channel 20 from the water discharge port 474 and replacing the water in the flow channel 20 on the downstream side of the heat exchanger unit 440 by the water heated in the heat exchanger unit 440. Thus, the flow channel 20 on the downstream side of the heat exchanger unit 440 can be warmed. Hence, in washing the "bottom" and other parts of a user seated on the toilet seat 200, cold water can be prevented from being squirted at the "bottom" and other parts of the user.

As described above with reference to FIG. 14, the hot water thermistor 443 senses the temperature of water heated by the hot water heater 441, and outputs the information of the water temperature to the controller 405. Furthermore, the user can set the hot water temperature by manipulating the manipulator 500. Then, the controller 405 can sense (sense suitable temperature) that the temperature sensed by the hot water thermistor 443 has reached a preset temperature (suitable temperature) (timing t212). That is, from when the controller 405 starts the hot water preparation until the controller 405 senses the suitable temperature, the temperature sensed by the hot water thermistor 443 increases (timing t211-t212).

Next, after sensing the suitable temperature, based on the time period required to fill the flow channel 20 on the downstream side of the electrolytic cell unit 450 with sterilizing water, the controller 405 starts to energize the electrolytic cell unit 450 (timing t213). This timing is at e.g. approximately 9 seconds after starting the hot water preparation.

Next, the controller 405 stops energizing the electrolytic cell unit 450 to complete the hot water preparation (timing t214). The timing at which the controller 405 completes the hot water preparation is e.g. the timing when a prescribed time has elapsed after the controller 405 senses the suitable temperature. Alternatively, this timing is set by calculating the time period of the temperature increase to the suitable temperature based on at least one of the temperature sensed by the incoming water thermistor 433, the output of the hot water heater 441, and the flow rate in the flow channel 20. This timing is e.g. approximately 12 seconds after starting the hot water preparation. Thus, the flow channel 20 on the downstream side of the electrolytic cell unit 450 is filled with the sterilizing water produced by the electrolytic cell unit 450. The timing at which the controller 405 completes the hot water preparation is described later in detail.

In the operation shown in FIG. 15A, the controller 405 energizes the electrolytic cell unit 450 after sensing the suitable temperature, i.e., while the temperature sensed by the hot water thermistor 443 is stable. Thus, the time period of the operation after the controller 405 sensing the suitable temperature is determined. Furthermore, the timing to stop energizing the electrolytic cell unit 450 is determined. This can suppress wasteful production of sterilizing water in the electrolytic cell unit 450, wasteful passage of sterilizing water into the flow channel 20, and wasteful drainage of sterilizing water from the water discharge port 474.

Next, the operation illustrated in FIG. 15B is described.

The operation at timing t221-t222 shown in FIG. 15B is similar to the operation at timing t211-t212 described above with reference to FIG. 15A. Next, the controller 405 completes the hot water preparation (timing t223). The timing at which the controller 405 completes the hot water preparation is similar to the timing described above with reference to FIG. 15A.

Next, after completing the hot water preparation, the controller 405 starts to energize the electrolytic cell unit 450 (timing t223). In the operation shown in FIG. 15B, the controller 405 starts to energize the electrolytic cell unit 450 at 12 seconds after starting the hot water preparation. However, the embodiment is not limited thereto. For instance, if the controller 405 has completed the hot water preparation at 11 seconds after starting the hot water preparation, then the controller 405 may start to energize the electrolytic cell unit 450 at that timing. Next, based on the time period required to fill the flow channel 20 on the downstream side of the electrolytic cell unit 450 with sterilizing water, the controller 405 stops energizing the electrolytic cell unit 450 (timing t224). Thus, the flow channel 20 on the downstream side of the electrolytic cell unit 450 is filled with the sterilizing water produced by the electrolytic cell unit 450.

In the operation shown in FIG. 15B, the controller 405 energizes the electrolytic cell unit 450 after completing the hot water preparation. Thus, there is no need to take into consideration the influence of variation in the temperature sensed by the hot water thermistor 443. This facilitates controlling the electrolytic cell unit 450 and the hot water heater 441.

Next, the operation illustrated in FIG. 15C is described.

The operation at timing t231-t232 shown in FIG. 15C is similar to the operation at timing t211-t212 described above with reference to FIG. 15A. Next, after the lapse of a fixed time (7 seconds in the operation shown in FIG. 15C) from the start of the hot water preparation, the controller 405 forcibly starts to energize the electrolytic cell unit 450 (timing t233). Next, the controller 405 completes the hot water preparation (timing t234). Thus, the flow channel 20 on the downstream side of the electrolytic cell unit 450 is filled with the sterilizing water produced by the electrolytic cell unit 450. The timing at which the controller 405 completes the hot water preparation is similar to the timing described above with reference to FIG. 15A.

In the operation shown in FIG. 15C, after the lapse of a fixed time from the start of the hot water preparation, the controller 405 forcibly starts to energize the electrolytic cell unit 450. Thus, as in the operation shown in FIG. 15B, there is no need to take into consideration the influence of variation in the temperature sensed by the hot water thermistor 443. This facilitates controlling the electrolytic cell unit 450 and the hot water heater 441.

Figure 16:
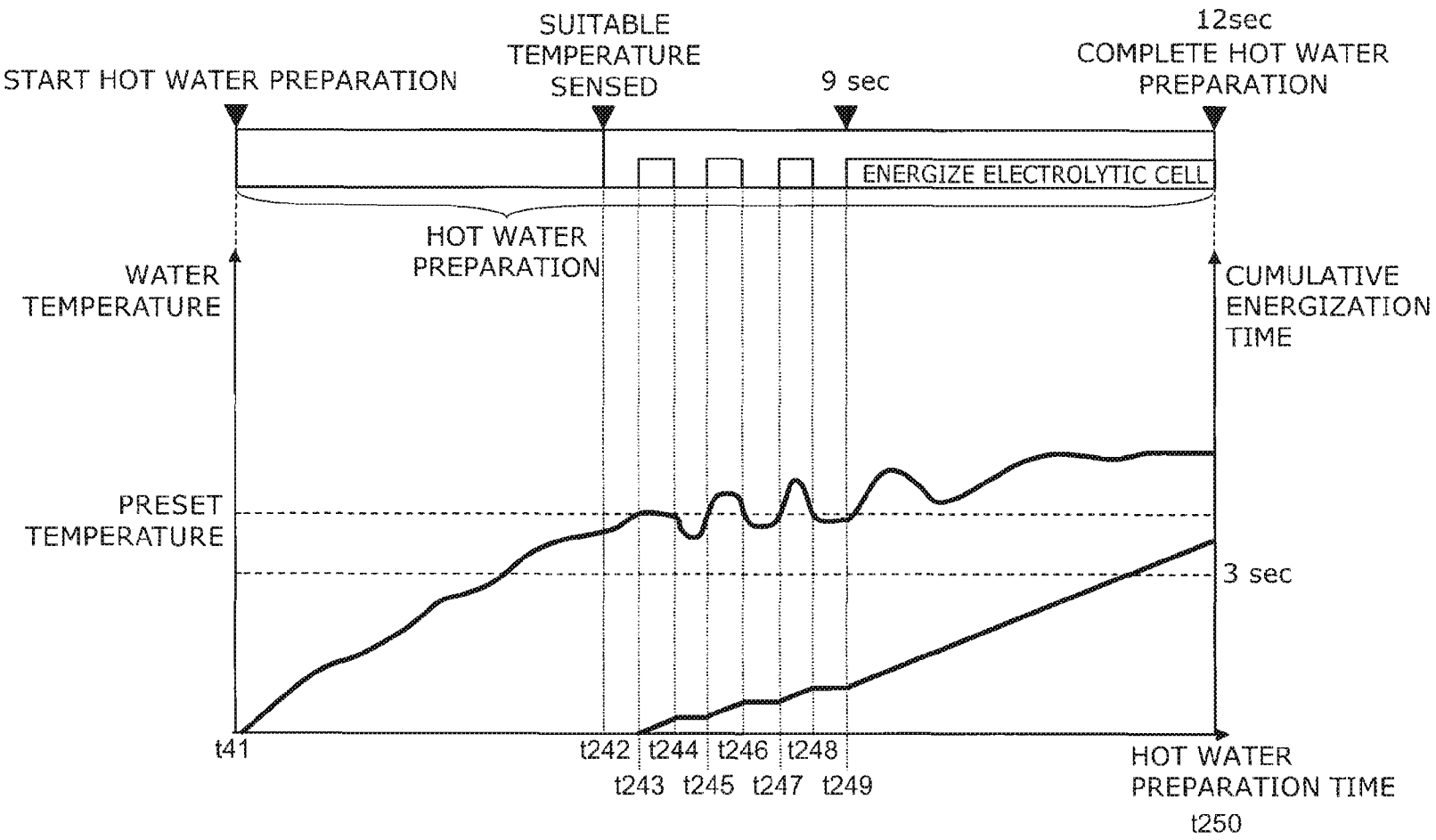
FIG. 16 is a conceptual schematic diagram illustrating an alternative operation of the hot water preparation of the sanitary washing device according to this embodiment.

FIG. 16 is a conceptual schematic diagram illustrating an alternative operation of the hot water preparation of the sanitary washing device according to this embodiment.

The operation at timing t241-t242 shown in FIG. 16 is similar to the operation at timing t211-t212 described above with reference to FIG. 15A. Next, after sensing the suitable temperature, based on the time period required to fill the flow channel 20 on the downstream side of the electrolytic cell unit 450 with sterilizing water, the controller 405 starts to energize the electrolytic cell unit 450 (timing t243).

Next, if the temperature sensed by the hot water thermistor 443 is lower than the preset temperature, the controller 405 stops energizing the electrolytic cell unit 450 (timing t244). Then, if the temperature sensed by the hot water thermistor 443 reaches the preset temperature, then based on the time period required to fill the flow channel 20 on the downstream side of the electrolytic cell unit 450 with sterilizing water, the controller 405 restarts to energize the electrolytic cell unit 450 (timing t245). Next, similar operations are repeated when the temperature sensed by the hot water thermistor 443 is lower than the preset temperature and reaches the preset temperature (timings t246, t247, t248).

Next, if the temperature sensed by the hot water thermistor 443 reaches the preset temperature, then based on the time period required to fill the flow channel 20 on the downstream side of the electrolytic cell unit 450 with sterilizing water, the controller 405 restarts to energize the electrolytic cell unit 450 (timing t249). Next, the controller 405 stops energizing the electrolytic cell unit 450 to complete the hot water preparation (timing t250).

Thus, even if the so-called "hunting" occurs as shown in FIG. 16, the controller 405 can ensure the time period required to fill the flow channel 20 on the downstream side of the electrolytic cell unit 450 with sterilizing water. That is, the controller 405 ensures a cumulative energization time (e.g., a time longer than 3 seconds) longer than the cumulative energization time (e.g., 3 seconds) of the electrolytic cell unit 450 in the case of no hunting. Thus, even if hunting occurs, the flow channel 20 on the downstream side of the electrolytic cell unit 450 is filled with the sterilizing water produced by the electrolytic cell unit 450.

Figure 17:
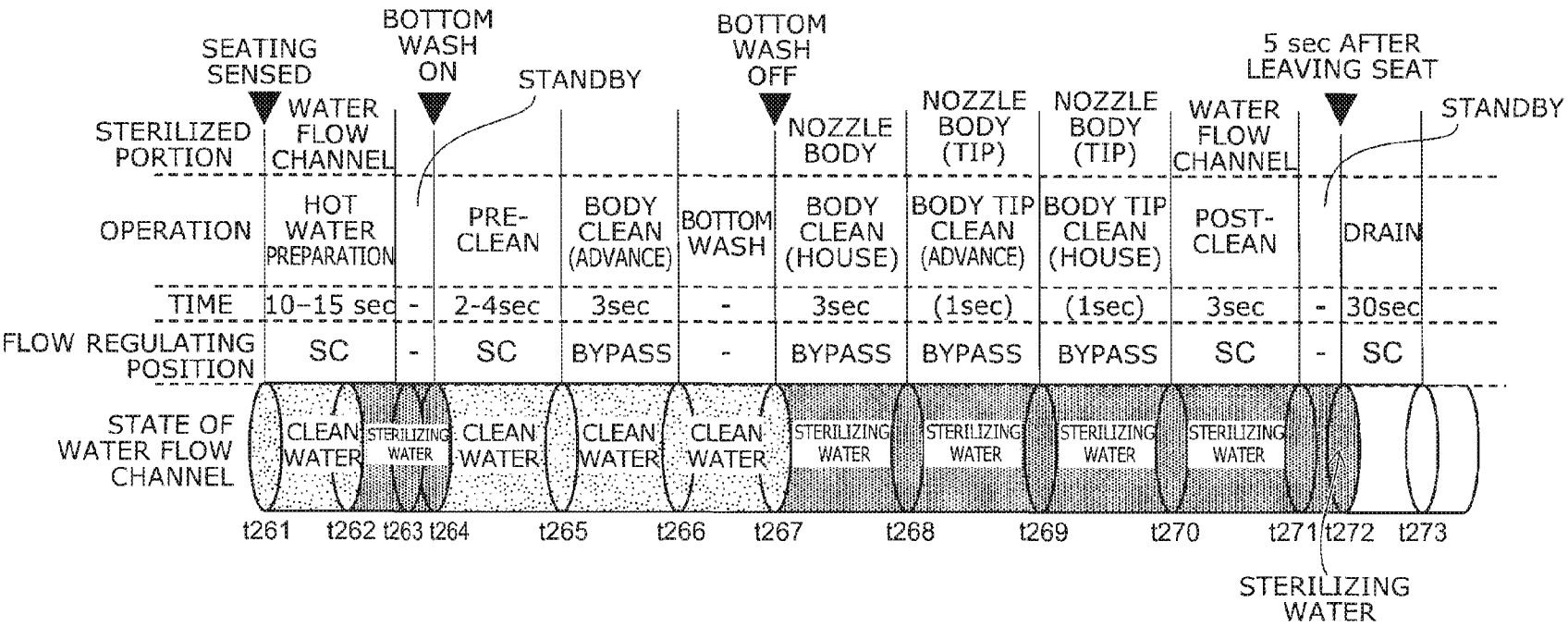
FIG. 17 is a conceptual schematic diagram generally showing the operation and the state of the flow channel of the sanitary washing device according to this embodiment.

FIG. 17 is a conceptual schematic diagram generally showing the operation and the state of the flow channel of the sanitary washing device according to this embodiment.

The state of the flow channel shown in FIG. 17 shows the state inside the flow channel 20 on the downstream side of the electrolytic cell unit 450.

In the following description, it is illustratively assumed that the nozzle 473 includes a plurality of water discharge ports 474.

First, when the seating sensor 404 senses a human body, the controller 405 starts hot water preparation for opening the solenoid valve 431, activating the hot water heater 441, and draining water from the water discharge port 474 (timing t261). At this time, the controller 405 does not energize the electrolytic cell unit 450. Hence, clean water flows in the flow channel 20 and is drained from the water discharge port 474.

Next, the controller 405 starts to energize the electrolytic cell unit 450 to produce sterilizing water in the electrolytic cell unit 450 (timing t262). Then, the controller 405 controls the flow rate switching valve 471 and the flow channel switching valve 472, thereby discharging the sterilizing water from all the plurality of water discharge ports 474. At this time, because the sterilizing water is discharged from the water discharge port 474, the inside of the flow channel 20 on the downstream side of the electrolytic cell unit 450 and the water discharge port 474 region are sterilized with the sterilizing water.

Next, the controller 405 stops energizing the electrolytic cell unit 450 to complete the hot water preparation (timing t263). An example of this hot water preparation is described later in detail. Here, the time period for performing the hot water preparation is e.g. approximately 10-15 seconds.

Next, with the solenoid valve 431 closed, the controller 405 waits on standby until the "bottom washing switch", not shown, provided on the manipulator 500 is pressed by the user (timing t263-t264). At this time, because the controller 405 closes the solenoid valve 431 and the flow channel switching valve 472, the sterilizing water produced in the electrolytic cell unit 450 can be retained for a prescribed time inside the flow channel 20 on the downstream side of the electrolytic cell unit 450. Thus, the inside of the flow channel 20 on the downstream side of the electrolytic cell unit 450 can be sterilized before the user performs "bottom washing".

This prescribed time refers to the time for which the sterilizing water is retained inside the flow channel 20 on the downstream side of the electrolytic cell unit 450, i.e., the time from when the controller 405 closes the solenoid valve and the flow channel switching valve 472 until the "bottom washing switch" is pressed by the user. Thus, this prescribed time varies with the time period for e.g. the user's act of using the toilet.

Next, when the user presses the "bottom washing switch", not shown, provided on the manipulator 500 (timing t264), the controller 405 receives a signal for performing private parts washing. Then, the controller 405 first performs "pre-cleaning" with clean water (timing t264-t265). More specifically, the controller 405 controls the flow rate switching valve 471 and the flow channel switching valve 472, thereby discharging clean water from all the plurality of water discharge ports 474 to clean these water discharge ports 474. At this time, the controller 405 does not energize the electrolytic cell unit 450, and does not produce sterilizing water. Hence, the region around the plurality of water discharge ports 474 is physically cleaned with clean water (including clean water reflected by the inner wall of the nozzle cleaning chamber 478) discharged by the water discharge ports 474 themselves.

In other words, the sterilizing water retained inside the flow channel 20 is drained from the water discharge port 474 by the newly supplied clean water. That is, the sterilizing water retained inside the flow channel 20 is replaced by the newly supplied clean water and drained. Here, the time period for performing the pre-cleaning with clean water is e.g. approximately 2-4 seconds.

Next, the controller 405 controls the flow rate switching valve 471 and the flow channel switching valve 472, thereby squirting clean water from the water discharge portion 479 provided in the nozzle cleaning chamber 478. Simultaneously, the controller 405 advances the nozzle 473 into the bowl 801. Thus, the body of the nozzle 473 is cleaned with clean water squirted from the water discharge portion 479 (timing t265-t266). At this time again, the controller 405 does not energize the electrolytic cell unit 450, and does not produce sterilizing water. Hence, the body of the nozzle 473 is physically cleaned with clean water squirted from the water discharge portion 479.

At this time again, the sterilizing water retained inside the flow channel 20 connected to the water discharge portion 479 is replaced by the newly supplied clean water and drained. Here, the time period for performing the body cleaning with clean water is e.g. approximately 3 seconds.

Next, the controller 405 controls the flow rate switching valve 471 and the flow channel switching valve 472, thereby squirting clean water from the water discharge port 474 for "bottom washing" to wash the "bottom" of the user seated on the toilet seat 200 (timing t266-t267). At this time, the controller 405 does not energize the electrolytic cell unit 450, and does not produce sterilizing water. Furthermore, the sterilizing water which was retained inside the flow channel 20 is replaced by the newly supplied clean water and drained at timing t264-t266. Hence, there is no case where the sterilizing water is squirted at the user's private parts.

Furthermore, during the hot water preparation and standby before performing "bottom washing", the inside of the flow channel 20 on the downstream side of the electrolytic cell unit 450 is sterilized with sterilizing water (timing t262-t264). Hence, hygienic water is squirted from the water discharge port 474.

Next, when the user presses the "stop switch", not shown, on the manipulator 500 (timing t267), the controller 405 controls the flow rate switching valve 471 and the flow channel switching valve 472, thereby squirting sterilizing water from the water discharge portion 479 provided in the nozzle cleaning chamber 478. Simultaneously, the controller 405 houses the nozzle 473 in the casing 400 (timing t267-t268). That is, the controller 405 starts to energize the electrolytic cell unit 450 to produce sterilizing water, and performs "body cleaning" of the nozzle 473 with the sterilizing water squirted from the water discharge portion 479 (timing t267-t268). Thus, the inside of the flow channel 20 on the downstream side of the electrolytic cell unit 450 and the outer peripheral surface of the nozzle 473 are sterilized with the sterilizing water. Here, the time period for performing the body cleaning with the sterilizing water is e.g. approximately 3 seconds.

Next, the controller 405 controls the flow rate switching valve 471 and the flow channel switching valve 472, thereby squirting sterilizing water from the water discharge portion 479 provided in the nozzle cleaning chamber 478. Simultaneously, the controller 405 advances the nozzle 473 into the bowl 801 (timing t268-t269), and then houses the nozzle 473 in the casing 400 (timing t269-t270). Hence, the tip portion of the nozzle 473 provided with the water discharge port 474 and the outer peripheral surface of the nozzle 473 are sterilized with the sterilizing water. Thus, while squirting sterilizing water from the water discharge portion 479, the controller 405 advances and retracts the nozzle 473 again so that the tip portion and body of the nozzle 473 can be sterilized more reliably. Here, the time period for advancing and retracting the nozzle 473 is e.g. approximately 1 second, respectively.

Next, with the nozzle 473 housed in the casing 400, the controller 405 controls the flow rate switching valve 471 and the flow channel switching valve 472, thereby discharging sterilizing water from all the plurality of water discharge ports 474 to perform "post-cleaning" of these water discharge ports 474 (timing t270-t271). That is, the controller 405 energizes the electrolytic cell unit 450 to produce sterilizing water, and performs the post-cleaning of the water discharge port 474 region with the sterilizing water squirted from the water discharge port 474 (timing t270-t271).

Thus, the inside of the flow channel 20 on the downstream side of the electrolytic cell unit 450 and the water discharge port 474 region are sterilized with the sterilizing water. Furthermore, after the body of the nozzle 473 is sterilized and cleaned with the sterilizing water (timing t267-t270), the sterilizing water is discharged only from the water discharge port 474 (timing t270-t271). Hence, the drainage water flowing out in sterilizing and cleaning the body of the nozzle 473 does not enter the flow channel 20 from the water discharge port 474. Furthermore, the flow channel 20 on the downstream side of the electrolytic cell unit 450 can be filled with the sterilizing water down to the water discharge port 474 located at the end of the flow channel 20. Here, the time period for performing the post-cleaning with the sterilizing water is e.g. approximately 3 seconds.

Next, the controller 405 closes the solenoid valve 431, and then closes the flow channel switching valve 472. The controller 405 waits on standby until the lapse of 5 seconds after the seating sensor 404 ceases to sense the human body (timing t271-t272). At this time, because the controller 405 closes the solenoid valve 431 and the flow channel switching valve 472, the sterilizing water produced in the electrolytic cell unit 450 can be retained for a prescribed time inside the flow channel 20 on the downstream side of the electrolytic cell unit 450. Thus, after the user performs "bottom washing", the inside of the flow channel 20 can be sterilized.

This prescribed time is the time period for which the sterilizing water is retained inside the flow channel 20 on the downstream side of the electrolytic cell unit 450, i.e., the time period from when the controller 405 closes the solenoid valve and the flow channel switching valve 472 until 5 seconds after the user leaves the seat. Here, "until 5 seconds after the user leaves the seat" means until 5 seconds has elapsed after the seating sensor 404 ceases to sense the human body. Thus, this prescribed time varies with e.g. the time period of the user's wiping and standing action.

Next, when 5 seconds has elapsed after the seating sensor 404 ceases to sense the human body, the controller 405 performs "drainage" (timing t272-t273). That is, the controller 405 drains the sterilizing water inside the flow channel 20, thereby emptying the flow channel 20. The time period for performing this "drainage" is e.g. approximately 30 seconds. Thus, in the sanitary washing device 100 according to this embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

The controller 405 of this embodiment performs the cleaning step for cleaning the nozzle 473, and retains sterilizing water for a prescribed time inside the flow channel 20 continuously subsequent to the cleaning step. Here, the term "cleaning step" for cleaning the nozzle used herein refers to at least one of the pre-cleaning with the sterilizing water, the body cleaning with the sterilizing water, and the post-cleaning with the sterilizing water. Thus, after performing the cleaning step for cleaning the nozzle 473, the inside of the flow channel 20 can be elaborately sterilized. Hence, bacteria surviving inside the flow channel 20 can be sterilized more reliably, and hygienic water can be squirted from the water discharge port 474.

Next, examples of the hot water preparation of this embodiment are described with reference to the drawings.

FIGS. 18A to 18C are conceptual schematic diagrams illustrating examples of the hot water preparation of this embodiment.

FIG. 19 is a correspondence table showing the correspondence between the incoming water temperature and the suitable temperature continuation time in the hot water preparation.

As in the conceptual schematic diagram shown in FIG. 17, FIGS. 18A to 18C show the state inside the flow channel 20 on the downstream side of the electrolytic cell unit 450.

In the description of these examples, it is illustratively assumed that the operation time of the hot water preparation is set to 10-15 seconds. Furthermore, as shown in FIG. 19, it is illustratively assumed that the water passage time of the sterilizing water, i.e., the energization time of the electrolytic cell unit 450, is set to 3 seconds.

First, the example shown in FIG. 18A is described.

As described above with reference to FIG. 17, when the seating sensor 404 senses a human body, the controller 405 starts hot water preparation for opening the solenoid valve 431, activating the hot water heater 441, and draining water from the water discharge port 474 (timing t301). At this time, the controller 405 does not energize the electrolytic cell unit 450. Hence, clean water flows in the flow channel 20 and is drained from the water discharge port 474. The temperature sensed by the hot water thermistor 443 increases (timing t301-t302, increase temperature).

Next, when the controller 405 senses (sense suitable temperature) that the temperature sensed by the hot water thermistor 443 has reached a preset temperature (suitable temperature), the controller 405 appropriately controls the hot water heater 441 to maintain the suitable temperature (timing t302-t303, continue suitable temperature). That is, even if the temperature sensed by the hot water thermistor 443 has reached the preset temperature, the controller 405 does not necessarily stop activating the hot water heater 441. This is because even if the temperature sensed by the hot water thermistor 443 has reached the preset temperature, the flow channel 20 on the downstream side of the electrolytic cell unit 450 is not necessarily filled with hot water. That is, to fill the flow channel 20 on the downstream side of the electrolytic cell unit 450 with hot water, the controller 405 continues to activate the hot water heater 441 without stopping even after the temperature sensed by the hot water thermistor 443 reaches the preset temperature.

Here, the time of continuing the suitable temperature (suitable temperature continuation time) is described with reference to FIG. 19.

When the controller 405 starts hot water preparation, the controller 405 sets the suitable temperature continuation time based on the temperature sensed by the incoming water thermistor 433 (incoming water temperature). More specifically, when the incoming water temperature is 5° C. or less, the controller 405 sets the suitable temperature continuation time to 6 seconds. Then, the controller 405 allocates 3 seconds of the 6 seconds to the water passage time of clean water, and the remaining 3 seconds of the 6 seconds to the water passage time of sterilizing water.

When the incoming water temperature is higher than 5° C. and 10° C. or less, the controller 405 sets the suitable temperature continuation time to 5 seconds. Then, the controller 405 allocates 2 seconds of the 5 seconds to the water passage time of clean water, and the remaining 3 seconds of the 5 seconds to the water passage time of sterilizing water.

When the incoming water temperature is higher than 10° C. and 15° C. or less, the controller 405 sets the suitable temperature continuation time to 4 seconds. Then, the controller 405 allocates 1 second of the 4 seconds to the water passage time of clean water, and the remaining 3 seconds of the 4 seconds to the water passage time of sterilizing water.

When the incoming water temperature is higher than 15° C., the controller 405 sets the suitable temperature continuation time to 3 seconds. Then, the controller 405 allocates the 3 seconds entirely to the water passage time of sterilizing water.

That is, in this example, the controller 405 configures a shorter suitable temperature continuation time with the increase in the level of the incoming water temperature. The controller 405 allocates 3 seconds of the configured suitable temperature continuation time to the water passage time of sterilizing water.

Returning to FIG. 18A, the controller 405 senses the suitable temperature at less than 7 seconds from the start of the hot water preparation (timing t302). In this case, the controller 405 does not set the suitable temperature continuation time. At less than 7 seconds from the start of the hot water preparation, the controller 405 does not produce sterilizing water in the electrolytic cell unit 450. That is, the controller 405 passes clean water in the flow channel 20 on the downstream side of the electrolytic cell unit 450. Then, after the lapse of 7 seconds from the start of the hot water preparation, the controller 405 starts to energize the electrolytic cell unit 450 to produce sterilizing water in the electrolytic cell unit 450 (timing t303). That is, in the example shown in FIG. 18A, the controller 405 suppresses energization of the electrolytic cell unit 450 until the lapse of 7 seconds from the start of the hot water preparation. Next, after the lapse of 10 seconds, which is the minimum operation time of the hot water preparation, the controller 405 stops energizing the electrolytic cell unit 450 to complete the hot water preparation (timing t304).

In the example shown in FIG. 18A, even in the case where the controller 405 senses the suitable temperature at less than 7 seconds from the start of the hot water preparation, the controller 405 can ensure the water passage time of sterilizing water. Simultaneously, the controller 405 can start to energize the electrolytic cell unit 450 so that the timing to stop energizing the electrolytic cell unit 450 coincides with the timing to complete the hot water preparation.

Next, the example shown in FIG. 18B is described.

In the example shown in FIG. 18B, when the seating sensor 404 senses a human body, the controller 405 starts hot water preparation (timing t311), and senses the suitable temperature at 7 seconds or more and less than 12 seconds from the start of the hot water preparation (timing t312). In this case, the controller 405 sets the suitable temperature continuation time based on the incoming water temperature (see FIG. 19).

When the controller 405 senses the suitable temperature (timing t312), the controller 405 performs suitable temperature continuation with the suitable temperature continuation time configured based on the incoming water temperature (timing t312-t314). More specifically, the controller 405 passes clean water for the water passage time of clean water configured based on the incoming water temperature (timing t312-t313). Subsequently, the controller 405 produces sterilizing water in the electrolytic cell unit 450 and passes it for the configured water passage time (3 seconds) of sterilizing water (timing t313-t314). Next, after the lapse of the suitable temperature continuation time configured based on the incoming water temperature, the controller 405 stops energizing the electrolytic cell unit 450 to complete the hot water preparation (timing t314).

In the example shown in FIG. 18B, even in the case where the controller 405 senses the suitable temperature at 7 seconds or more and less than 12 seconds from the start of the hot water preparation, the controller 405 can ensure the water passage time of sterilizing water. Simultaneously, the controller 405 can start to energize the electrolytic cell unit 450 so that the timing to stop energizing the electrolytic cell unit 450 coincides with the timing to complete the hot water preparation.

Next, the example shown in FIG. 18C is described.

In the example shown in FIG. 18C, when the seating sensor 404 senses a human body, the controller 405 starts hot water preparation (timing t321), and senses the suitable temperature at 12 seconds or more from the start of the hot water preparation (timing t323). In this case, the controller 405 does not set the suitable temperature continuation time. After the lapse of 12 seconds from the start of the hot water preparation, the controller 405 starts to energize the electrolytic cell unit 450 to produce sterilizing water in the electrolytic cell unit 450 (timing t322). That is, if the controller 405 does not sense the suitable temperature after the lapse of 12 seconds from the start of the hot water preparation, the controller 405 forcibly starts to energize the electrolytic cell unit 450. Next, after the lapse of 15 seconds, which is the maximum operation time of the hot water preparation, the controller 405 stops energizing the electrolytic cell unit 450 to complete the hot water preparation (timing t324).

In the example shown in FIG. 18C, even in the case where the controller 405 does not sense the suitable temperature after the lapse of 12 seconds from the start of the hot water preparation, the controller 405 can ensure the water passage time of sterilizing water. Simultaneously, the controller 405 can start to energize the electrolytic cell unit 450 so that the timing to stop energizing the electrolytic cell unit 450 coincides with the timing to complete the hot water preparation.

As described above, in these examples (the examples shown in FIGS. 18A to 18C), irrespective of variations in the incoming water temperature and the timing of sensing the suitable temperature, the controller 405 can ensure the water passage time of sterilizing water. Simultaneously, the controller 405 can start to energize the electrolytic cell unit 450 so that the timing to stop energizing the electrolytic cell unit 450 coincides with the timing to complete the hot water preparation. This can suppress wasteful production of sterilizing water in the electrolytic cell unit 450, wasteful passage of sterilizing water in the flow channel 20, and wasteful drainage of sterilizing water from the water discharge port 474, even if the incoming water temperature is varied. Furthermore, because the energization time of the anode plate 451 and the cathode plate 452 can be made shorter, the lifetime of the anode plate 451 and the cathode plate 452 can be increased. Furthermore, because the energization time of the anode plate 451 and the cathode plate 452 can be made shorter, generation of scale can be suppressed.

Furthermore, in these examples, the controller 405 may store the past suitable temperature continuation time in the memory 405*a* (see FIG. 13). Then, the controller 405 can refer to the past suitable temperature continuation time stored in the memory 405*a* and start to energize the electrolytic cell unit 450 so that the timing to stop energizing the electrolytic cell unit 450 coincides with the timing to complete the hot water preparation. Here, the "past suitable temperature continuation time" includes e.g. the several suitable temperature continuation times immediately before usage of the sanitary washing device 100, and the suitable temperature continuation times in the same hours on the past several days. Thus, the controller 405 can refer to the past suitable temperature continuation time. This can further suppress wasteful production of sterilizing water in the electrolytic cell unit 450, wasteful passage of sterilizing water in the flow channel 20, and wasteful drainage of sterilizing water from the water discharge port 474.

Figure 20:
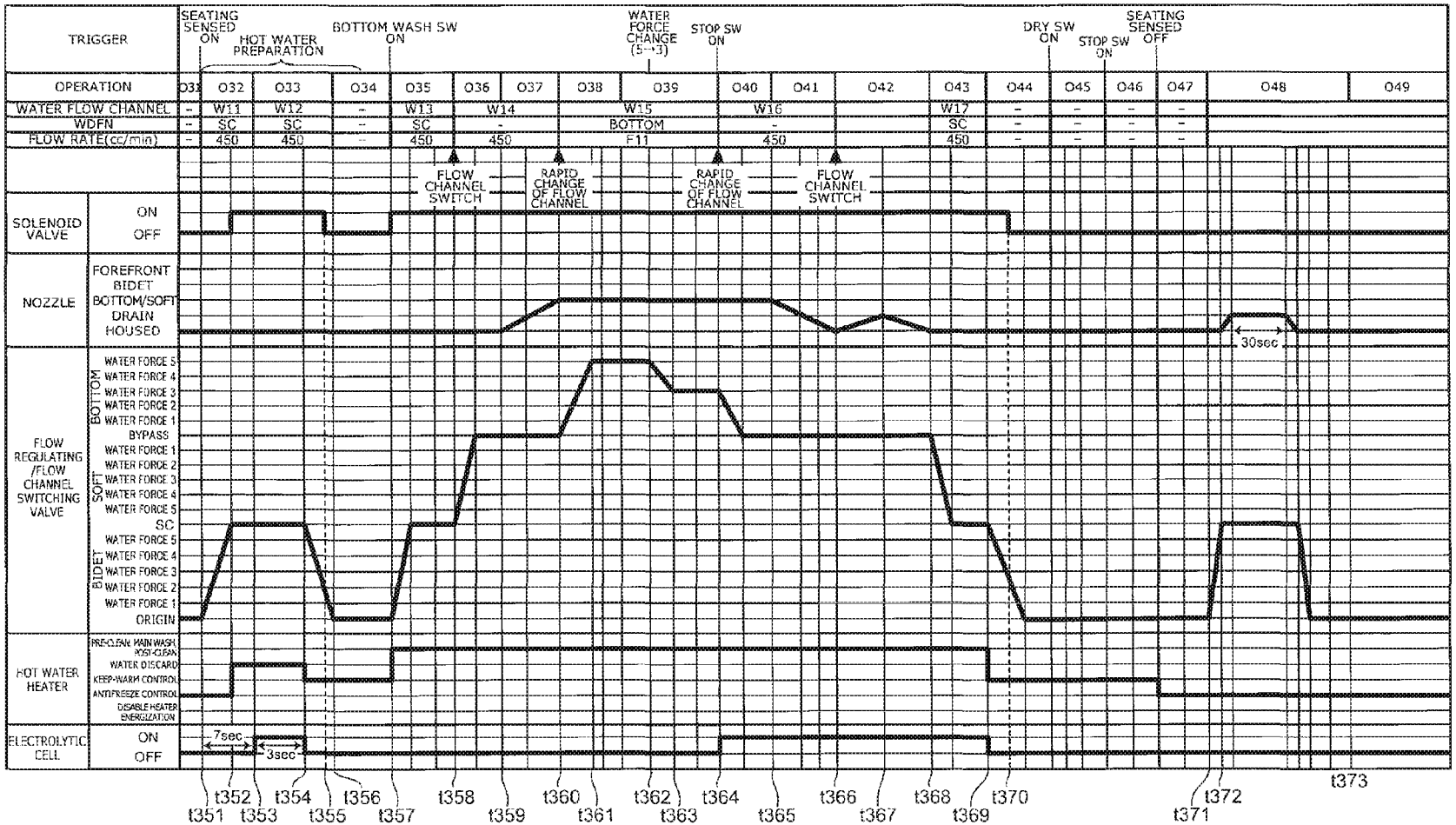
FIG. 20 is a timing chart illustrating an example operation of the sanitary washing device according to this embodiment.

FIG. 20 is a timing chart illustrating an example operation of the sanitary washing device according to this embodiment.

The timing chart shown in FIG. 20 shows an example operation of the sanitary washing device performing the hot water preparation illustrated with reference to FIG. 15C.

"O31" of "OPERATION" in FIG. 20 shows "STANDBY".

"O32" of "OPERATION" in FIG. 20 shows "PASS CLEAN WATER". "O33" of "OPERATION" in FIG. 20 shows "STERILIZE WATER FLOW CHANNEL". "O34" of "OPERATION" in FIG. 20 shows "KEEP WARM". "O35" of "OPERATION" in FIG. 20 shows "PRE-CLEAN". "O36" of "OPERATION" in FIG. 20 shows "DEPRESSURE". "O37" of "OPERATION" in FIG. 20 shows "BODY CLEAN (ADVANCE NOZZLE)". "O38" of "OPERATION" in FIG. 20 shows "SOFT START". "O39" of "OPERATION" in FIG. 20 shows "MAIN WASH". "O40" of "OPERATION" in FIG. 20 shows "DEPRESSURE". "O41" of "OPERATION" in FIG. 20 shows "BODY CLEAN (HOUSE NOZZLE)".

"O42" of "OPERATION" in FIG. 20 shows "BODY CLEAN (ADVANCE/HOUSE NOZZLE)". "O43" of "OPERATION" in FIG. 20 shows "POST-CLEAN". "O44" of "OPERATION" in FIG. 20 shows "KEEP WARM". "O45"

of "OPERATION" in FIG. 20 shows "DRY". "O46" of "OPERATION" in FIG. 20 shows "KEEP WARM". "O47" of "OPERATION" in FIG. 20 shows "STANDBY". "O48" of "OPERATION" in FIG. 20 shows "DRAINAGE/HOT AIR DAMPER STUCK PREVENTION". "O49" of "OPERATION" in FIG. 20 shows "STANDBY".

"W11" to "W13" of "WATER FLOW CHANNEL" in FIG. 20 show "PRIMARY CHANNEL". "W14" of "WATER FLOW CHANNEL" in FIG. 20 shows "BYPASS". "W15" of "WATER FLOW CHANNEL" in FIG. 20 shows "PRIMARY CHANNEL". "W16" of "WATER FLOW CHANNEL" in FIG. 20 shows "BYPASS". "W17" of "WATER FLOW CHANNEL" in FIG. 20 shows "PRIMARY CHANNEL".

"WDFN" in FIG. 20 shows "WATER DISCHARGE FROM NOZZLE".

"F11" of "FLOW RATE (cc/min)" in FIG. 20 shows "FROM MINIMUM TO PRESET FLOW RATE (270-430)".

First, the seating sensor 404 senses a user seated on the toilet seat 200. Then, the controller 405 starts hot water preparation (timing t351). More specifically, the controller 405 switches the flow rate switching valve 471 and the flow channel switching valve 472 from "origin" to "SC (self-cleaning)" to enable water discharge from all the water discharge ports 474 for "bottom washing" and "bidet washing".

Next, when the switching of the flow rate switching valve 471 and the flow channel switching valve 472 is completed, the controller 405 opens the solenoid valve 431 and sets the hot water heater 441 to the "water discard mode" (timing t352). Next, after the lapse of 7 seconds from the start of the hot water preparation, the controller 405 starts to energize the electrolytic cell unit 450 to produce sterilizing water in the electrolytic cell unit 450 (timing t353).

At this time, the controller 405 has switched the flow rate switching valve 471 and the flow channel switching valve 472 to "SC". Hence, water discharge from all the water discharge ports 474 for "bottom washing" and "bidet washing" is enabled. Furthermore, the sterilizing water produced in the electrolytic cell unit 450 is discharged from the water discharge port 474. Hence, the inside of the flow channel 20 on the downstream side of the electrolytic cell unit 450 and the water discharge port 474 region are sterilized with the sterilizing water.

Next, after the lapse of 3 seconds from the start of energization of the electrolytic cell unit 450, the controller 405 stops energizing the electrolytic cell unit 450 (timing t354). Simultaneously, the controller 405 switches the flow rate switching valve 471 and the flow channel switching valve 472 from "SC" to "origin", and changes the setting of the hot water heater 441 from the "water discard mode" to the "keep-warm control mode" (timing t354).

Thus, after the lapse of 7 seconds from the start of the hot water preparation, the controller 405 forcibly starts to energize the electrolytic cell unit 450. After the lapse of 3 seconds from the start of energization of the electrolytic cell unit 450, the controller 405 stops energizing the electrolytic cell unit 450. Hence, the controller 405 can ensure the water passage time of sterilizing water. Simultaneously, the controller 405 can start to energize the electrolytic cell unit 450 so that the timing to stop energizing the electrolytic cell unit 450 coincides with or precedes the timing to complete the hot water preparation. This can suppress wasteful production of sterilizing water in the electrolytic cell unit 450, wasteful passage of sterilizing water in the flow channel 20, and wasteful drainage of sterilizing water from the water discharge port 474.

Next, the controller 405 closes the solenoid valve 431 (timing t355). Here, it is because of the so-called "after-boiling prevention" that the controller 405 closes the solenoid valve 431 after changing the setting of the hot water heater 441. That is, this is because the hot water heater 441 generates residual heat even after its setting is changed from the "water discard mode" to the "keep-warm control mode".

Next, until the "bottom washing switch", not shown, provided on the manipulator 500 is pressed by the user, the controller 405 waits on standby and keeps the temperature of water to be discharged from the water discharge port 474 (timing t356-t357). At this time, because the controller 405 closes the solenoid valve 431 and the flow channel switching valve 472, the sterilizing water produced in the electrolytic cell unit 450 can be retained for a prescribed time inside the flow channel 20 on the downstream side of the electrolytic cell unit 450. Thus, the inside of the flow channel 20 on the downstream side of the electrolytic cell unit 450 can be sterilized before the user performs "bottom washing".

Next, when the user presses the "bottom washing switch", not shown, provided on the manipulator 500 (timing t357), the controller 405 receives a signal for performing private parts washing. Then, the controller 405 switches the flow rate switching valve 471 and the flow channel switching valve 472 from "origin" to "SC". Furthermore, the controller 405 opens the solenoid valve 431 and sets the hot water heater 441 to the "pre-cleaning mode, main washing mode, post-cleaning mode". At this time, the controller 405 does not energize the electrolytic cell unit 450, and does not produce sterilizing water. Hence, the water discharge port 474 region is cleaned with clean water discharged by the water discharge ports 474 themselves.

In other words, the sterilizing water retained inside the flow channel 20 is drained from the water discharge port 474 by the newly supplied clean water. That is, the sterilizing water retained inside the flow channel 20 is replaced by the newly supplied clean water and drained.

Next, the controller 405 switches the flow rate switching valve 471 and the flow channel switching valve 472 from "SC" to "bypass" so that water can be squirted from the water discharge portion 479 provided in the nozzle cleaning chamber 478 (timing t358). Next, the controller 405 advances the nozzle 473 housed in the casing 400 to the position of "bottom washing" (timing t359-t360). At this time, the controller 405 opens the solenoid valve 431, does not energize the electrolytic cell unit 450, and does not produce sterilizing water. Hence, the body of the nozzle 473 is cleaned with clean water squirted from the water discharge portion 479. Furthermore, the sterilizing water retained inside the flow channel 20 connected to the water discharge portion 479 is replaced by the newly supplied clean water and drained.

Next, the controller 405 switches the flow rate switching valve 471 and the flow channel switching valve 472 from "bypass" to "bottom water force 5" (timing t360-t361) and performs main washing (bottom washing) (timing t361-t362). Here, for instance, if the user changes the setting of the water force in "bottom washing" from "water force 5" to "water force 3" by the manipulator 500, then the controller 405 switches the flow rate switching valve 471 and the flow channel switching valve 472 from "bottom water force 5" to "bottom water force 3" (timing t362-t363). Then, the controller 405 continues main washing at "water force 3" (timing t363-t364).

In this main washing, the controller 405 does not energize the electrolytic cell unit 450, and does not produce sterilizing water. Furthermore, the sterilizing water which was retained inside the flow channel 20 is replaced by the newly supplied clean water and drained at timing t357-t360. Hence, there is no case where the sterilizing water is squirted at the user's private parts. Furthermore, the inside of the flow channel 20 on the downstream side of the electrolytic cell unit 450 is sterilized at timing t353-t357. Hence, hygienic water is squirted from the water discharge port 474.

Next, when the user pushes a "stop switch", not shown, on the manipulator 500, the controller 405 switches the flow rate switching valve 471 and the flow channel switching valve 472 from "bottom water force 3" to "bypass" so that water can be squirted from the water discharge portion 479 provided in the nozzle cleaning chamber 478 (timing t364). Simultaneously, the controller 405 starts to energize the electrolytic cell unit 450 to produce sterilizing water in the electrolytic cell unit 450 (timing t364).

Next, the controller 405 houses the nozzle 473 advanced to the position of "bottom washing" in the casing 400 (timing t365-t366). At this time, the controller 405 opens the solenoid valve 431, and energizes the electrolytic cell unit 450 to produce sterilizing water. Hence, the body of the nozzle 473 is cleaned with the sterilizing water squirted from the water discharge portion 479.

Next, the controller 405 advances the nozzle 473 to the position of "drainage" (timing t366-t367), and then houses the nozzle 473 in the casing 400 (timing t367-t368). Hence, the tip portion of the nozzle 473 provided with the water discharge port 474 and the outer peripheral surface of the nozzle 473 are sterilized with the sterilizing water. Thus, while squirting sterilizing water from the water discharge portion 479, the controller 405 advances and retracts the nozzle 473 again so that the tip portion and body of the nozzle 473 can be sterilized more reliably. At this time, the nozzle 473 can be sterilized by being advanced to the position of "drainage", which has a smaller amount of advancement than the position of "bottom washing", so as not to bring discomfort to the user.

Next, the controller 405 switches the flow rate switching valve 471 and the flow channel switching valve 472 from "bypass" to "SC". Thus, post-cleaning is performed by discharging the sterilizing water from all the water discharge ports 474 for "bottom washing" and "bidet washing" (timing t368-t369). At this time again, the controller 405 opens the solenoid valve 431 and energizes the electrolytic cell unit 450. Hence, the water discharge port 474 region of the nozzle 473 is cleaned with the sterilizing water discharged by the water discharge ports 474 themselves.

Next, the controller 405 stops energizing the electrolytic cell unit 450. Furthermore, the controller 405 switches the flow rate switching valve 471 and the flow channel switching valve 472 from "SC" to "origin", and sets the hot water heater 441 to the "keep-warm control mode" (timing t369). Subsequently, the controller 405 closes the solenoid valve 431 (timing t370). Here, as described above, it is because of the so-called "after-boiling prevention" that the controller 405 closes the solenoid valve 431 after changing the setting of the hot water heater 441.

Next, when a prescribed time (e.g., approximately 5 minutes) has elapsed after the seating sensor 404 ceases to sense the human body, the controller 405 switches the flow rate switching valve 471 and the flow channel switching valve 472 from "origin" to "SC" (timing t371), and moves the nozzle 473 to the position of "drainage" (timing t372). Thus, the "drainage" of the flow channel 20 is performed (timing t371-t373). That is, the controller 405 drains the sterilizing water inside the flow channel 20, thereby emptying the flow channel 20. Here, the time period for performing the "drainage" is e.g. approximately 30 seconds.

As described above, according to this embodiment, after the seating sensor 404 senses a human body, the controller 405 performs hot water preparation for opening the solenoid valve 431, activating the hot water heater 441, and draining water from the water discharge port 474. Furthermore, based on the time period required to fill the flow channel 20 on the downstream side of the electrolytic cell unit 450 with sterilizing water, the controller 405 controls the timing to activate the electrolytic cell unit 450 after starting the hot water preparation.

Thus, the flow channel 20 on the downstream side of the electrolytic cell unit 450 can be filled with a smaller amount of sterilizing water. Hence, wasteful drainage of the sterilizing water can be suppressed. Furthermore, because the energization time of the anode plate 451 and the cathode plate 452 can be made shorter, the lifetime of the anode plate 451 and the cathode plate 452 can be increased. Furthermore, because the energization time of the anode plate 451 and the cathode plate 452 can be made shorter, generation of scale can be suppressed.

Next, still another embodiment of the invention is described with reference to the drawings.

Figure 21:
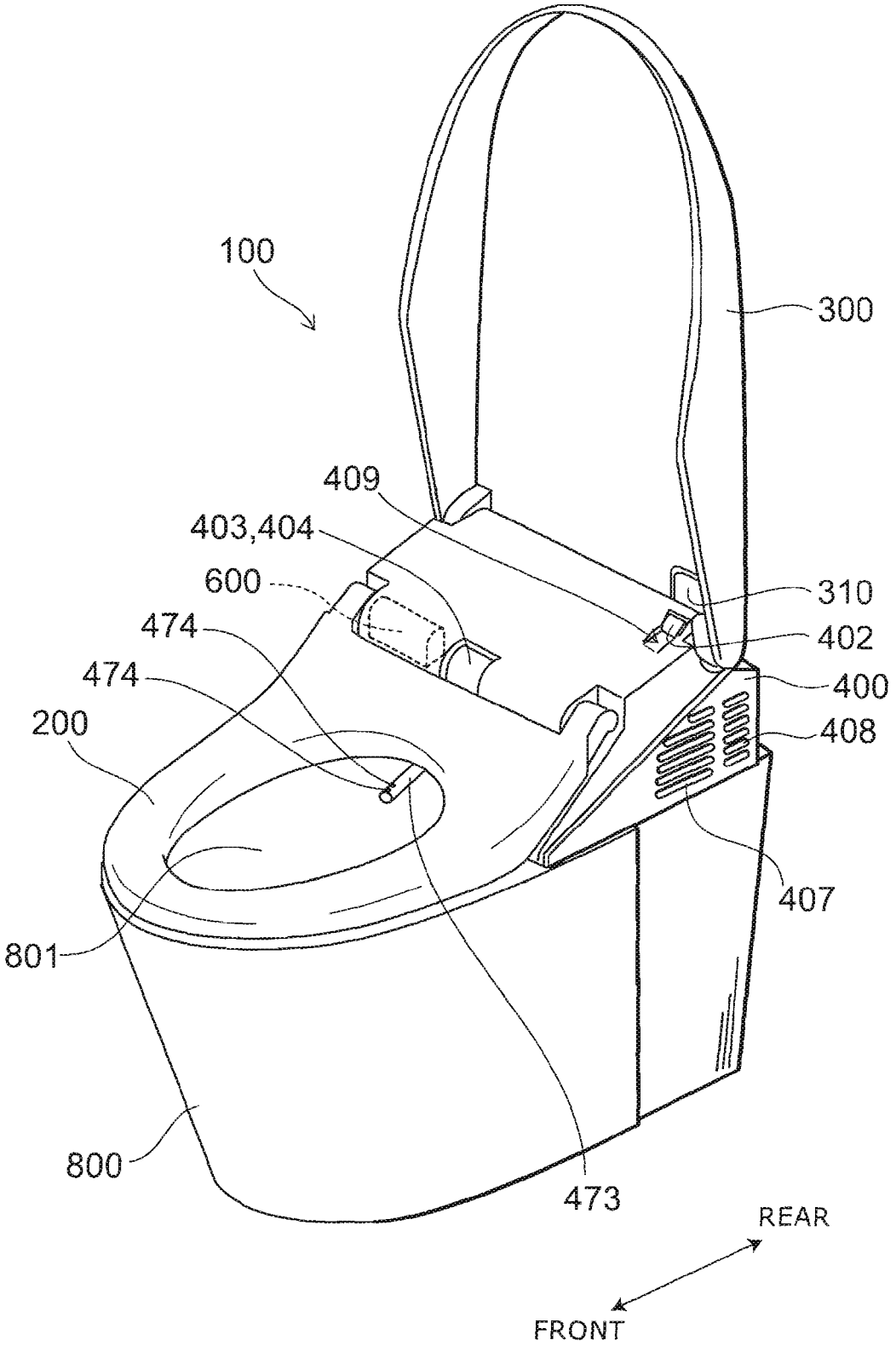
FIG. 21 is a perspective schematic view showing a toilet device equipped with a sanitary washing device according to still another embodiment of the invention.

FIG. 21 is a perspective schematic view showing a toilet device equipped with a sanitary washing device according to still another embodiment of the invention.

Figure 22:
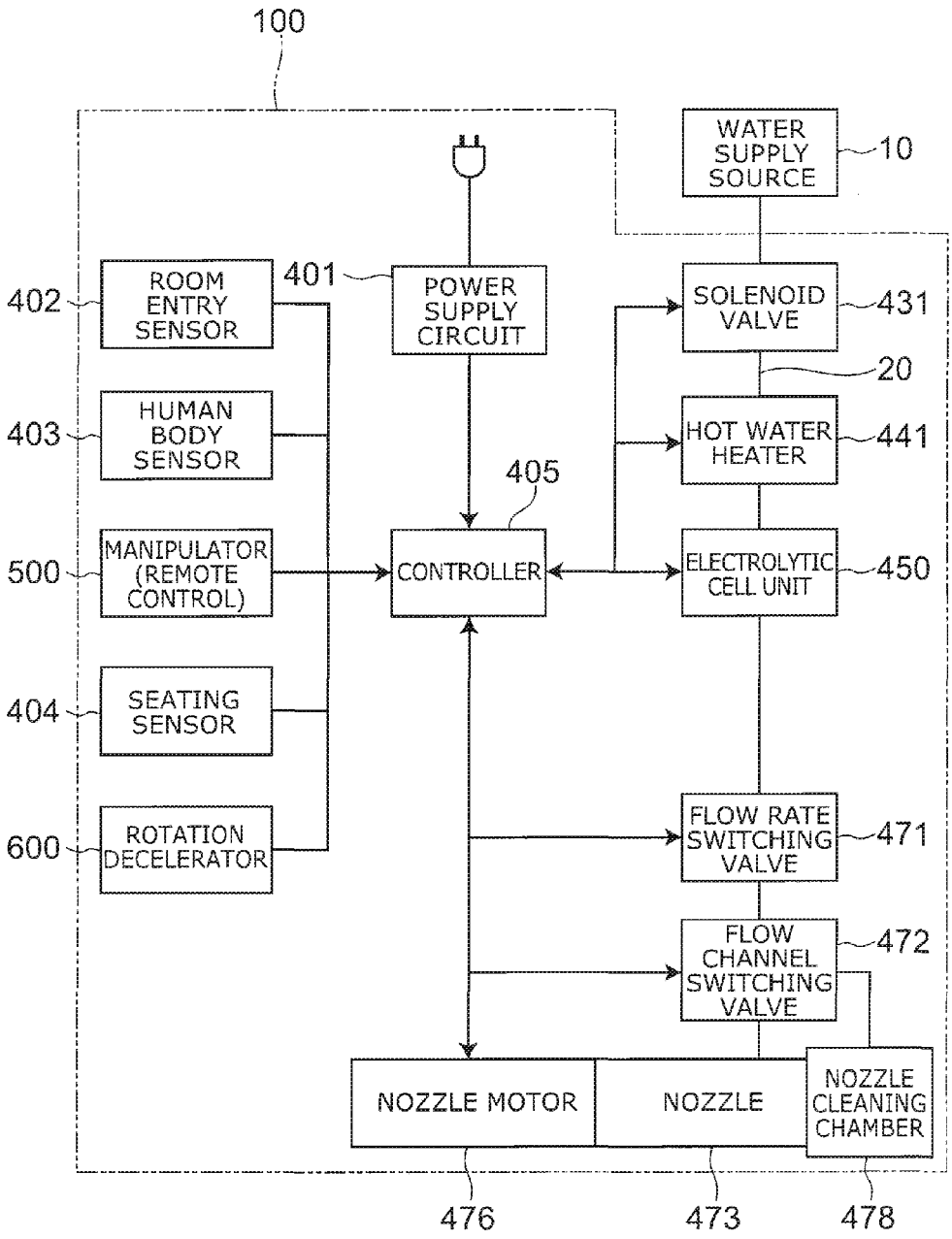
FIG. 22 is a block diagram showing the relevant configuration of the sanitary washing device according to this embodiment.

FIG. 22 is a block diagram showing the relevant configuration of the sanitary washing device according to this embodiment.

In FIG. 22, the relevant configuration of the water channel system and the electrical system is shown together.

The nozzle 473 can be advanced into or retracted from the bowl 801 of the toilet stool 800 under a driving force from a nozzle motor 476. That is, the nozzle motor 476 can advance/retract the nozzle 473 based on commands from the controller 405.

Furthermore, the controller 405 is supplied with electrical power from a power supply circuit 401. The controller 405 can receive signals from a room entry sensor (human body sensing device) 402 for sensing entry of a user into a toilet room, a human body sensor 403 for sensing a user present in front of the toilet seat 200, a seating sensor 404 for sensing seating of a user on the toilet seat 200, and a manipulator 500. Based on these signals, the controller 405 can control the operation of the solenoid valve 431, hot water heater 441, electrolytic cell unit 450, flow rate switching valve 471 and flow channel switching valve 472, and nozzle motor 476.

The seating sensor 404 can sense a human body present above the toilet seat 200 immediately before the user is seated on the toilet seat 200. Furthermore, the seating sensor 404 can sense a user seated on the toilet seat 200. That is, the seating sensor 404 can sense not only a user seated on the toilet seat 200, but also a user present above the toilet seat 200. Such a seating sensor 404 can be e.g. an infrared transmit/receive range sensor.

The human body sensor 403 can sense a user present in front of the toilet stool 800, i.e., a user present at a position spaced in front of the toilet seat 200. That is, the human body sensor 403 can sense a user entering the toilet room and approaching the toilet seat 200. Such a human body sensor 403 can be e.g. an infrared transmit/receive range sensor.

The room entry sensor 402 can sense a user who has just opened the door of the toilet room and entered the toilet room. Furthermore, the room entry sensor 402 can sense a user about to enter the toilet room and present in front of the door. That is, the room entry sensor 402 can sense not only a user who has entered the toilet room, but also a user who is yet to enter the toilet room, i.e., a user present in front of the door outside the toilet room. Such a room entry sensor 402 can be e.g. a pyroelectric sensor, or a microwave sensor such as Doppler sensor. The microwave sensor can be based on the microwave Doppler effect, or can transmit a microwave and detect an object based on the amplitude (intensity) of the reflected microwave. In the case of using such a sensor, the presence of a user can be sensed through the door of the toilet room. That is, such a sensor can sense a user before entering the toilet room.

In the toilet device shown in FIG. 21, a recess 409 is formed in the upper surface of the casing 400. The room entry sensor 402 is partly embedded in this recess 409. In the closed state of the toilet lid 300, the room entry sensor 402 senses entry of a user through a transmissive window 310 provided near the base of the toilet lid 300. For instance, when the room entry sensor 402 senses a user, the controller 405 can automatically open the toilet lid 300 based on the sensing result of the room entry sensor 402. Furthermore, the seating sensor 404 and the human body sensor 403 are provided at the front center of the casing 400. However, the installation configuration of the seating sensor 404, the human body sensor 403, and the room entry sensor 402 is not limited thereto, but can be suitably modified.

The casing 400 includes therein a rotation decelerator (toilet lid opening/closing sensing device) 600 for damping the closing speed of the toilet seat 200 and the toilet lid 300. The rotation decelerator 600 can apply resistance to the rotation of the toilet seat 200 and the toilet lid 300 in one direction (closing direction), sense the rotational angle of the toilet seat 200 and the toilet lid 300, and sense the presence or absence of rotation of the toilet seat 200 and the toilet lid 300. This rotation decelerator 600 is described later in detail. The rest of the structure of the toilet device equipped with the sanitary washing device 100 according to this embodiment is similar to that of the toilet device described above with reference to FIG. 1. Furthermore, the rest of the relevant configuration of the sanitary washing device 100 according to this embodiment is similar to the relevant configuration of the sanitary washing device 100 described above with reference to FIG. 13.

According to this embodiment, after the human body sensing device senses a human body, the sanitary washing device 100 can supply the sterilizing water produced in the electrolytic cell unit 450 to the flow channel 20, fill the flow channel 20 with the sterilizing water, and retain the sterilizing water for a prescribed time inside the flow channel 20. In this step, the flow channel switching valve 472 can be closed to facilitate retaining the sterilizing water inside the flow channel 20. In particular, because the flow channel extending to the water discharge port 474 of the nozzle 473 is prone to pollution, this embodiment is effective. Furthermore, when the sterilizing water is filled and retained inside the flow channel 20, injection of the sterilizing water into the flow channel 20 is preferably performed after completely replacing the water remaining inside the flow channel 20. Furthermore, after filling and retaining the sterilizing water for a prescribed time inside the flow channel 20, the sanitary washing device 100 according to this embodiment can drain the sterilizing water out of the flow channel 20.

Thus, in the sanitary washing device 100, the sterilizing water is filled and retained for a prescribed time inside the flow channel 20. Hence, bacteria surviving inside the flow channel 20 can be sterilized more reliably, and hygienic water can be squirted from the water discharge port 474. This is one of the effective means in the case where the flow channel 20 is formed from an antibacterial metal with weaker sterilizing power. Furthermore, in the sanitary washing device 100, after filling and retaining the sterilizing water for a prescribed time inside the flow channel 20, the sterilizing water is drained out of the flow channel 20. Hence, even if the sterilizing power of the sterilizing water is decreased over time, the action of the sterilizing water as a nutrient source for bacteria can be suppressed. In the following, these operations are described with reference to the drawings.

Figure 23:
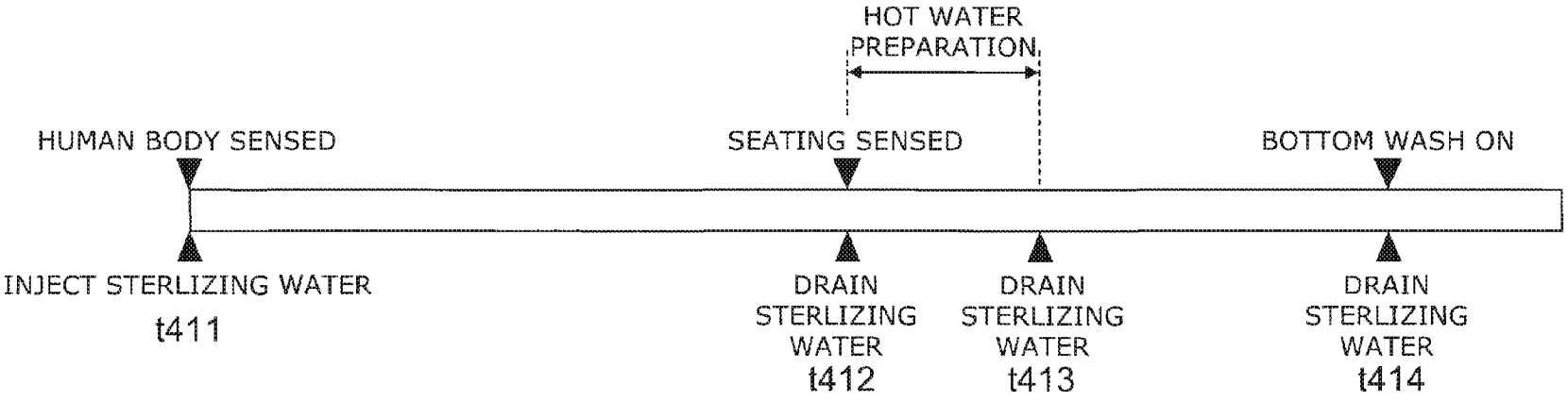
FIG. 23 is a conceptual schematic diagram generally showing the operation of the sanitary washing device according to this embodiment.

FIG. 23 is a conceptual schematic diagram generally showing the operation of the sanitary washing device according to this embodiment.

According to this embodiment, after the human body sensing device senses a human body, the sanitary washing device 100 starts to energize the electrolytic cell unit 450 to supply sterilizing water to the flow channel 20 on the downstream side of the electrolytic cell unit 450 (timing t411). Thus, the flow channel 20 on the downstream side of the electrolytic cell unit 450 is filled and sterilized with the sterilizing water.

Here, the human body sensing device is illustratively a room entry sensor 402 or a human body sensor 403. However, the human body sensing device is not limited thereto. The human body sensing device may be a device for sensing "turn-on" of the lamp switch of the toilet room, a device for sensing the opening motion of the door of the toilet room, or a device for sensing the opening motion of the toilet lid. For instance, a toilet lid opening/closing device (toilet lid opening/closing sensing device), not shown, for opening/closing the toilet lid 300 may be provided inside the casing 400. In this case, the controller 405 can automatically open the toilet lid 300 based on the sensing result of the room entry sensor 402. In this case, the sanitary washing device 100 can start to energize the electrolytic cell unit 450 based on the opening motion of the toilet lid 300 by the toilet lid opening/closing device.

Alternatively, the human body sensing device may be a rotation decelerator 600. The rotation decelerator 600 can sense the rotational angle of the toilet seat 200 and the toilet lid 300. Hence, the rotation decelerator 600 can sense the opening motion of the toilet lid 300. Thus, the sanitary washing device 100 can start to energize the electrolytic cell unit 450 based on the opening motion of the toilet lid 300 by the rotation decelerator 600. This rotation decelerator 600 is described later in detail.

Thus, the term "human body sensing device" used herein encompasses not only devices for performing "human body sensing" such as the room entry sensor 402, but also devices for performing "utilization sensing", i.e., for sensing the possibility of utilization of the sanitary washing device 100 such as a device for sensing "turn-on" of the lamp switch of the toilet room.

Accordingly, when there is a possibility that a user utilizes the sanitary washing device 100, the sanitary washing device 100 can earlier supply the sterilizing water to the flow channel 20 on the downstream side of the electrolytic cell unit 450. That is, the sanitary washing device 100 can supply the sterilizing water to the flow channel 20 on the downstream side of the electrolytic cell unit 450, for instance, after the room entry sensor 402 senses a user who has just entered the toilet room and before the seating sensor 404 senses a user seated on the toilet seat 200. Thus, bacteria surviving inside the flow channel 20 can be sterilized at an earlier stage after sensing the possibility of utilization of the sanitary washing device 100.

Next, when the seating sensor 404 senses a user seated on the toilet seat 200, the sanitary washing device 100 stops energizing the electrolytic cell unit 450, and supplies clean water to the flow channel 20 on the downstream side of the electrolytic cell unit 450 (timing t412). Thus, the sterilizing water in the flow channel 20 on the downstream side of the electrolytic cell unit 450 is drained to the bowl 801 of the toilet stool 800.

At this time, the sanitary washing device 100 activates the hot water heater 441. That is, the sanitary washing device 100 starts hot water preparation for activating the hot water heater 441 and draining water from the water discharge port 474 (timing t412). The operation of the hot water preparation is the operation of draining the water in the flow channel 20 from the water discharge port 474 and replacing the water in the flow channel 20 on the downstream side of the heat exchanger unit 440 by the water heated in the heat exchanger unit 440. Thus, the flow channel 20 on the downstream side of the heat exchanger unit 440 can be warmed. Hence, in washing the "bottom" and other parts of a user seated on the toilet seat 200, cold water can be prevented from being squirted at the "bottom" and other parts of the user.

Next, when the operation of the hot water preparation is completed, the sanitary washing device 100 restarts to energize the electrolytic cell unit 450 to supply sterilizing water to the flow channel 20 on the downstream side of the electrolytic cell unit 450 (timing t413). Thus, the flow channel 20 on the downstream side of the electrolytic cell unit 450 is refilled with the sterilizing water.

Next, when the user presses the "bottom washing switch", not shown, provided on the manipulator 500, the sanitary washing device 100 stops energizing the electrolytic cell unit 450, and supplies clean water to the flow channel 20 on the downstream side of the electrolytic cell unit 450 (timing t414). Thus, the sterilizing water in the flow channel 20 on the downstream side of the electrolytic cell unit 450 is drained to the bowl 801 of the toilet stool 800 (timing t414).

Then, the sanitary washing device 100 squirts water from the water discharge port 474 for "bottom washing" to wash the "bottom" of the user seated on the toilet seat 200. At this time, because the sterilizing water in the flow channel 20 is drained by the operation at timing t414, there is no case where the sterilizing water is squirted at the user's private parts. Furthermore, as described above, after the human body sensing device senses the human body and after the hot water preparation is completed, the inside of the flow channel 20 on the downstream side of the electrolytic cell unit 450 is sterilized with sterilizing water. Hence, hygienic water is squirted from the water discharge port 474.

According to this embodiment, after the human body sensing device senses a human body, the sanitary washing device 100 starts to energize the electrolytic cell unit 450 to supply sterilizing water to the flow channel 20 on the downstream side of the electrolytic cell unit 450. In the case where the human body sensing device is a room entry sensor 402, after the room entry sensor 402 senses a user just entering the toilet room, the sanitary washing device 100 can supply sterilizing water to the flow channel 20 on the downstream side of the electrolytic cell unit 450. Hence, the sterilizing water can be retained for a longer time inside the flow channel 20 on the downstream side of the electrolytic cell unit 450.

Before the seating sensor 404 senses a user seated on the toilet seat 200 (before timing t412), the hot water preparation has not been started yet. Thus, before the seating sensor 404 senses a user seated on the toilet seat 200, the flow channel 20 on the downstream side of the electrolytic cell unit 450 is filled with sterilizing water at lower temperature. The reproductive power of bacteria is weaker in the environment at lower temperature than in the environment at higher temperature. Hence, before the seating sensor 404 senses a user seated on the toilet seat 200, bacteria surviving inside the flow channel 20 can be sterilized more efficiently.

Figure 24:
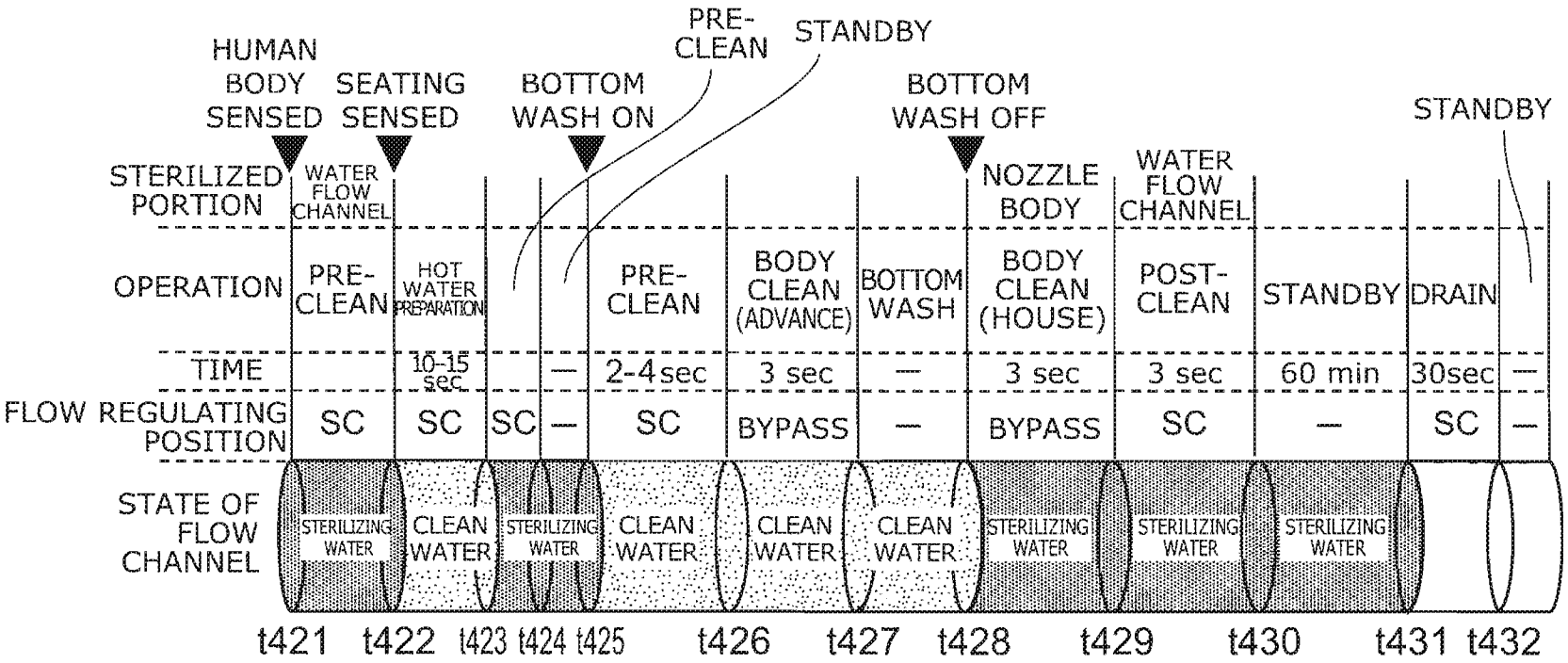
FIG. 24 is a conceptual schematic diagram generally showing the operation and the state of the flow channel of the sanitary washing device according to this embodiment.

FIG. 24 is a conceptual schematic diagram generally showing the operation and the state of the flow channel of the sanitary washing device according to this embodiment.

The state of the flow channel shown in FIG. 24 shows the state inside the flow channel 20 on the downstream side of the electrolytic cell unit 450.

In the following description, it is illustratively assumed that the nozzle 473 includes a plurality of water discharge ports 474.

First, when the human body sensing device senses a human body, the controller 405 starts to energize the electrolytic cell unit 450 to produce sterilizing water in the electrolytic cell unit 450 (timing t421). Furthermore, the controller 405 opens the solenoid valve 431 and supplies the sterilizing water to the flow channel 20 on the downstream side of the electrolytic cell unit 450 (timing t421). Thus, the flow channel 20 on the downstream side of the electrolytic cell unit 450 is filled and sterilized with the sterilizing water. Furthermore, the controller 405 controls the flow rate switching valve 471 and the flow channel switching valve 472, thereby discharging the sterilizing water from all the plurality of water discharge ports 474. Thus, the inside of the flow channel 20 on the downstream side of the electrolytic cell unit 450 and the water discharge port 474 region are sterilized with the sterilizing water.

Next, when the seating sensor 404 senses a user seated on the toilet seat 200, the controller 405 stops energizing the electrolytic cell unit 450, and supplies clean water to the flow channel 20 on the downstream side of the electrolytic cell unit 450 (timing t422). Thus, the sterilizing water in the flow channel 20 on the downstream side of the electrolytic cell unit 450 is drained to the bowl 801 of the toilet stool 800. At this time, the sanitary washing device 100 activates the hot water heater 441. That is, the sanitary washing device 100 starts hot water preparation for activating the hot water heater 441 and draining water from the water discharge port 474 (timing t422). Here, the time period for performing the hot water preparation is e.g. approximately 10-15 seconds.

Next, upon completion of the operation of the hot water preparation, the controller 405 starts to energize the electrolytic cell unit 450 to produce sterilizing water in the electrolytic cell unit 450 (timing t423). Then, the controller 405 controls the flow rate switching valve 471 and the flow channel switching valve 472, thereby discharging the sterilizing water from all the plurality of water discharge ports 474. At this time, because the sterilizing water is discharged from the water discharge port 474, the inside of the flow channel 20 on the downstream side of the electrolytic cell unit 450 and the water discharge port 474 region are sterilized with the sterilizing water. This sterilizing water has been warmed so that the flow channel warmed in the hot water preparation is not cooled down.

Next, the controller 405 stops energizing the electrolytic cell unit 450 and closes the solenoid valve 431 (timing t424). With the solenoid valve 431 closed, the controller 405 waits on standby until the "bottom washing switch", not shown, provided on the manipulator 500 is pressed by the user (timing t424-t425). At this time, because the controller 405 closes the solenoid valve 431 and the flow channel switching valve 472, the sterilizing water produced in the electrolytic cell unit 450 can be retained for a prescribed time inside the flow channel 20 on the downstream side of the electrolytic cell unit 450. Thus, the inside of the flow channel 20 on the downstream side of the electrolytic cell unit 450 can be sterilized before the user performs "bottom washing".

This prescribed time refers to the time for which the sterilizing water is retained inside the flow channel 20 on the downstream side of the electrolytic cell unit 450, i.e., the time from when the controller 405 closes the solenoid valve 431 and the flow channel switching valve 472 until the "bottom washing switch" is pressed by the user. Thus, this prescribed time varies with the time period for e.g. the user's act of using the toilet.

Next, when the user presses the "bottom washing switch", not shown, provided on the manipulator 500 (timing t425), the controller 405 receives a signal for performing private parts washing. Then, the controller 405 first performs "pre-cleaning" with clean water (timing t425-t426). More specifically, the controller 405 controls the flow rate switching valve 471 and the flow channel switching valve 472, thereby discharging clean water from all the plurality of water discharge ports 474 to clean these water discharge ports 474. At this time, the controller 405 does not energize the electrolytic cell unit 450, and does not produce sterilizing water. Hence, the region around the plurality of water discharge ports 474 is physically cleaned with clean water (including clean water reflected by the inner wall of the nozzle cleaning chamber 478) discharged by the water discharge ports 474 themselves.

In other words, the sterilizing water retained inside the flow channel 20 is drained from the water discharge port 474 by the newly supplied clean water. That is, the sterilizing water retained inside the flow channel 20 is replaced by the newly supplied clean water and drained. Here, the time period for performing the pre-cleaning with clean water is e.g. approximately 2-4 seconds.

Next, the controller 405 controls the flow rate switching valve 471 and the flow channel switching valve 472, thereby squirting clean water from the water discharge portion 479 provided in the nozzle cleaning chamber 478. Simultaneously, the controller 405 advances the nozzle 473 into the bowl 801. Thus, the body of the nozzle 473 is cleaned with clean water squirted from the water discharge portion 479 (timing t426-t427). At this time again, the controller 405 does not energize the electrolytic cell unit 450, and does not produce sterilizing water. Hence, the body of the nozzle 473 is physically cleaned with clean water squirted from the water discharge portion 479.

At this time again, the sterilizing water retained inside the flow channel 20 connected to the water discharge portion 479 is replaced by the newly supplied clean water and drained. Here, the time period for performing the body cleaning with clean water is e.g. approximately 3 seconds.

Next, the controller 405 controls the flow rate switching valve 471 and the flow channel switching valve 472, thereby squirting clean water from the water discharge port 474 for "bottom washing" to wash the "bottom" of the user seated on the toilet seat 200 (timing t427-t428). At this time, the controller 405 does not energize the electrolytic cell unit 450, and does not produce sterilizing water. Furthermore, the sterilizing water which was retained inside the flow channel 20 is replaced by the newly supplied clean water and drained at timing t425-t427. Hence, there is no case where the sterilizing water is squirted at the user's private parts.

Furthermore, during the hot water preparation and standby before performing "bottom washing", the inside of the flow channel 20 on the downstream side of the electrolytic cell unit 450 is sterilized with sterilizing water (timing t421-t422, t423-t425). Hence, hygienic water is squirted from the water discharge port 474.

Next, when the user presses the "stop switch", not shown, on the manipulator 500 (timing t428), the controller 405 controls the flow rate switching valve 471 and the flow channel switching valve 472, thereby squirting sterilizing water from the water discharge portion 479 provided in the nozzle cleaning chamber 478. Simultaneously, the controller 405 houses the nozzle 473 in the casing 400 (timing t428-t429). That is, the controller 405 starts to energize the electrolytic cell unit 450 to produce sterilizing water, and performs "body cleaning" of the nozzle 473 with the sterilizing water squirted from the water discharge portion 479 (timing t428-t429). Thus, the inside of the flow channel 20 on the downstream side of the electrolytic cell unit 450 and the outer peripheral surface of the nozzle 473 are sterilized with the sterilizing water. Here, the time period for performing the body cleaning with the sterilizing water is e.g. approximately 3 seconds.

Next, with the nozzle 473 housed in the casing 400, the controller 405 controls the flow rate switching valve 471 and the flow channel switching valve 472, thereby discharging sterilizing water from all the plurality of water discharge ports 474 to perform "post-cleaning" of these water discharge ports 474 (timing t429-t430). That is, the controller 405 energizes the electrolytic cell unit 450 to produce sterilizing water, and performs the post-cleaning of the water discharge port 474 region with the sterilizing water squirted from the water discharge port 474 (timing t429-t430). Thus, the inside of the flow channel 20 and the water discharge port 474 region are sterilized with the sterilizing water. Here, the time period for performing the post-cleaning with the sterilizing water is e.g. approximately 3 seconds.

Next, the controller 405 closes the solenoid valve 431, and then closes the flow channel switching valve 472, so that the sterilizing water produced in the electrolytic cell unit 450 is retained for a prescribed time inside the flow channel 20 (timing t430-t431). Thus, after the user performs "bottom washing", the inside of the flow channel 20 can be sterilized. This prescribed time is e.g. approximately 60 minutes. Thus, in the sanitary washing device 100 according to this embodiment, the sterilizing water is retained for a longer time inside the flow channel 20. Hence, bacteria surviving inside the flow channel 20 can be sterilized more reliably.

Next, after the lapse of the prescribed time, the controller 405 performs "drainage" (timing t431-t432). That is, the controller 405 drains the sterilizing water inside the flow channel 20, thereby emptying the flow channel 20. The time period for performing this "drainage" is e.g. approximately 30 seconds. Thus, in the sanitary washing device 100 according to this embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

The controller 405 of this embodiment performs the cleaning step for cleaning the nozzle 473, and retains sterilizing water for a prescribed time inside the flow channel 20 continuously subsequent to the cleaning step. Here, the term "cleaning step" for cleaning the nozzle used herein refers to at least one of the pre-cleaning with the sterilizing water, the body cleaning with the sterilizing water, and the post-cleaning with the sterilizing water. Thus, after performing the cleaning step for cleaning the nozzle 473, the inside of the flow channel 20 can be elaborately sterilized. Hence, bacteria surviving inside the flow channel 20 can be sterilized more reliably.

Figure 25:
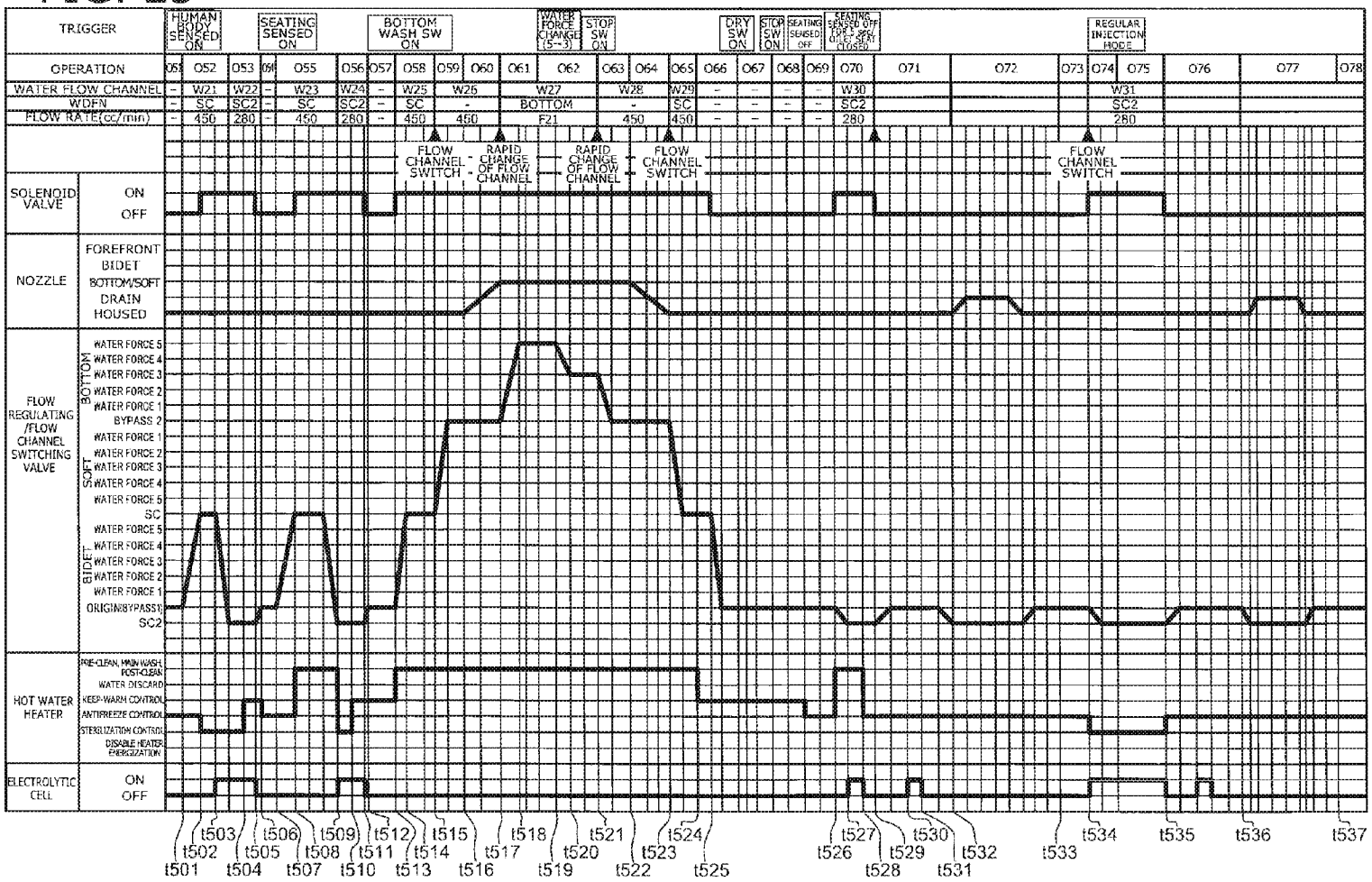
FIG. 25 is a tinning chart illustrating an example operation of the sanitary washing device according to this embodiment.

FIG. 25 is a timing chart illustrating an example operation of the sanitary washing device according to this embodiment.

"O51" of "OPERATION" in FIG. 25 shows "STANDBY".

"O52" of "OPERATION" in FIG. 25 shows "HOT WATER PREPARATION". "O53" of "OPERATION" in FIG. 25 shows "PRE-STERILIZE". "O54" of "OPERATION" in FIG. 25 shows "STANDBY". "O55" of "OPERATION" in FIG. 25 shows "HOT WATER PREPARATION". "O56" of "OPERATION" in FIG. 25 shows "PRE-STERILIZE". "O57" of "OPERATION" in FIG. 25 shows "KEEP WARM".

"O58" of "OPERATION" in FIG. 25 shows "PRE-CLEAN". "O59" of "OPERATION" in FIG. 25 shows "DEPRESSURE". "O60" of "OPERATION" in FIG. 25 shows "BODY CLEAN (ADVANCE NOZZLE)". "O61" of "OPERATION" in FIG. 25 shows "SOFT START". "O62" of "OPERATION" in FIG. 25 shows "MAIN WASH". "O63" of "OPERATION" in FIG. 25 shows "DEPRESSURE". "O64" of "OPERATION" in FIG. 25 shows "BODY CLEAN (HOUSE NOZZLE)".

"O65" of "OPERATION" in FIG. 25 shows "POST-CLEAN".

"O66" of "OPERATION" in FIG. 25 shows "KEEP WARM".

"O67" of "OPERATION" in FIG. 25 shows "DRY".

"O68" of "OPERATION" in FIG. 25 shows "KEEP WARM".

"O69" of "OPERATION" in FIG. 25 shows "STANDBY".

"O70" of "OPERATION" in FIG. 25 shows "POST-CLEAN".

"O71" of "OPERATION" in FIG. 25 shows "STERILIZING STEP". "O72" of "OPERATION" in FIG. 25 shows "DRAINAGE/HOT AIR DAMPER STUCK PREVENTION". "O73" of "OPERATION" in FIG. 25 shows "STANDBY". "O74" of "OPERATION" in FIG. 25 shows "DEPRESSURE". "O75" of "OPERATION" in FIG. 25 shows "REGULAR STERILIZATION". "O76" of "OPERATION" in FIG. 25 shows "STERILIZING STEP". "O77" of "OPERATION" in FIG. 25 shows "DRAINAGE/HOT AIR DAMPER STUCK PREVENTION". "O78" of "OPERATION" in FIG. 25 shows "STANDBY".

"W21" to "W25" of "WATER FLOW CHANNEL" in FIG. 25 show "PRIMARY CHANNEL". "W26" of "WATER FLOW CHANNEL" in FIG. 25 shows "BYPASS". "W27" of "WATER FLOW CHANNEL" in FIG. 25 shows "PRIMARY CHANNEL". "W28" of "WATER FLOW CHANNEL" in FIG. 25 shows "BYPASS". "W29" to "W31" of "WATER FLOW CHANNEL" in FIG. 25 show "PRIMARY CHANNEL".

"WDFN" in FIG. 25 shows "WATER DISCHARGE FROM NOZZLE".

"F21" of "FLOW RATE (cc/min)" in FIG. 25 shows "FROM MINIMUM TO PRESET FLOW RATE (270-430)".

First, the human body sensing device senses a human body (timing t501). Then, the controller 405 switches the flow rate switching valve 471 and the flow channel switching valve 472 from "origin" to "SC (self-cleaning)" to enable water discharge from all the water discharge ports 474 for "bottom washing" and "bidet washing". The flow rate (volume of water) at this time is e.g. approximately 450 cc/min.

Next, when the switching of the flow rate switching valve 471 and the flow channel switching valve 472 is completed (timing t502), the controller 405 opens the solenoid valve 431 and sets the hot water heater 441 to the "sterilization control mode". Thus, cold water in the flow channel 20 is drained for hot water preparation. Thus, the hot water preparation is performed before the seating sensor 404 senses a user seated on the toilet seat 200. Hence, the user can perform "bottom washing" even immediately after seated on the toilet seat 200.

Next, the controller 405 starts to energize the electrolytic cell unit 450 to produce sterilizing water in the electrolytic cell unit 450 (timing t503). At this time, because the solenoid valve 431 is opened, the flow channel 20 on the downstream side of the electrolytic cell unit 450 is filled and sterilized with the sterilizing water. Furthermore, because the controller 405 has switched the flow rate switching valve 471 and the flow channel switching valve 472 to "SC2", the water discharge port 474 region is sterilized with the sterilizing water.

The flow rate (volume of water) at this time is e.g. approximately 280 cc/min. That is, the flow rate at this time is lower than the flow rate during the hot water preparation (e.g., approximately 450 cc/min) and the flow rate during the pre-cleaning, body cleaning, and post-cleaning with water (e.g., approximately 450 cc/min). In other words, the controller 405 can produce sterilizing water at a preset flow rate independent of the flow rate in performing private parts washing. In this example, the flow rate during the hot water preparation and the flow rate during the pre-cleaning, body cleaning, and post-cleaning with water are set to the maximum flow rate. Thus, the controller 405 makes the flow rate of water supplied to the electrolytic cell unit 450 lower than the maximum flow rate. Hence, the concentration of hypochlorous acid in the sterilizing water produced in the electrolytic cell unit 450 can be made higher.

Furthermore, at this time, the controller 405 changes the setting of the hot water heater 441 from the "antifreeze control mode" to the "sterilization control mode" (timing t502). The temperature of the hot water heater 441 at this time, i.e., the preset temperature of the hot water heater 441 in the "sterilization control mode", is equal to or higher than the maximum temperature of the preset temperature of the hot water heater 441 in performing private parts washing, i.e., the preset temperature of the hot water heater 441 in the "pre-cleaning mode, main washing mode, post-cleaning mode". In other words, the controller 405 can produce sterilizing water at a preset temperature independent of the temperature in performing private parts washing.

Thus, the controller 405 sets the hot water heater 441 to the "sterilization control mode" so that the temperature is set equal to or higher than the maximum temperature of water supplied from the hot water heater 441 in performing private parts washing. Hence, the concentration of hypochlorous acid in the sterilizing water produced in the electrolytic cell unit 450 can be made higher. Furthermore, because the concentration of hypochlorous acid in the sterilizing water can be made higher by setting the temperature equal to or higher than the maximum temperature in performing private parts washing, the controller 405 can suppress the decrease of the sterilizing power of the sterilizing water, and the sterilizing effect of the sterilizing water retained inside the flow channel 20 can be maintained for a longer time. Thus, the action of the sterilizing water as a nutrient source for bacteria can be suppressed.

Next, the controller 405 changes the setting of the hot water heater 441 from the "sterilization control mode" to the "keep-warm control mode" (timing t504). Next, the controller 405 closes the solenoid valve 431, switches the flow rate switching valve 471 and the flow channel switching valve 472 from "SC2" to "origin", and stops energizing the electrolytic cell unit 450 (timing t505). Next, the controller 405 changes the setting of the hot water heater 441 from the "keep-warm control mode" to the "antifreeze control mode" (timing t506). Here, it is because of the so-called "after-boiling prevention" that the controller 405 closes the solenoid valve 431 after changing the setting of the hot water heater 441. That is, this is because the hot water heater 441 generates residual heat even after its setting is changed from the "sterilization control mode" to the "keep-warm control mode".

Next, until the seating sensor 404 senses a user seated on the toilet seat 200, the controller 405 waits on standby while retaining the sterilizing water inside the flow channel 20 (timing t506-t507). Then, when the seating sensor 404 senses a user seated on the toilet seat 200 (timing t507), the controller 405 switches the flow rate switching valve 471 and the flow channel switching valve 472 from "origin" to "SC" to enable water discharge from all the water discharge ports 474 for "bottom washing" and "bidet washing". The flow rate (volume of water) at this time is e.g. approximately 450 cc/min.

Next, when the switching of the flow rate switching valve 471 and the flow channel switching valve 472 is completed (timing t508), the controller 405 opens the solenoid valve 431 and sets the hot water heater 441 to the "water discard mode". Thus, cold water in the flow channel 20 is drained for hot water preparation again. Next, the controller 405 switches the flow rate switching valve 471 and the flow channel switching valve 472 from "SC" to "SC2", thereby completing the hot water preparation. Then, the controller 405 starts to energize the electrolytic cell unit 450 to produce sterilizing water (timing t509). Furthermore, the controller 405 sets the hot water heater 441 to the "sterilization control mode" (timing t509). The flow rate (volume of water) at this time is e.g. approximately 280 cc/min.

Next, the controller 405 changes the setting of the hot water heater 441 from the "sterilization control mode" to the "keep-warm control mode" (timing t510). Next, the controller 405 closes the solenoid valve 431, switches the flow rate switching valve 471 and the flow channel switching valve 472 from "SC2" to "origin", and stops energizing the electrolytic cell unit 450 (timing t511). Here, as described above, it is because of the so-called "after-boiling prevention" that the controller 405 closes the solenoid valve 431 after changing the setting of the hot water heater 441.

Next, until the "bottom washing switch", not shown, provided on the manipulator 500 is pressed by the user, the controller 405 waits on standby while retaining the sterilizing water inside the flow channel 20, and keeps the temperature of water to be discharged from the water discharge port 474 (timing t512-t513). At this time, because the controller 405 closes the solenoid valve 431 and the flow channel switching valve 472, the sterilizing water produced in the electrolytic cell unit 450 can be retained for a prescribed time inside the flow channel 20. Thus, the inside of the flow channel 20 can be sterilized before the user performs "bottom washing".

Next, when the user presses the "bottom washing switch", not shown, provided on the manipulator 500 (timing t513), the controller 405 receives a signal for performing private parts washing. Then, the controller 405 switches the flow rate switching valve 471 and the flow channel switching valve 472 from "origin" to "SC". Furthermore, the controller 405 opens the solenoid valve 431 and sets the hot water heater 441 to the "pre-cleaning mode, main washing mode, post-cleaning mode". At this time, the controller 405 does not energize the electrolytic cell unit 450, and does not produce sterilizing water. Hence, the water discharge port 474 region is cleaned with water discharged by the water discharge ports 474 themselves.

In other words, the sterilizing water retained inside the flow channel 20 is drained from the water discharge port 474 by the newly supplied water. That is, the sterilizing water retained inside the flow channel 20 is replaced by the newly supplied water and drained.

Next, the controller 405 switches the flow rate switching valve 471 and the flow channel switching valve 472 from "SC" to "bypass 2" so that water can be squirted from the water discharge portion 479 provided in the nozzle cleaning chamber 478 (timing t515). Next, the controller 405 advances the nozzle 473 housed in the casing 400 to the position of "bottom washing" (timing t516-t517). At this time, the controller 405 opens the solenoid valve 431, does not energize the electrolytic cell unit 450, and does not produce sterilizing water. Hence, the body of the nozzle 473 is cleaned with water squirted from the water discharge portion 479. Furthermore, the sterilizing water retained inside the flow channel 20 connected to the water discharge portion 479 is replaced by the newly supplied water and drained.

Next, the controller 405 switches the flow rate switching valve 471 and the flow channel switching valve 472 from "bypass 2" to "bottom water force 5" (timing t517-t518) and performs main washing (bottom washing) (timing t518-t519). Here, for instance, if the user changes the setting of the water force in "bottom washing" from "water force 5" to "water force 3" by the manipulator 500, then the controller 405 switches the flow rate switching valve 471 and the flow channel switching valve 472 from "bottom water force 5" to "bottom water force 3" (timing t519-t520). Then, the controller 405 continues main washing at "water force 3" (timing t520-t521).

In this main washing, the controller 405 does not energize the electrolytic cell unit 450, and does not produce sterilizing water. Furthermore, the sterilizing water which was retained inside the flow channel 20 is replaced by the newly supplied water and drained at timing t513-t517. Hence, there is no case where the sterilizing water is squirted at the user's private parts.

Next, when the user pushes a "stop switch", not shown, on the manipulator 500, the controller 405 switches the flow rate switching valve 471 and the flow channel switching valve 472 from "bottom water force 3" to "bypass 2" so that water can be squirted from the water discharge portion 479 provided in the nozzle cleaning chamber 478 (timing t521). Next, the controller 405 houses the nozzle 473 advanced to the position of "bottom washing" in the casing 400 (timing t522-t523). At this time, the controller 405 opens the solenoid valve 431, does not energize the electrolytic cell unit 450, and does not produce sterilizing water. Hence, the body of the nozzle 473 is cleaned with water squirted from the water discharge portion 479.

Next, with the nozzle 473 housed in the casing 400, the controller 405 switches the flow rate switching valve 471 and the flow channel switching valve 472 from "bypass 2" to "Sc". Thus, post-cleaning is performed by discharging water from all the water discharge ports 474 for "bottom washing" and "bidet washing" (timing t523-t524). At this time again, the controller 405 opens the solenoid valve 431, and does not energize the electrolytic cell unit 450. Hence, the water discharge port 474 region of the nozzle 473 is cleaned with water discharged by the water discharge ports 474 themselves.

Next, the controller 405 closes the solenoid valve 431 and switches the flow rate switching valve 471 and the flow channel switching valve 472 from "SC" to "origin" (timing t525). Next, the user performs "bottom drying" as appropriate and leaves the toilet seat 200. Then, after the lapse of a prescribed time (here, e.g., approximately 5 seconds), the controller 405 switches the flow rate switching valve 471 and the flow channel switching valve 472 from "origin" to "SC2" to enable water discharge from all the water discharge ports 474 for "bottom washing" and "bidet washing" (timing t526). Furthermore, the controller 405 opens the solenoid valve 431 and sets the hot water heater 441 to the "pre-cleaning mode, main washing mode, post-cleaning mode" (timing t526). Furthermore, the controller 405 starts to energize the electrolytic cell unit 450, and starts to produce sterilizing water (timing t527).

Thus, the post-cleaning of the nozzle 473 is performed with the sterilizing water produced in the electrolytic cell unit 450. That is, the sterilizing water produced in the electrolytic cell unit 450 is discharged from the water discharge port 474. Hence, the inside of the flow channel 20 and the water discharge port 474 region are sterilized with the sterilizing water.

Thus, after the user performs "bottom washing", the inside of the flow channel 20 can be sterilized.

The flow rate (volume of water) at this time is e.g. approximately 280 cc/min. Thus, as described above, by decreasing the flow rate of water supplied to the electrolytic cell unit 450, the controller 405 can increase the concentration of hypochlorous acid in the sterilizing water produced in the electrolytic cell unit 450.

Next, the controller 405 stops energizing the electrolytic cell unit 450, and sets the hot water heater 441 to the "anti-freeze control mode" (timing t528). Subsequently, the controller 405 closes the solenoid valve 431 and the flow channel switching valve 472, so that the sterilizing water produced in the electrolytic cell unit 450 is retained for a prescribed time inside the flow channel 20 (timing t529-t532). Thus, after the user performs "bottom washing", the inside of the flow channel 20 can be sterilized.

The time period for performing this sterilizing water retaining step is e.g. approximately 60 minutes. Thus, in the sanitary washing device 100 according to this embodiment, the sterilizing water is retained for a longer time inside the flow channel 20. Hence, bacteria surviving inside the flow channel 20 can be sterilized more reliably. Here, the controller 405 may energize the electrolytic cell unit 450 to supply sterilizing water (timing t530-t531) while retaining sterilizing water inside the flow channel 20 (timing t529-t532). Thus, even if the sterilizing power of the sterilizing water is decreased over time, the controller 405 can control the electrolytic cell unit 450 to supply new sterilizing water, thereby suppressing the decrease of sterilizing power.

Next, after the lapse of the prescribed time (e.g., approximately 60 minutes), the controller 405 switches the flow rate switching valve 471 and the flow channel switching valve 472 from "origin" to "SC2", and moves the nozzle 473 to the position of "drainage" (timing t532). Thus, the "drainage" of the flow channel 20 is performed (timing t532-t533). That is, the controller 405 drains the sterilizing water inside the flow channel 20, thereby emptying the flow channel 20. Thus, in the sanitary washing device 100 according to this embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

After the controller 405 performs drainage of the flow channel 20, the controller 405 enters the standby state (timing t533-t534). Subsequently, the controller 405 switches the flow rate switching valve 471 and the flow channel switching valve 472 from "origin" to "SC2" to enable water discharge from all the water discharge ports 474 for "bottom washing" and "bidet washing" (timing t534). Furthermore, the controller 405 opens the solenoid valve 431 and sets the hot water heater 441 to the "sterilization control mode" (timing t534). Furthermore, the controller 405 starts to energize the electrolytic cell unit 450, and starts to produce sterilizing water (timing t534). That is, here, as described above with reference to timing t526-t529, the inside of the flow channel 20 and the water discharge port 474 region are sterilized with the sterilizing water (timing t533-t534).

Next, as in the operation described above with reference to timing t529-t532, the controller 405 closes the solenoid valve 431 and the flow channel switching valve 472, so that the sterilizing water produced in the electrolytic cell unit 450 is retained for a prescribed time inside the flow channel 20 (timing t535-t536). Thus, after the user performs "bottom washing", the inside of the flow channel 20 can be regularly sterilized. Then, as in the operation described above with reference to timing t532-t533, the controller 405 drains the sterilizing water inside the flow channel 20, thereby emptying the flow channel 20 (timing t536-t537). Thus, bacteria surviving inside the flow channel 20 can be sterilized more reliably, and multiplication of bacteria inside the flow channel 20 can be suppressed more reliably.

Here, with regard to the triggers for performing regular sterilization and drainage of the flow channel 20 (timing t534-t537), for instance, the controller 405 can perform regular sterilization and drainage at times appropriately set by a timer. The times of the timer may be preset during manufacturing or before shipment of the sanitary washing device 100, or may be configured by the user as desired. Alternatively, the controller 405 can perform regular sterilization and drainage during night hours when the sanitary washing device 100 is not used.

Alternatively, the controller 405 may store the frequency of usage of the sanitary washing device 100 by the user, and learn the hours having low usage frequency. Thus, the controller 405 can perform regular sterilization and drainage during the hours having low frequency of usage by the user.

Figure 26A:
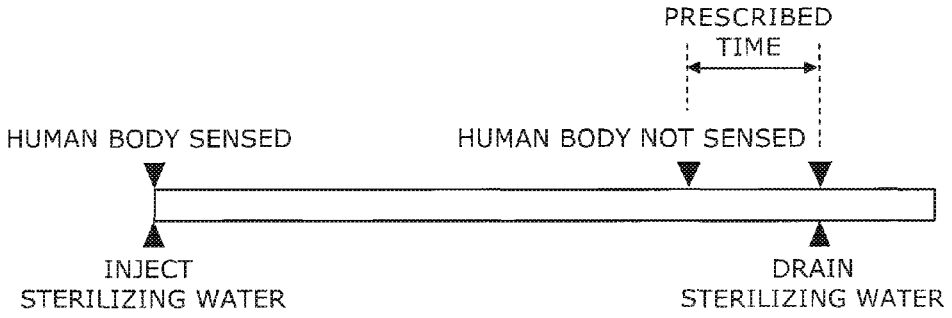
FIGS. 26A to 26C are conceptual schematic diagrams showing variations of the operation of the sanitary washing device according to this embodiment.
Figure 26B:
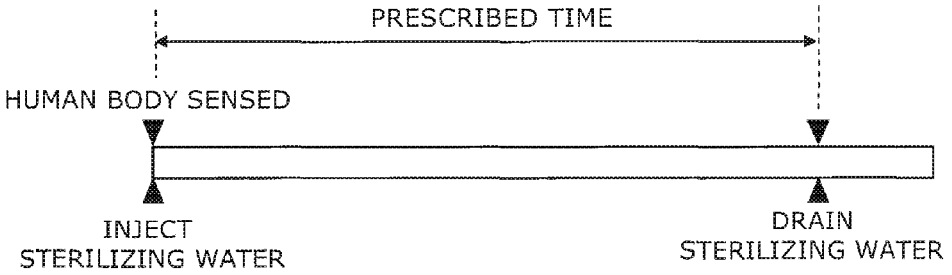
Figure 26C:
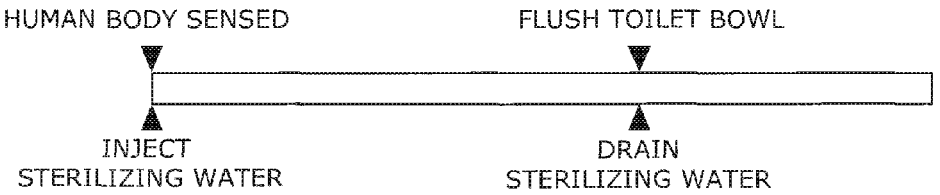

FIGS. 26A to 26C are conceptual schematic diagrams showing variations of the operation of the sanitary washing device according to this embodiment.

The operation described above with reference to FIGS. 23 to 25 relates to the case where "bottom washing" is performed after the human body sensing device senses a human body. However, there may be cases where "bottom washing" is not performed after the human body sensing device senses a human body. For instance, this occurs in the case where a male user urinates in the standing position.

Also in this case, the controller 405 can perform "drainage" of the flow channel 20. That is, even in the case where "bottom washing" is not performed after the human body sensing device senses a human body, the controller 405 can drain the sterilizing water inside the flow channel 20, thereby emptying the flow channel 20.

For instance, as shown in FIG. 26A, after the lapse of a prescribed time since the human body sensing device ceased to sense a human body, the controller 405 can drain the sterilizing water inside the flow channel 20, thereby emptying the flow channel 20. Alternatively, as shown in FIG. 26B, after the lapse of a prescribed time since the human body sensing device sensed a human body, the controller 405 can forcibly drain the sterilizing water inside the flow channel 20, thereby emptying the flow channel 20. Alternatively, as shown in FIG. 26C, after the human body sensing device senses a human body, if the seating sensor 404 does not sense a user seated on the toilet seat 200 even after the lapse of a prescribed time, then the controller 405 can drain the sterilizing water inside the flow channel 20 simultaneously with the operation for flushing the toilet bowl, thereby emptying the flow channel 20.

Thus, even in the case where "bottom washing" is not performed after the human body sensing device senses a human body, the controller 405 can drain the sterilizing water inside the flow channel 20, thereby emptying the flow channel 20, after retaining the sterilizing water for a prescribed time inside the flow channel 20. Hence, even if the sterilizing power of the sterilizing water is decreased over time, the action of the sterilizing water as a nutrient source for bacteria can be suppressed.

Next, an example with the human body sensing device being a rotation decelerator 600 is described with reference to the drawings.

Figure 27:
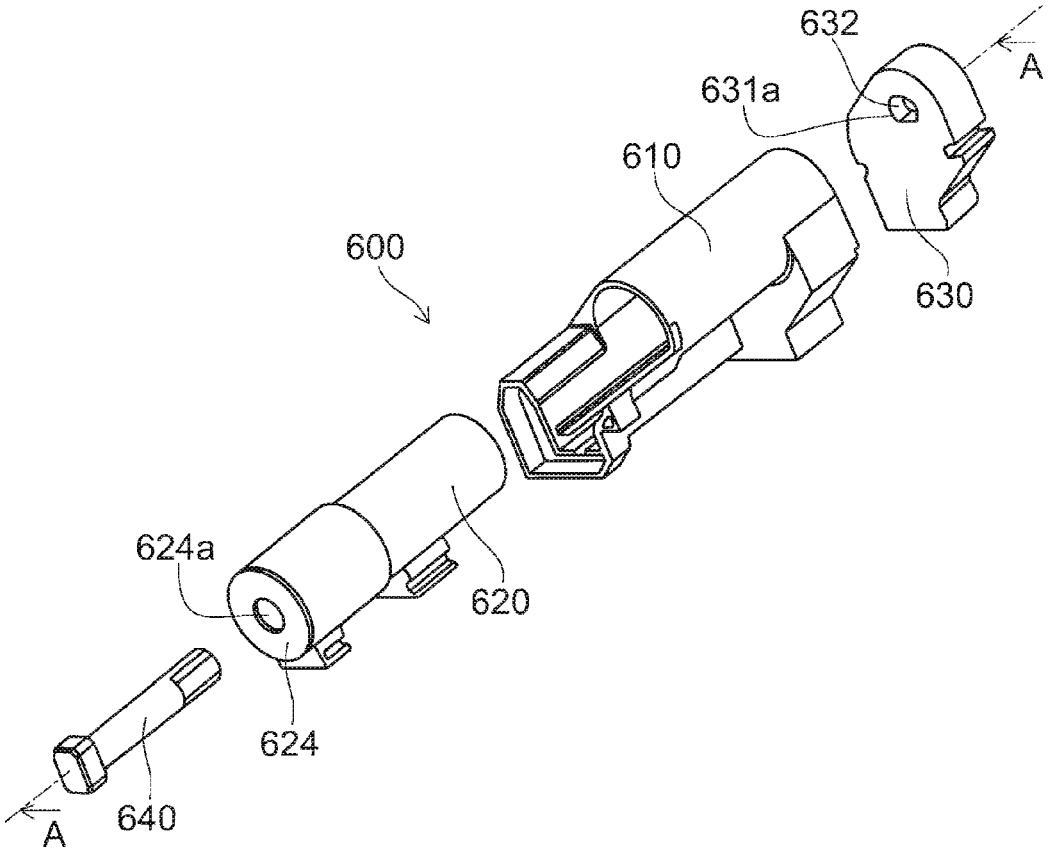
FIG. 27 is an exploded schematic view showing the rotation decelerator of this embodiment.

FIG. 27 is an exploded schematic view showing the rotation decelerator of this embodiment.

Figure 28:
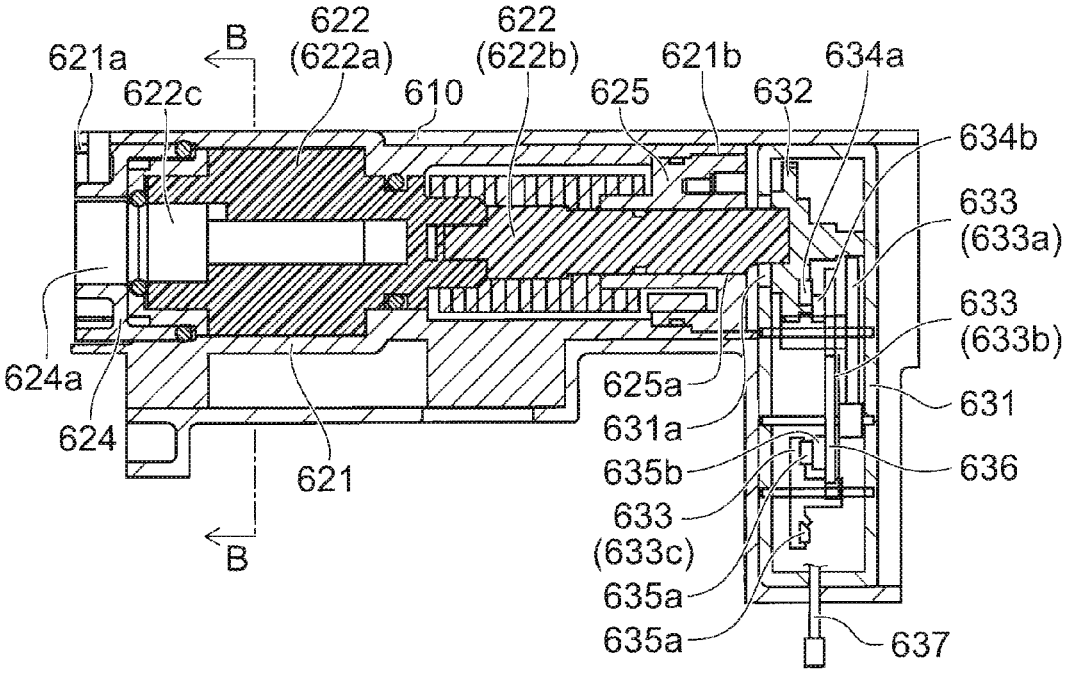
FIGS. 28 and 29 are sectional schematic views showing the rotation decelerator of this embodiment.
Figure 29:
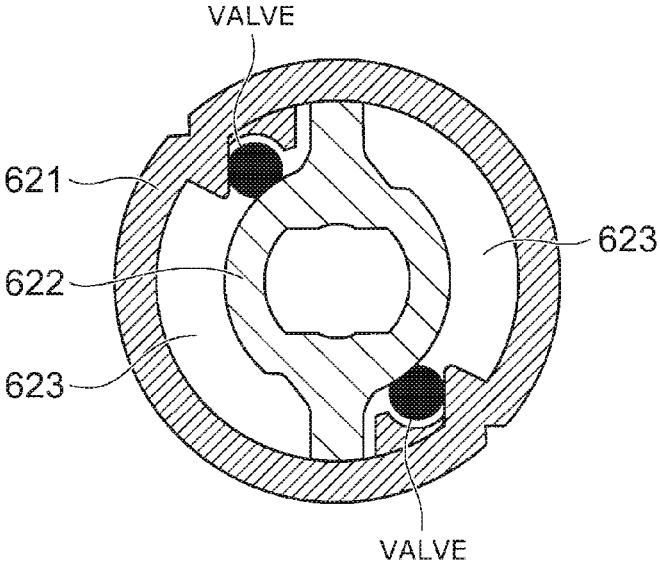

FIGS. 28 and 29 are sectional schematic views showing the rotation decelerator of this embodiment.

More specifically, FIG. 28 is a sectional schematic view taken along cross section A-A shown in FIG. 27.

FIG. 29 is a sectional schematic view taken along cross section B-B shown in FIG. 28.

As shown in FIG. 27, the rotation decelerator 600 includes a tubular mounting stage 610 fixed in the casing 400, and a damper 620 and an opening/closing sensor 630 held in the tube of the mounting stage 610.

The damper 620 and the opening/closing sensor 630 are independent members each having a separate case (casing), and detachably integrated with the mounting stage 610.

As shown in FIG. 28, the damper 620 includes a cylindrical casing 621 having openings 621*a*, 621*b* at both ends, a rotary shaft 622 slidably abutting inside the casing 621, a viscous oil 623 sealed between the casing 621 and the rotary shaft 622, and lids 624, 625 covering the openings 621*a*, 621*b*. The viscous oil 623 functions as a rotation resistance means for applying resistance to the rotation of the rotary shaft 622 in one direction (direction of closing the toilet seat) (see FIG. 29).

The rotary shaft 622 is rotatably fitted inside the casing 621. An opening 624*a* is provided at the center of one lid 624. A pin insertion hole 622*c* formed at one end of the rotary shaft 622 is seen through the opening 624*a*. From this opening 624*a* into the pin insertion hole 622*c*, a holding shaft 640 unrotatably attached to the base of the toilet seat 200 is unrotatably inserted. Furthermore, the other end of the rotary shaft 622 protrudes from an opening 625*a* provided in the other lid 625, and is engaged with a speed-up gear train 633 inside the opening/closing sensor 630.

The rotary shaft 622 may be configured as a single shaft from the pin insertion hole 622*c* to the portion engaged with the speed-up gear train 633. However, in this embodiment, the rotary shaft 622 is divided into two members, i.e., a first rotary shaft 622*a* and a second rotary shaft 622*b*. Of course, although divided, the ends of the first rotary shaft 622*a* and the second rotary shaft 622*b* are unrotatably engaged with each other. Hence, the rotation of the first rotary shaft 622*a* is directly transmitted to the rotation of the second rotary shaft 622*b*.

The opening/closing sensor 630 serves to sense the opening/closing state of the toilet seat 200 or the toilet lid 300. As shown in FIG. 28, the opening/closing sensor 630 includes a case 631, an input shaft 632 housed inside the case 631, a speed-up gear train 633 for speeding up and transmitting the rotation of the input shaft 632, a magnet 634*a* fixed to the input shaft 632, a magnet 635*a* fixed to the last-stage gear (third gear 633*c*) of the speed-up gear train 633, and a Hall IC substrate 636 including Hall ICs 634*b*, 635*b* for sensing the magnetic force of the respective magnets 634*a*, 635*a*. The magnet 634*a* is shaped like an arc with the N pole and S pole separated circumferentially around the input shaft 632. The magnet 635*a* is shaped like a disc with a plurality of N poles and S poles located circumferentially on the third gear 633*c*, which has the largest speed-up ratio with respect to the rotary shaft 622.

To the Hall IC substrate 636, a lead 637 for exchanging signals with the controller 405 is connected.

An opening 631*a* is formed in the side surface of the case 631. The other end of the aforementioned rotary shaft 622 (second rotary shaft 622*b*) is inserted through this opening 631*a* into the case 631 and engaged with the input shaft 632. That is, the rotation of the rotary shaft 622 is directly transmitted to the input shaft 632.

The speed-up gear train 633 includes a first gear 633*a*, a second gear 633*b*, and a third gear 633*c*. The first gear 633*a* speeds up the rotation of the input shaft 632 and transmits it to the second gear 633*b*. The second gear 633*b* speeds up the rotation of the first gear 633*a* and transmits it to the third gear 633*c*.

An angle detecting device for sensing the rotational angle of the input shaft 632 includes the magnet 634*a* fixed to the input shaft 632 and the Hall IC 634*b*. The rotational angle of the input shaft 632 is equal to the rotational angle of the rotary shaft 622. Hence, this angle detecting device can sense the rotational angle of the toilet seat 200, i.e., the position of the toilet seat 200.

A rotation detecting device for sensing the presence or absence of rotation of the third gear 633*c* includes the magnet 635*a* fixed to the third gear 633*c* and the Hall IC 635*b*. The third gear 633*c* is rotated by the rotary shaft 622 through the second gear 633*b*, the first gear 633*a*, and the input shaft 632. Hence, the presence or absence of rotation of the third gear agrees with the presence or absence of rotation of the rotary shaft 622. That is, this rotation detecting device can sense the presence or absence of rotation of the toilet seat 200. Furthermore, instead of directly detecting the rotation of the rotary shaft 622, the rotation detecting device detects the rotation sped up by the speed-up gear train 633. Hence, even if the toilet seat 200 is closed at a slow speed, the presence or absence of its rotation can be readily detected. Furthermore, in the speed-up gear train 633, the third gear 633*c* has the largest speed-up ratio with respect to the rotary shaft 622. Hence, the presence or absence of rotation can be detected more accurately than in the case where the magnets are located on the first gear 633*a* or the second gear 633*b*.

The result of detection by the angle detecting device and the rotation detecting device is extracted by the lead 637 out of the rotation decelerator 600 and outputted to the controller 405. Furthermore, electrical power is supplied from the controller 405 through the lead 637 to the angle detecting device and the rotation detecting device so that the Hall ICs 634*b*, 635*b* can sense the position of the magnets 634*a*, 635*a*.

Thus, the rotation decelerator 600 of this embodiment can sense the rotational angle and the presence or absence of rotation of the toilet seat 200. Hence, the controller 405 can start to energize the electrolytic cell unit 450 to supply sterilizing water to the flow channel 20 on the downstream side of the electrolytic cell unit 450 after the rotation decelerator 600 senses the opening motion of the toilet lid 300. Thus, the flow channel 20 on the downstream side of the electrolytic cell unit 450 is filled and sterilized with the sterilizing water.

Furthermore, in the case where hot water preparation is performed in response to the opening motion of the toilet lid 300, the opening motion of the toilet seat 200 may be sensed simultaneously or immediately after the opening motion of the toilet lid 300. In this situation, preferably, the hot water preparation is not performed, or is stopped in response to the opening motion of the toilet seat 200, so as to avoid wasteful operation of the hot water heater.

As described above, according to this embodiment, after the human body sensing device senses a human body, the controller 405 starts to energize the electrolytic cell unit 450 to supply sterilizing water to the flow channel 20 on the downstream side of the electrolytic cell unit 450. Thus, the flow channel 20 on the downstream side of the electrolytic cell unit 450 is filled and sterilized with the sterilizing water. That is, when there is a possibility that a user utilizes the sanitary washing device 100, the controller 405 can earlier supply the sterilizing water to the flow channel 20 on the downstream side of the electrolytic cell unit 450. Thus, bacteria surviving inside the flow channel 20 can be sterilized at an earlier stage after sensing the possibility of utilization of the sanitary washing device 100.

Furthermore, in the sanitary washing device 100 according to this embodiment, the sterilizing water can be filled and retained for a prescribed time inside the flow channel 20. Thus, bacteria surviving inside the flow channel 20 can be sterilized more reliably so that hygienic water can be squirted from the water discharge port 474. Furthermore, even when a male user urinates in the standing position, urine can be prevented from entering the flow channel 20 from the water discharge port 474 because the flow channel 20 on the downstream side of the electrolytic cell unit 450 is filled with the sterilizing water.

In the foregoing, the embodiments of the invention have been described. However, the invention is not limited to the above description. Those skilled in the art can suitably modify the above embodiments, and such modifications are also encompassed within the scope of the invention as long as they include the features of the invention. For instance, the shape, dimension, material, and layout of various components in the sanitary washing device 100 and the pressure modulator 460, and the installation configuration of the nozzle 473 and the nozzle cleaning chamber 478 are not limited to those illustrated, but can be suitably modified.

The sterilizing water produced in the electrolytic cell unit 450 may be a solution containing metal ions such as silver ions or copper ions. Alternatively, the sterilizing water produced in the electrolytic cell unit 450 may be a solution containing electrolytic chlorine or ozone. Alternatively, the sterilizing water produced in the electrolytic cell unit 450 may be acid water or alkaline water. Furthermore, the sterilizing water producing device is not limited to an electrolytic cell. That is, the sterilizing water may be sterilizing water produced by dissolving a bactericide and a sterilizing liquid in water. Furthermore, the trigger for performing regular sterilization and drainage of the flow channel 20 (the operation at timing t29-t32 shown in FIG. 7) is not limited to the trigger described above with reference to FIG. 7, but can be suitably configured.

In the above embodiments, when the sterilizing water is retained inside the flow channel 20, the flow channel switching valve 472 is illustratively set to "closed", but the invention is not limited thereto. It can be suitably configured as long as the sterilizing water can be retained for a prescribed time inside the flow channel 20.

Furthermore, various components in the above embodiments can be combined with each other as long as technically feasible. Such combinations are also encompassed within the scope of the invention as long as they include the features of the invention.

The invention claimed is:

1. A sanitary washing device comprising:

a nozzle including a water discharge port and configured to squirt water from the water discharge port to wash user's human private parts;

a flow channel configured to supply the water to the water discharge port;

a solenoid valve provided on the upstream side of the flow channel, the solenoid valve being a water supply device configured to supply the water;

a sterilizing water producing device provided midway along the flow channel and being operable to produce sterilizing water which includes sterilizing ingredient;

a flow channel switching valve configured to perform opening and closing water supply to the nozzle;

a vacuum breaker provided on downstream of the solenoid valve and on upstream of the flow channel switching valve; and a controller configured to perform control for stopping the water supply device by closing the solenoid valve, closing the flow channel switching valve, retaining the sterilizing water produced by the sterilizing water producing device for a prescribed time in the flow channel, and then draining the sterilizing water out of the flow channel by opening the flow channel switching valve, and emptying the flow channel.

2. The device according to claim 1, further comprising:

a human body sensing device configured to sense utilization by the user, wherein the controller performs control for filling the flow channel on downstream side of the sterilizing water producing device with the sterilizing water after the human body sensing device senses utilization by the user.

3. The device according to claim 2, further comprising:

a heating device provided on upstream side of the sterilizing water producing device and being operable to heat water supplied to the sterilizing water producing device, wherein the controller performs hot water preparation for operating the water supply device and the heating device to drain the water from the water discharge port when the human body sensing device senses the user, and the controller controls a timing to activate the sterilizing water producing device after starting the hot water preparation based on a time period required to fill the flow channel on the downstream side of the sterilizing water producing device with the sterilizing water.

4. The device according to claim 3, wherein the controller starts to activate the sterilizing water producing device during or after completing the hot water preparation.

5. The device according to claim 3, further comprising:

a first temperature sensing device configured to sense temperature of the water heated by the heating device, wherein the controller starts to activate the sterilizing water producing device when the temperature sensed by the first temperature sensing device reaches a preset temperature.

6. The device according to claim 3, wherein the controller starts to activate the sterilizing water producing device after lapse of a fixed time from the start of the hot water preparation.

7. The device according to claim 3, further comprising:

a second temperature sensing device configured to sense temperature of water supplied to the heating device, wherein the controller sets a suitable temperature continuation time required to fill the flow channel on the downstream side of the sterilizing water producing device with the water heated by the heating device based on the temperature sensed by the second temperature sensing device, and starts to activate the sterilizing water producing device based on the suitable temperature continuation time so that a timing to stop activating the sterilizing water producing device coincides with or precedes a timing to complete the hot water preparation.

8. The device according to claim 3, further comprising:

a second temperature sensing device configured to sense temperature of water supplied to the heating device, wherein the controller includes a memory device configured to store a suitable temperature continuation time required to fill the flow channel on the downstream side of the sterilizing water producing device with the water heated by the heating device based on the temperature sensed by the second temperature sensing device, and starts to activate the sterilizing water producing device by referring to a past one of the suitable temperature continuation time stored in the memory device so that a timing to stop activating the sterilizing water producing device coincides with or precedes a timing to complete the hot water preparation.

9. The device according to claim 2, wherein the human body sensing device is a room entry sensor operable to sense entry of a user into a toilet room.

10. The device according to claim 2, further comprising:

a toilet lid, wherein the human body sensing device is a toilet lid opening/closing sensing device operable to sense an opening motion of the toilet lid.

11. The device according to claim 1, wherein the controller performs a cleaning step configured to clean the nozzle, and performs the control for retaining continuously subsequent to the cleaning step.

12. The device according to claim 1, wherein the controller performs the control for retaining after the user ceases to be sensed.

13. The device according to claim 12, wherein the controller senses leaving of the user from a toilet seat.

14. The device according to claim 1, wherein the controller regularly performs the control for retaining and the control for draining.

15. The device according to claim 1, further comprising:

a human body sensing device operable to sense the user, wherein the controller performs the control for retaining when the human body sensing device senses the user, and the controller performs the control for draining in response to receipt of a signal directing to perform washing of the human private parts.

16. The device according to claim 1, further comprising:

a nozzle cleaning device including a water discharge portion and configured to clean a surface of the nozzle with water discharged from the water discharge portion, wherein the controller discharges the sterilizing water from the water discharge portion, and then completes the hot water preparation by discharging the sterilizing water from only the water discharge port of the nozzle.

17. The device according to claim 1, wherein the sterilizing water producing device is an electrolytic cell.

18. The device according to claim 17, wherein flow rate of water supplied to the electrolytic cell in producing the sterilizing water is lower than maximum flow rate of water flowing in the electrolytic cell.

* * * * *